US009457359B2

(12) United States Patent
Von Stetten et al.

(10) Patent No.: US 9,457,359 B2
(45) **Date of Patent: *Oct. 4, 2016**

(54) DEVICE FOR INSERTION INTO A ROTOR OF A CENTRIFUGE, CENTRIFUGE AND METHOD FOR THE FLUIDIC COUPLING OF CAVITIES

(71) Applicants: Albert-Ludwigs-Universitaet Freiburg, Freiburg (DE); Hahn-Schickard-Gesellschaft fuer angewandte Forschung e.V., Villingen-Schwenningen (DE)

(72) Inventors: Felix Von Stetten, Freiburg (DE); Marion Finkbeiner, Stuttgart (DE); Roland Zengerle, Waldkirch (DE); Nils Paust, Freiburg (DE); Guenter Roth, Freiburg (DE)

(73) Assignees: ALBERT-LUDWIGS-UNIVERSITAET FREIBURG, Freiburg (DE); HAHN-SCHICKARD-GESELLSCHAFT FUER ANGEWANDTE FORSCH, Villingen-Schwennin (DE)

( * ) Notice: Subject to any disclaimer, the term of this patent is extended or adjusted under 35 U.S.C. 154(b) by 863 days.

This patent is subject to a terminal disclaimer.

(21) Appl. No.: 13/624,079

(22) Filed: Sep. 21, 2012

(65) Prior Publication Data

US 2013/0252796 A1 Sep. 26, 2013

Related U.S. Application Data

(63) Continuation of application No. PCT/EP2011/054502, filed on Mar. 23, 2011.

(60) Provisional application No. 61/317,029, filed on Mar. 24, 2010.

(30) Foreign Application Priority Data

Mar. 24, 2010 (DE) ..... 10 2010 003 223

(51) Int. Cl.

| | |
|---|---|
| ***B04B 7/08*** | (2006.01) |
| ***B01L 3/00*** | (2006.01) |
| ***B04B 5/04*** | (2006.01) |

(52) U.S. Cl.

CPC ..... *B04B 7/08* (2013.01); *B01L 3/502* (2013.01); *B01L 3/5025* (2013.01); *B04B 5/0407* (2013.01);

(Continued)

(58) Field of Classification Search

CPC . B04B 5/0414; B04B 5/0421; B04B 5/0407; B04B 2005/0435; B04B 2005/0471; B01L 3/502; B01L 3/5025; B01L 3/5021; B01L 2300/044; B01L 2300/047; B01L 2300/0829; B01L 2400/0409; B01L 2400/0683

USPC ..... 494/4, 8, 9, 16, 20, 81, 37; 422/533, 422/548

See application file for complete search history.

(56) References Cited

U.S. PATENT DOCUMENTS

| | | | | |
|---|---|---|---|---|
| 3,897,902 | A * | 8/1975 | Yanez, Jr. | 494/10 |
| 3,905,528 | A | 9/1975 | Maiocco | |

(Continued)

FOREIGN PATENT DOCUMENTS

| | | |
|---|---|---|
| AT | 49 658 E | 11/1985 |
| CN | 101229448 A | 7/2008 |

(Continued)

OTHER PUBLICATIONS

Official Communication issued in International Patent Application No. PCT/JP2011/054502, mailed on Aug. 3, 2011.

(Continued)

*Primary Examiner* — Charles Cooley
*Assistant Examiner* — Shuyi S Liu
(74) *Attorney, Agent, or Firm* — Keating & Bennett, LLP

(57) ABSTRACT

A device for insertion into a rotor of a centrifuge has at least two bodies stacked one above the other in a stacking direction inside a housing insertable into a holder of the rotor of the centrifuge. The two bodies are movably disposed in relation to each other inside the housing in order to fluidically couple, in a first phase, responding to a rotation of the rotor, a first cavity of the first body to a first cavity of the second body and to fluidically couple in a second phase a second cavity of the first body to the first cavity of the second body.

24 Claims, 29 Drawing Sheets

(52) U.S. Cl.
CPC ..... *B04B 5/0421* (2013.01); *B01L 3/5021* (2013.01); *B01L 3/50255* (2013.01); *B01L 2300/044* (2013.01); *B01L 2300/047* (2013.01); *B01L 2300/049* (2013.01); *B01L 2300/0681* (2013.01); *B01L 2300/0829* (2013.01); *B01L 2400/0409* (2013.01); *B01L 2400/065* (2013.01); *B01L 2400/0683* (2013.01); *B04B 2005/0435* (2013.01)

(56) References Cited

U.S. PATENT DOCUMENTS

| | | | | |
|---|---|---|---|---|
| 4,119,407 | A * | 10/1978 | Goldstein et al. | 422/413 |
| 4,190,530 | A * | 2/1980 | Forsythe et al. | 210/656 |
| 4,812,294 | A * | 3/1989 | Combs | 422/72 |
| 5,045,047 | A * | 9/1991 | Hutchins et al. | 494/17 |
| 5,087,369 | A | 2/1992 | Tanimoto et al. | |
| 5,171,533 | A * | 12/1992 | Fine | G01N 21/07 210/516 |
| 5,449,621 | A * | 9/1995 | Klein | 436/45 |
| 6,401,552 | B1 * | 6/2002 | Elkins | 73/863 |
| 6,770,244 | B2 * | 8/2004 | Hool et al. | 422/72 |
| 7,976,796 | B1 * | 7/2011 | Smith et al. | 422/548 |
| 2001/0016224 | A1 | 8/2001 | Huttlin | |
| 2002/0015355 | A1 | 2/2002 | Sanpei et al. | |
| 2003/0205097 | A1 * | 11/2003 | Wickstead et al. | 73/863.32 |
| 2005/0260100 | A1 * | 11/2005 | Leif | 422/72 |
| 2010/0152013 | A1 | 6/2010 | Eberle et al. | |
| 2010/0288060 | A1 * | 11/2010 | Ronsick et al. | 73/864.63 |
| 2012/0167672 | A1 * | 7/2012 | Miller | 73/61.59 |
| 2012/0304484 | A1 | 12/2012 | Ramhold et al. | |
| 2012/0314532 | A1 * | 12/2012 | Daub et al. | 366/200 |
| 2013/0344496 | A1 * | 12/2013 | Peytavi et al. | 435/6.12 |
| 2015/0024384 | A1 * | 1/2015 | Peyvan | 435/6.1 |

FOREIGN PATENT DOCUMENTS

| | | | | |
|---|---|---|---|---|
| DE | 524 254 | C | 4/1931 | |
| DE | 36 87 588 | T2 | 5/1993 | |
| DE | 198 38 540 | A1 | 3/2000 | |
| DE | 10 2007 000 310 | A1 | 12/2008 | |
| EP | 0 198 462 | A2 | 10/1986 | |
| EP | 0 160 282 | B1 | 1/1990 | |
| EP | 402669 | A * | 12/1990 | |
| EP | 1901054 | A2 * | 3/2008 | B01F 13/0059 |

OTHER PUBLICATIONS

Paust et al., "Mixer for Insertion Into a Rotor of a Centrifuge,", U.S. Appl. No. 13/624,085, filed Sep. 21, 2012.

* cited by examiner

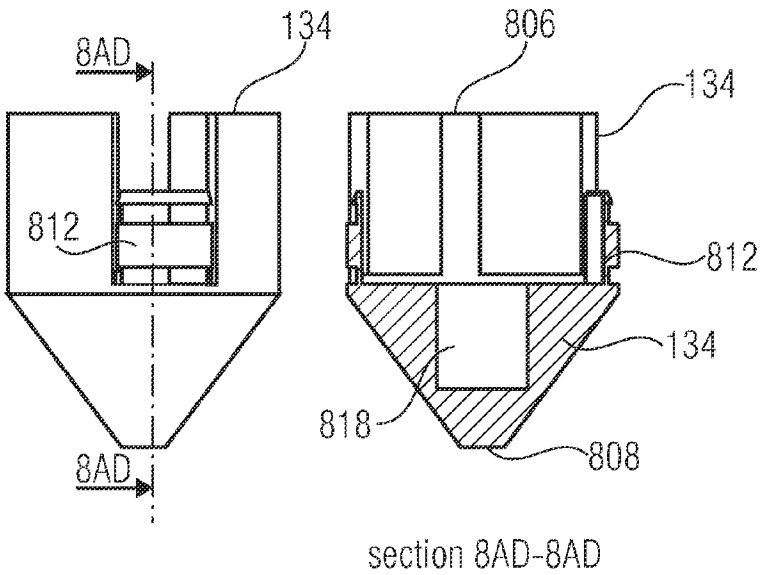
FIG. 8AD
FIG. 8AC
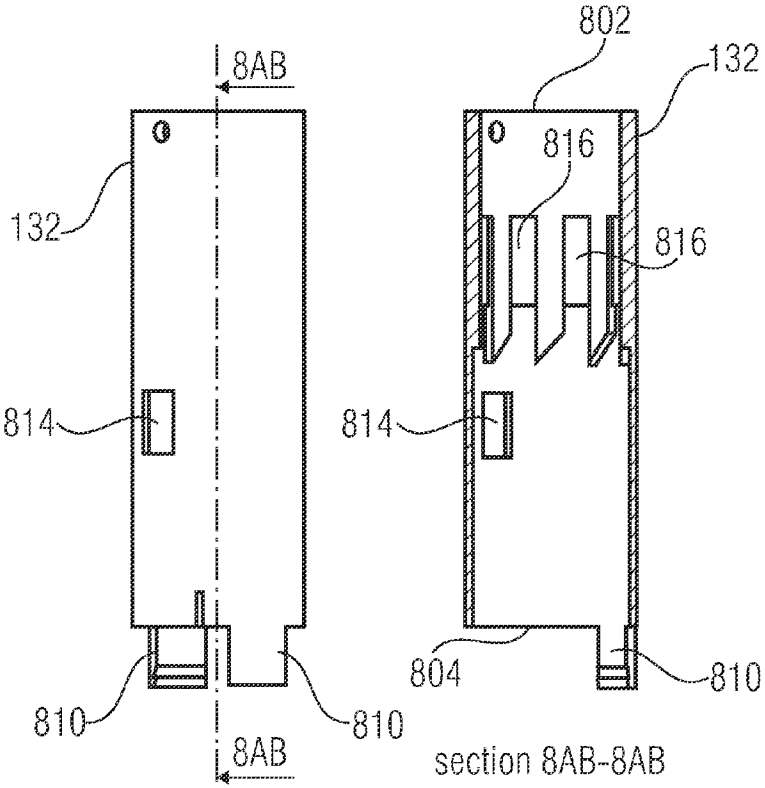
FIG. 8AB
FIG. 8AA section 8CE-8CE

DEVICE FOR INSERTION INTO A ROTOR OF A CENTRIFUGE, CENTRIFUGE AND METHOD FOR THE FLUIDIC COUPLING OF CAVITIES

CROSS-REFERENCE TO RELATED APPLICATIONS

This application is a continuation of copending International Application No. PCT/EP2011/054502, filed Mar. 23, 2011, which is incorporated herein by reference in its entirety, and additionally claims priority from German Application No. DE 102010003223.9-23, filed Mar. 24, 2010 and U.S. Patent Application No. 61/317,029, filed Mar. 24, 2010, all of which are incorporated herein by reference in their entirety.

BACKGROUND OF THE INVENTION

Embodiments of the invention relate to a device for insertion into a rotor of a centrifuge such as, for example, on a standard laboratory centrifuge. Further embodiments relate to a method for coupling cavities fluidically. Further embodiments refer to a centrifuge.

The implementation of (bio)chemical processes needs the handling of liquids. On the one hand, this occurs manually with the assistance of pipettes, reaction vessels and further auxiliary process means such as, for example, columns or magnetic particles and laboratory equipment and, on the other hand, automatically relying on pipetting robots or other special instruments.

So-called lab-on-a-chip (LOC; i.e., laboratories on a micro-component) systems seek to automate individual process steps, simplify the handling of process liquids and target the development of cost-effective, compact systems. The main objective of lab-on-a-chip systems is miniaturization.

For the most part, lab-on-a-chip systems include an arrangement of two main components. Typical lab-on-a-chip systems therein have a passive fluidic disposable cartridge (also referred to as test carrier) that contains channels, reaction chambers as well as pre-stored reagents and, moreover, an active instrument that contains actuator components as well as detection and control units. This active instrument is typically adjusted to the requirements of the fluidics cartridge. Therefore, such instruments are associated with high costs in terms of development, manufacturing and acquisition. This is the reason why efforts are underway to automate (bio)chemical processes that need only minimal instrumentation or none at all. Examples for this are testing strips (also referred to as a lateral flow test). Such approaches, however, often suffer from the disadvantage that processes that are expediently automated can only comprise few steps; moreover, their sensitivity is limited. For many (bio)chemical processes (for example, synthesis, analysis and filtration), centrifuging is an essential component of processing. A centrifugal force that is generated by centrifuging action therein is used either for the transportation of liquids from a processing step that is radially further to the inside to a processing step that is radially located at the outside, or for purposes of material separation on the basis of varying densities.

Therefore, centrifuges are an essential aspect in any laboratory that handles (bio)chemical processes.

To be detailed below are automated systems that allow for handling several process steps in the context of (bio)chemical processes in an automated fashion.

Pipetting robots with integrated centrifuge have already been known in the art. Systems of this type have a pipetting robot with a pick-up device and an integrated centrifuge allowing, for example, for the automated filtration of DNA, RNA and proteins. In certain systems therein, it is possible to purify up to twelve samples per run.

A disadvantage of such automated system for customers are the high costs associated with the acquisition of special equipment, extra space requirements inside the laboratory and the needed familiarization period for qualified personnel.

Other special instruments utilize a non-centrifugal automation alternative for handling liquids. With such so-called fluidically integrated systems, it is possible to separate (nucleic acid extraction) and analyze samples (for example, for a so-called PCR in real time). To implement the tests, special containers are needed that are adjusted to the fluidically integrated system. Said containers and/or reaction vessels consist of a flexible hose that is separated by septa. The needed reagents are pre-stored inside the compartments that are thus created by the septa. Handling of the liquids takes place by means of pestles pressing against the hose thereby functioning, on the one hand, as a valve and, on the other hand, as a pump.

Using this automated system, it is possible to automate various (bio)chemical processes; however, once again, acquisition of specialized and expensive equipment is needed. Therefore, this system has the same disadvantages as the system mentioned previously.

Moreover, so-called special centrifuges for the processing of liquids have been in existence.

Document U.S. Pat. No. 4,190,530 (also published as DE 2912676 A1) discloses a specially developed centrifuge having different collecting receptacles that are disposed in a radial arrangement. The collecting receptacles therein are disposed at different spacings in relation to an axis of rotation of a rotor of the centrifuge in swing-out cup holders. The centrifuge as shown in the specification thereby allows for processing multiple fluids via different paths from a location that is in closer proximity relative to the axis of relation to a location that is at a greater distance relative to the axis of rotation. A fluid therein flows through a separation column into a first radially inside-located collecting receptacle. Located at the radially outside location are multiple collecting receptacles into which the fluid, having flowed over the separation column, can flow. By means of acceleration forces, the fluid is guided to the outside via different paths. This allows the fluid to reach different collecting receptacles. Using this system, beginning with a starting cavity at the radially inner location, different fluidic paths in the centrifuge can be embodied. In particular, using valves and lines inside the centrifuge as well as nozzles, the fluid is brought into the radially inner collecting receptacle. A disadvantage of the apparatus is that fluids of different starting cavities are not guided via the same path. Moreover, the equipment needs a special design and manufacture, thus resulting in high costs.

Document U.S. Pat. No. 5,045,047 discloses a centrifuge apparatus having a rotor with an inner and an outer ring. So-called inner containers are disposed on the inner ring, and so-called outer containers are disposed on the outer ring. In addition, the centrifuge apparatus that is disclosed in the specification includes a mechanism for preventing any radial alignment of the inner containers that is generated due to the centrifugal force. This allows for a partial alignment of the inner containers with the outer containers, whereby a fluid from an inner container is able to flow, due to the centrifugal force generated by a rotation of the rotor of the centrifuge apparatus, into an associated outer container. The specification describes this state as the aligned state. In a non-aligned state, meaning when the inner container are held such as prevent them to from being able to radially align themselves, it is possible to empty the inner containers. A disadvantage of this disclosed centrifuge apparatus is the fact that fluids from different inner containers cannot be routed into a common outer container. It is especially disadvantageous that the centrifuge apparatus, as described previously, is a piece of specialized equipment with only a limited range of applications and associated very high costs.

Document U.S. Pat. No. 5,087,369 (also published as DE 68923835 T2) discloses a method for the separation and recovery of proteins that are present inside liquids, specifically using a rotary column. Based on the rotation of the column, the fluid is circulated from an inner cylinder into an outer cylinder chamber. Again, it is disadvantageous that the fluids from different starting cavities cannot be routed into a common end cavity.

Consequently, automated systems suffer from the substantial disadvantage, in particular, that they are associated with high additional fixed costs because they rely on the purchase of special equipment. As a result, the market launch of such systems is rendered more difficult.

An alternate solution to the automated handling of liquids for the implementation of chemical and (bio)chemical processes is the manual handling of the liquids. Disadvantages associated with any manual handling are the many needed individual operating steps, such as, for example, for DNA extractions, that are to be carried out by especially trained personnel in extremely time-consuming process steps. Furthermore, there is a risk of cross contamination of the handled liquids.

SUMMARY

According to an embodiment, a device for insertion into a rotor of a centrifuge may have at least two bodies stacked one above the other; and a housing that is configured in order to be inserted into a holder of the rotor of the centrifuge; wherein the at least two bodies in the housing are disposed in a stacking direction in such a way that, upon a correct reception of the device in the rotor of the centrifuge and rotation of the rotor, a spacing of one body of the at least two bodies in relation to an axis of rotation of the rotor is smaller than a spacing of another body of the at least two bodies in relation to the axis of rotation of the rotor; wherein a first body of the at least two bodies has at least one first cavity and a second cavity; wherein a second body of the at least two bodies has at least one first cavity; wherein the at least two bodies are movably disposed in relation to each other inside the housing in order to fluidically couple in a first phase, responding to a rotation of the rotor, the first cavity of the first body to the first cavity of the second body and in order to fluidically couple, in a second phase, the second cavity of the first body to the first cavity of the second body; a restorer; wherein the restorer exercises a restoring force on at least one of the at least two bodies in order to hold, depending on the angular velocity of the restoring force of the rotor, the at least two bodies in a given position in relation to the housing; and wherein the restorer is configured such that a first amount of a force that is based on a centrifugal force acting in a direction opposite to the restoring force is greater at a first angular velocity in the first phase than an amount of the restoring force, and such that a second amount of the force acting in the direction opposite the restoring force is smaller at a second angular velocity during a transition from the first phase to the second phase than the amount of the restoring force such that during the transition from the first phase to the second phase at least one of the at least two bodies moves inside the housing.

An embodiment may have a centrifuge with a device for insertion into a rotor of a centrifuge which may have at least two bodies stacked one above the other; and a housing that is configured in order to be inserted into a holder of the rotor of the centrifuge; wherein the at least two bodies in the housing are disposed in a stacking direction in such a way that, upon a correct reception of the device in the rotor of the centrifuge and rotation of the rotor, a spacing of one body of the at least two bodies in relation to an axis of rotation of the rotor is smaller than a spacing of another body of the at least two bodies in relation to the axis of rotation of the rotor; wherein a first body of the at least two bodies has at least one first cavity and a second cavity; wherein a second body of the at least two bodies has at least one first cavity; wherein the at least two bodies are movably disposed in relation to each other inside the housing in order to fluidically couple in a first phase, responding to a rotation of the rotor, the first cavity of the first body to the first cavity of the second body and in order to fluidically couple, in a second phase, the second cavity of the first body to the first cavity of the second body; a restorer; wherein the restorer exercises a restoring force on at least one of the at least two bodies in order to hold, depending on the angular velocity of the restoring force of the rotor, the at least two bodies in a given position in relation to the housing; and wherein the restorer is configured such that a first amount of a force that is based on a centrifugal force acting in a direction opposite to the restoring force is greater at a first angular velocity in the first phase than an amount of the restoring force, and such that a second amount of the force acting in the direction opposite the restoring force is smaller at a second angular velocity during a transition from the first phase to the second phase than the amount of the restoring force such that during the transition from the first phase to the second phase at least one of the at least two bodies moves inside the housing.

According to another embodiment, a method for fluidically coupling cavities may have the steps of rotating a rotor of a centrifuge at a first velocity; wherein a housing is inserted into a holder of the rotor, in which at least two bodies, with one stacked above the other, are disposed in a stacking direction such that upon a rotation of the rotor a spacing of one of the at least two bodies is smaller in relation to an axis of rotation of the rotor than a spacing of another of the at least two bodies in relation to the axis of rotation of the rotor; wherein a first of the at least two bodies has at least a first and a second cavity; wherein a second of the at least two bodies has at least a first cavity; wherein the at least two bodies are movably disposed in relation to each other inside the housing in order to fluidically couple, responding to a rotation of the rotor, in a first phase, the first cavity of the first body to the first cavity of the second body and in order to fluidically couple, in a second phase, the second cavity of the first body to a first cavity of the second body; wherein the first velocity is selected such that the first cavity of the first body is fluidically coupled to the first cavity of the second body; wherein, furthermore, the housing has a restorer; wherein the restorer exercises a restoring force on at least one of the at least two bodies in order to hold, depending on the angular velocity of the rotor, the at least two bodies in a given position in relation to the housing; wherein the restorer is configured such that a first amount of a force, which is based on the centrifugal force acting in the opposite direction of the restoring force, is greater at a first angular velocity in the first phase than an amount of the restoring force and such that a second amount of the force acting in the opposite direction of the restoring force is smaller at a second angular velocity during the transition from the first phase to the second phase than the amount of the restoring force such that, during the transition from the first phase to the second phase, at least one of the two bodies inside the housing moves; and changing the velocity of the rotor of the centrifuge such that the second cavity of the first body is fluidically coupled to the first cavity of the second body.

According to another embodiment, a method for producing a labeled starting material is used for fluidically coupling cavities, which may have the steps of rotating a rotor of a centrifuge at a first velocity; wherein a housing is inserted into a holder of the rotor, in which at least two bodies, with one stacked above the other, are disposed in a stacking direction such that upon a rotation of the rotor a spacing of one of the at least two bodies is smaller in relation to an axis of rotation of the rotor than a spacing of another of the at least two bodies in relation to the axis of rotation of the rotor; wherein a first of the at least two bodies has at least a first and a second cavity; wherein a second of the at least two bodies has at least a first cavity; wherein the at least two bodies are movably disposed in relation to each other inside the housing in order to fluidically couple, responding to a rotation of the rotor, in a first phase, the first cavity of the first body to the first cavity of the second body and in order to fluidically couple, in a second phase, the second cavity of the first body to a first cavity of the second body; wherein the first velocity is selected such that the first cavity of the first body is fluidically coupled to the first cavity of the second body; wherein, furthermore, the housing has a restorer; wherein the restorer exercises a restoring force on at least one of the at least two bodies in order to hold, depending on the angular velocity of the rotor, the at least two bodies in a given position in relation to the housing; wherein the restorer is configured such that a first amount of a force, which is based on the centrifugal force acting in the opposite direction of the restoring force, is greater at a first angular velocity in the first phase than an amount of the restoring force and such that a second amount of the force acting in the opposite direction of the restoring force is smaller at a second angular velocity during the transition from the first phase to the second phase than the amount of the restoring force such that, during the transition from the first phase to the second phase, at least one of the two bodies inside the housing moves; and changing the velocity of the rotor of the centrifuge such that the second cavity of the first body is fluidically coupled to the first cavity of the second body.

Embodiments according to the present invention provide a device for insertion into a rotor of a centrifuge. The device includes at least two bodies that are stacked one above the other and a housing. The housing is constructed such in order to be inserted into a holder of the rotor of a centrifuge. The at least two bodies are disposed inside the housing in a stacking direction such that, with a correct reception of the device in the rotor of the centrifuge and upon a rotation of the rotor, the spacing of one of the at least two bodies in relation to an axis of rotation is less than the spacing of another of the at least two bodies in relation to the axis of rotation of the rotor. A first of the at least two bodies therein has at least one first and one second cavity, and a second of the at least two bodies has at least one first cavity. The at least two bodies are disposed inside the housing so as to be movable with respect to one another in order, responding to a rotation of the rotor, in a first phase, to couple the first cavity of the first body to the first cavity of the second body fluidically and in order to, in a second phase, couple the second cavity of the first body to the first cavity of the second body fluidically.

A core idea of the present invention posits the possibility of providing an improved concept for the automated handling of liquids, such as, for example, in (bio)chemical processes, that does not need the use of any special equipment for the automated processing of liquids; instead, it is entirely possible to use standard laboratory equipment such as, for example, a standard centrifuge, which is typically a component of any (bio)chemical laboratory, and wherein the processing takes place automatically inside the centrifuge and is controlled by the rotation of the rotor of the centrifuge. Since a centrifuge of this kind is an integral components of any laboratory, contrary to the specialized equipment as provided by standard technology, this solution does not generate any additional fixed costs in terms of special equipment purchasing. Embodiments according to the present invention are configured such that they can be inserted into a holder of a rotor such as, for example, a swivel cup holder of a rotor.

Embodiments according to the present invention thereby allow for processing different fluids inside a closed apparatus (for example, one container), and wherein the different fluids can have been be pre-stored inside the device (for example, inside the first cavity and the second cavity of the first body). In a first phase, based on a centrifugal force generated by the rotor of the centrifuge, a fluid can flow from the first cavity of the first body into the first cavity of the second body (because the first cavity of the first body is fluidically coupled to the first cavity of the second body). In a second phase, during which the second cavity of the first body is fluidically connected to the first cavity of the second body, it is possible for a fluid to flow from the second cavity of the first body into the first cavity of the second body, again due to the centrifugal force that is generated by the rotation of the rotor. The device can remain inside the centrifuge during this process; particularly, any interaction with a user is not needed.

Embodiments thereby allows for automating the process of handling liquids that are not reliant on expensive special equipment; instead, the process can be implemented using standard instruments that is typically available in any (bio) chemical laboratory. The laboratory centrifuge is such a standard device that is widely used in the manual handling of many processes.

Embodiments according to the invention can thus be employed for automating the liquid handling inside a laboratory centrifuge pursuing the objective of automating chemical and (bio)chemical processes such as, for example, DNA extraction.

Contrary to previously known special instruments, the embodiments are not associated with any significant fixed costs; instead, in terms of their nature, they are essentially comparable with the disposable plastic items that are used for the implementation of laboratory protocols anyway.

Moreover, any interaction between user and device has been reduced to an absolute minimum, which means available expert personnel is not needed for the use of the device.

As seen in embodiments according to the present invention, the needed auxiliary process means, such as, for example, reaction vessels, reagents or solid phases, can already be device components (for example, they can be present in the cavities of the device).

Embodiments according to the present invention thereby allow for automating the implementation of processes such as DNA extractions, immunoassays or the syntheses of radiopharmaceuticals inside a centrifuge such as, for example, a laboratory centrifuge.

Some embodiments according to the present invention envision that, during a transition from the first phase to the second phase, it is possible for a position of the two bodies to change in relation to each other. A position of the first body with regard to the second body is different in the first phase in comparison to a position of the first body with regard to the second body in the second phase. In the first phase therein, the first cavity of the first body is coupled to the first cavity of the second body; and in the second phase, the second cavity of the first body is coupled to the first cavity of the second body. The transition from the first phase to the second phase therein can occur in response to a change of the angular velocity of the rotor with regard to the angular velocity of the rotor in the first phase. Embodiments thereby allow for fluidically coupling different cavities within the device, based respectively, on an angular velocity, meaning a rotation rate of the rotor of a centrifuge. In other words, any fluidic coupling of the cavities can be initiated by a centrifugation protocol of the centrifuge.

According to some embodiments, the transition from the first phase to the second phase can occur without change of direction of the rotation of the rotor of the centrifuge. During the transition from the first phase to the second phase, it is, moreover, possible for an amount of the angular velocity of the rotor to be greater than zero. In other words, embodiments according to the present invention can also be utilized in centrifuges that only allow only for one movement in one preset direction. Embodiments according to the present invention, therefore, do not pose any additional requirements for a centrifuge than those from previously known (manual) processing methods.

Some embodiments according to the present invention envision that the bodies can be cylindrical bodies, and wherein each of the bodies includes a cover side as well as a base side opposite thereto in the stacking direction. A base side of the first body can be disposed opposite a cover side of the second body. The first and the second cavities of the first body can be adjacent to the base side of the first body; and the first cavity of the second body can be adjacent to the cover side of the second body. The device therein can be configured such that one of the two bodies (for example, the second body) twists with regard to the other body (for example, the first body) around an axis of rotation of the two bodies that extends in the stacking direction. In other words, in the first phase, the second body can be disposed in a first position in relation to the first body; and in the second phase, the second body can be disposed, with regard to the first body, in a position that is twisted in relation to the first position. Furthermore, the housing can include at least in one region a circular cross-section, thereby corresponding, for example, in its external shape to a standard centrifuge tube. Such a standard centrifuge tube can have a volume of, for example, 2 ml, 12 to 18 ml, 50 ml or 500 ml.

According to a further embodiment, the cavities (for example, the first and the second cavities of the first body) can include closing means, and wherein the device can be configured such that a closing means of the first cavity of the first body is opened in the first phase and a closing means of the second cavity of the first body is opened in the second phase. Embodiments according to the present invention thus allow for pre-storing certain reagents inside the cavities, which are then opened during a phase in which said reagents are needed. In the same way as a coupling of the different cavities occurs in response to a rotation of the rotor, the opening of the closing means of the cavities can also occur in response to a rotation of the rotor.

According to some embodiments, the closing means can be, for example, membranes, and the second body can include, for example, at least one piercer on the cover side thereof, which is configured such that it perforates, responding to a rotation of the rotor, at least one of the membranes.

According to further embodiments, a spacing between the two bodies can be variable in such a way that, for example, upon a transition from the first phase to the second phase, a spacing of the two bodies is greater than a spacing of the two bodies in relation to each other in the first phase and in the second phase. For example, it is possible to use a change of the spacing of the two bodies relative to each other for opening closing means of the cavities or to be able to displace the two bodies in relation to each other during the transition from the first phase to the second phase, however also, to achieve, furthermore, a tight fluidic coupling of the cavities of the two bodies in the first phase and in the second phase.

According to some embodiments, the housing can include at least two housing parts that can be separated from each other such that, upon separating the at least two housing parts, at least one of the at least two bodies can be removed from the device. Correspondingly, following completion of the automated processing of the liquids, for example, the device can be removed from the centrifuge and after that, by separating the two housing parts of the housing, it is possible to remove one of the two bodies from the housing such as, for example, the second body along with an eluate that is present in a cavity of the second body and needed for further use.

Some embodiments according to the present invention envision that the at least two bodies can be configured as microtiter plates, meaning as plates having arranged thereupon a field of rows or wells. The plates therein are displaceable in relation to each other.

BRIEF DESCRIPTION OF THE DRAWINGS

Embodiments according to the present invention shall be described in further detail below based on the enclosed figures.

DETAILED DESCRIPTION OF THE INVENTION

Before explaining the present invention in further detail using the figures, it is to be noted that identical elements or functionally identical elements in the figures are marked by the same reference symbols; in addition, any repetitions of same descriptions have been omitted. The description of elements with identical reference symbols are, therefore, interchangeable and/or applicable to each other in the different embodiments.

Figure 1A:
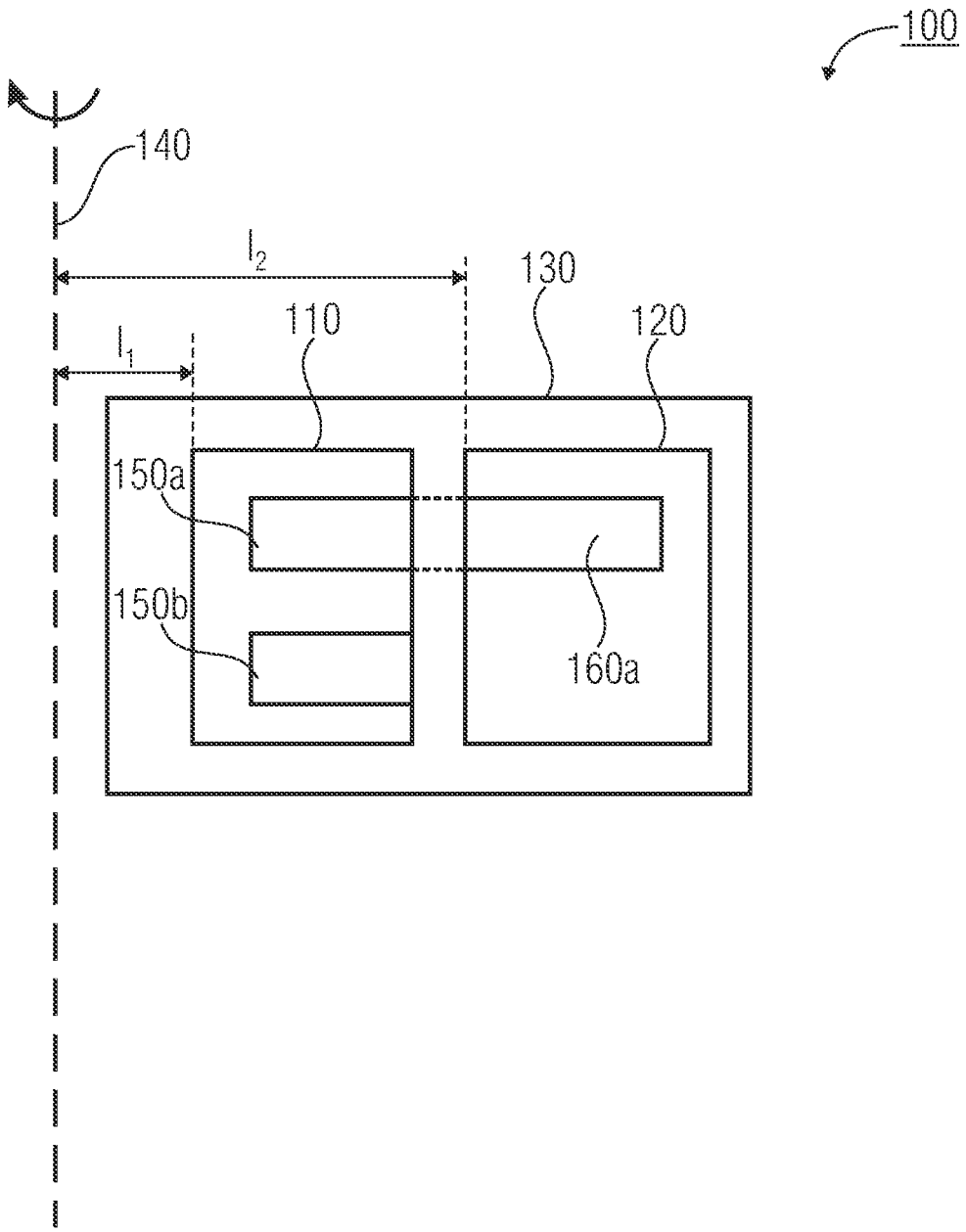
FIG. 1A is a schematic representation of a device according to an embodiment of the present invention in a first phase.
Figure 1B:
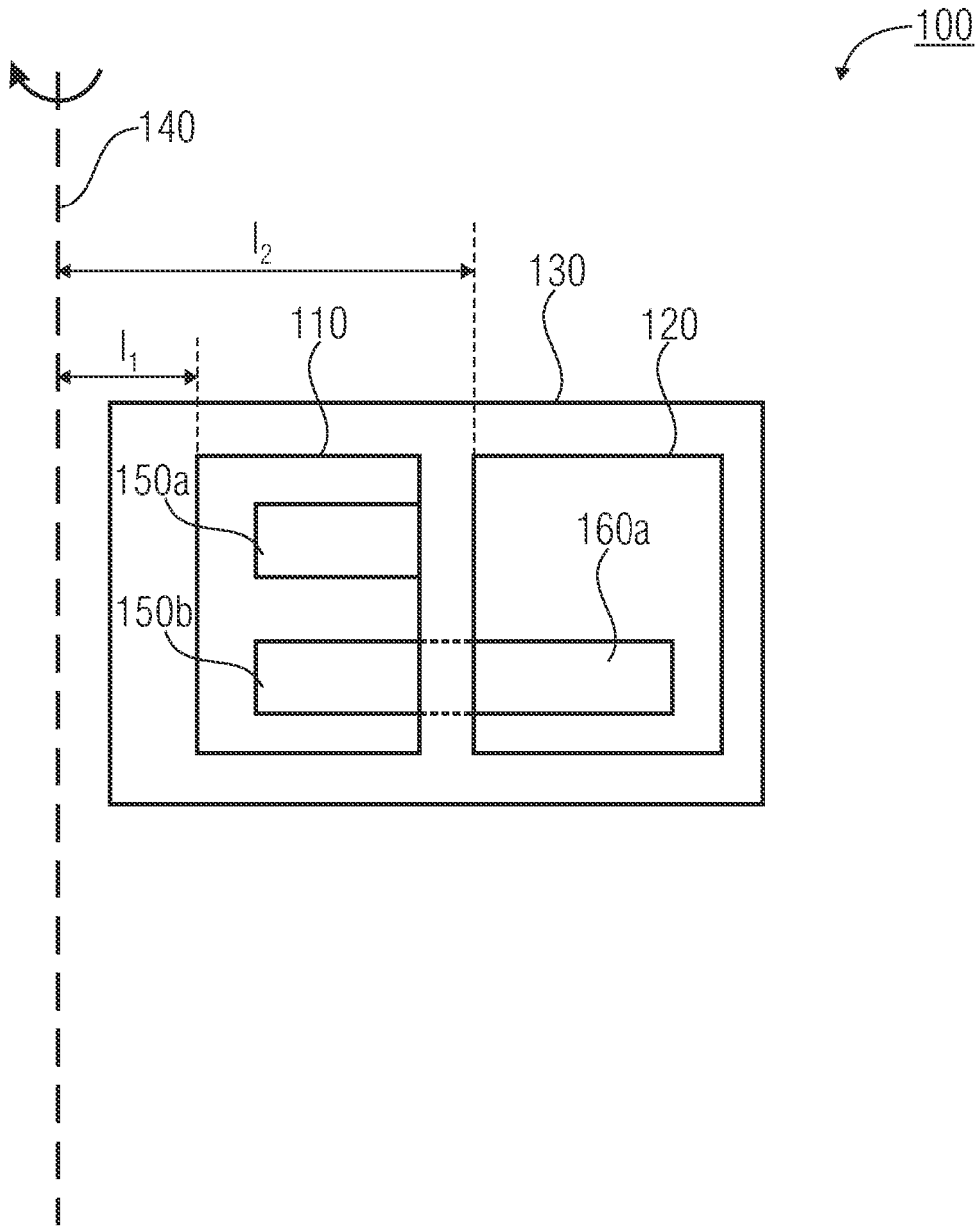
FIG. 1B is a schematic depiction of the device from FIG. 1A in a second phase.

FIGS. 1A and 1B depict a device 100 according to an embodiment of the present invention in two different phases of device 100. The device 100 for insertion into a rotor of a centrifuge includes two bodies 110, 120, stacked one above of the other and that can be separated from each other. Moreover, the device 100 includes a housing 130 that is configured such that it can be inserted into a holder of the rotor of the centrifuge. The two bodies 110, 120 are disposed inside the housing 130 in a stacking direction such that, with a correct reception the device 100 in the rotor of the centrifuge and upon rotation of the rotor, a spacing $l_1$ of one of the two bodies 110, 120 in relation to an axis of rotation 140 of the rotor is smaller than a spacing $l_2$ of another of the two bodies 110, 120 in relation to the axis of rotation 140 of the rotor. A first body 110 of the two bodies 110, 120 has a first cavity 150*a* and a second cavity 150*b*. A second body 120 of the two bodies 110, 120 has a first cavity 160*a*. The two bodies 110, 120 are movably disposed in relation to each other inside the housing 130 in order to fluidically couple, responding to a rotation of the rotor, in a first phase, the first cavity 150*a* of the first body 110 with the first cavity 160*a* of the second body 120 and to fluidically couple, in a second phase, the second cavity 150*b* of the first body 110 with the first cavity 160*a* of the second body 120.

In device 100 as shown in FIGS. 1A and 1B, upon a rotation of the rotor, with a spacing $l_1$, the first body 110 is disposed closer to the axis of rotation 140 of the rotor than the second body 120 that is disposed as a spacing $l_2$.

According to further embodiments, it is also possible, however, for the two bodies 110 and 120 to be disposed such inside the housing 130 that the spacing $l_2$ of the second body 120 is smaller in relation to the axis of rotation 140 upon a rotation of the rotor than the spacing $l_1$ of the body 110 in relation to the axis of rotation 140 of the rotor.

In the first phase of FIG. 1A, the device 100, meaning the first cavity 150*a* of the first body is fluidically coupled to the first cavity 160*a* of the second body 120. Any fluid such as, for example, a reagent that is present in the first cavity 150*a* of the first body 110 can, based on the centrifugal force generated by the rotation of the rotor around the axis of rotation 140, flow from the first cavity 150*a* of the first body 110 into the first cavity 160*a* of the second body 120.

FIG. 1B shows the device 100 in the second phase, meaning the second cavity 150*b* of the first body 110 is coupled to the first cavity 160*a* of the second body 120. Any fluid that is present in the second cavity, such as, for example, a reagent, can thereby, based on a centrifugal force that is generated by the rotation of the rotor around the axis of rotation 140, flow from the second cavity 150*b* of the first body 110 into the first cavity 160*a* of the second body 120.

According to some embodiments, the first cavity 160*a* of the second body 120 can include a mixing apparatus that is configured such as to blend a fluid that flows in the first phase from the first cavity 150*a* of the first body 110 into the first cavity 160*a* of the second body 120 with a fluid that flows in the second phase from the second cavity 150*b* of the first body 110 into the first cavity 160*a* of the second body 120. In particular, the mixing apparatus can be configured to blend the two fluids in response to the rotation of the rotor.

According to further embodiments, it is possible for a further reagent to be pre-stored inside first cavity 160*a* of the second body 120, which, based the process protocol, is to come into contact first with the fluid from the first cavity 150*a* of the first body 110 and thereafter with the fluid from the second cavity 150*b* of the first body 110.

Correspondingly, embodiments allow for an automated processing of liquids such as, for example, in the context of (bio)chemical, chemical or biological processes inside a standard laboratory centrifuge, and without having to remove the device 100 from the centrifuge during processing.

The bodies 110, 120, which are movably disposed inside the housing 130, can be disposed in such a way, as envisioned by some embodiments, that they are displaceable (for example, in a translational fashion) in relation to each other; according to some further embodiments, they can be rotably disposed in relation to each other.

According to some embodiments, during a transition from the first phase to the second phase, a position of the two bodies 110, 120 in relation to each other can change such that that a position of the first body 110 in relation to the second body 120 in the first phase is different from a position of the first body 110 in relation to the second body 120 in the second phase. Moreover, the device 100 can be configured such that the transition from the first phase to the second phase occurs in response of a change of the angular velocity of the rotor with regard to the angular velocity of the rotor in the first phase. In other words, the rotor can have a given angular velocity in the first phase in order to allow a fluid that is present in the first cavity 150*a* of the first body 110 to flow into the first cavity 160*a* of the second body 120. An angular velocity of a rotor can thereupon be changed such that, for example, the second body 120 is displaced or twisted in relation to the first body 110. The device 100 therein can, for example, have an actuating mechanism that changes the position of the two bodies 110, 120 in relation to each other based on a centrifugal force that is generated by the rotation of the rotor.

According to some embodiments, the transition from the first phase to the second phase can occur without change of the direction of rotation of the rotor in relation to the centrifuge, such that, during the transition from the first phase to the second phase, an amount of the angular velocity of the rotor is greater zero. In other words, some embodiments envision that the centrifuge cannot be stopped to bring the device 100 into the second phase. In contrast, in the context of known manual methods, a first fluid is, for example, added to a centrifuge cup, the same is centrifuged in the centrifuge, then the centrifuge is brought to a halt in order to add a second fluid to this centrifuge cup to then centrifuge the same together with the first fluid inside the centrifuge. Embodiments according to the present invention, therefore, simplify handling during the processing of different liquids in comparison to manual methods.

According to some embodiments, one of the cavities of the device 100 can have closing means, and wherein the device 100 is configured such that it opens the closing means. Correspondingly, the first cavity 150*a* and the second cavity 150*b* of the first body 110 can, for example, each have a closing means; and the device 100 can be configured such as to open the closing means of the first cavity 150*a* of the first body 110 in the first phase and the closing means of the second cavity 150*b* of the first body 110 in the second phase. Opening of the closing means therein can occur, for example, in that an angular velocity of the rotor is increased to the point when a fluid, which is present inside the respective cavity, exercises such an amount of pressure on the closing means as to cause the closing means to burst. Furthermore, the closing means of the first cavity 150*a* of the first body 110 can be configured such that it bursts at a lower angular velocity than the closing means of the second cavity 150*b* of the first body 110. According to further embodiments, however, a body that is located opposite from the cavity of the two bodies 110, 120, such as, for example, the second body 120, can include a piercer that is configured such as to open up at least one of the closing means. Correspondingly, in response to the rotation of the rotor (for example, as a function of a certain angular velocity of the rotor), the piercer can perforate at least one of the closing means causing the fluid that is present inside the cavity, which is closed by the closing means, to be released.

According to further embodiments, the device 100 can be configured such that a spacing of the two bodies 110, 120 is greater during the transition from the first phase to the second phase than a spacing of the two bodies 120, 130 in relation to each other in the first phase and in the second phase. It is possible, for example, for the two bodies 110, 120 to touch each other directly in the first phase and in the second phase in order to ensure a leak-proof fluidic connection between the first cavity 150*a* of the first body 110 and the first cavity 160*a* of the second body 120 and/or of the second cavity 150*b* of the first body 110 and the first cavity 160*a* of the second body 120. Furthermore, during the transition from the first phase to the second phase, a spacing of the two bodies 110, 120 can be greater, for example, to ensure that any displacement of the bodies in relation to each other occurs without any friction. Moreover, a change of the spacing of the two bodies can be utilized for opening the closing means by providing, for example, as described above, that a piercer be disposed on the second body that is configured such as to open at least one closing means of the cavities. For example, during the transition from the first phase to the second phase, it can thus be possible to insert the piercer, for example, into a closing means of the second cavity 150*b* of the first body 110 and remain there during the second phase.

A further embodiment envisions that the device 100 can include a phase indicator, and wherein the phase indicator is configured such as to indicate the phase that the device is in at the time the reading is taken. In other words, following the process implementation and after removing of device 100 from the centrifuge, a user is able to ascertain as to whether all needed processing steps have been carried out. For example, the device 100 can include a counter or a scale to this end.

Figure 2:
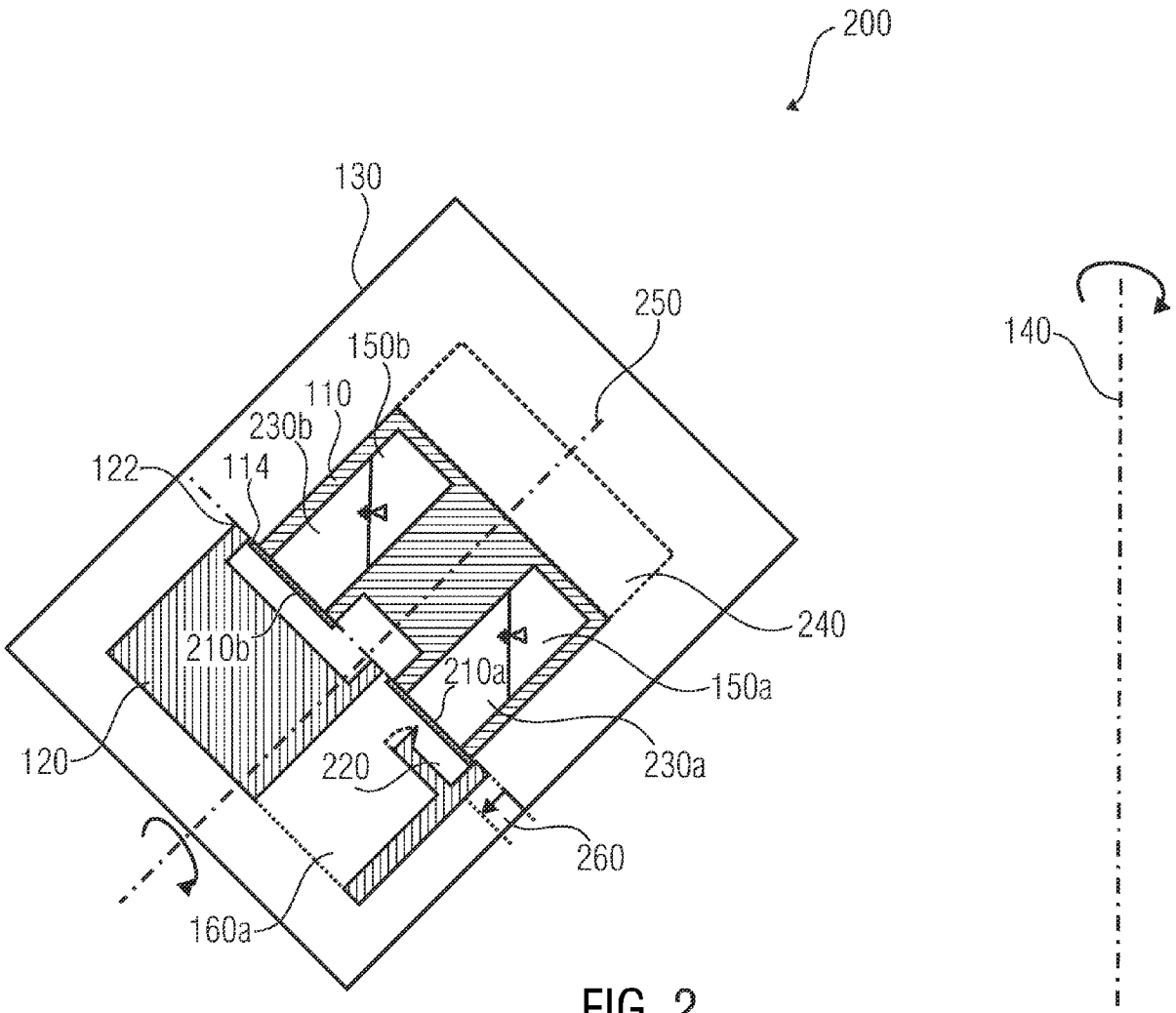
FIG. 2 is a schematic depiction of a device according to one embodiment of the present invention.

FIG. 2 depicts a device 200 according to an embodiment of the present invention. The device 200 differs from the device as shown in FIGS. 1A and 1B such that the first cavity 150*a* of the first body 110 has a first closing means 210*a* on a side that is directed toward the second body 120; and the second cavity 150*b* of the first body 110 has a second closing means 210*b* on the side that is directed toward the second body 120. A closing means therein can also assume a function of a lid. In addition, the second body 120 includes a piercer 220 on the side that is directed toward the first body 110 such as, for example, a piercer for perforating the lid. The piercer 220 can be configured therein such that is perforates the first closing means 210*a* of the first cavity 150*a* of the first body 110 in the first phase and in that it perforates the second closing means 210*b* of the second cavity 150*b* of the first body 110 in the second phase. The first cavity 160*a* of the second body 120 can be open on a side that is directed away from the body 110, as shown in the embodiment depicted in FIG. 2, for example, as a discharge channel 160*a*; or it can be closed, for example, as a collecting container. A liquid and/or a fluid 230*a* can be present in the first cavity 150*a* of the first body 110; a second liquid and/or fluid 230*b* can be present in the second cavity 150*b* of the first body 110. The two cavities 150*a*, 150*b* can, therefore, also assume the function of a reservoir. Correspondingly, it is possible to view the first body 110 also as a depot of a unit, meaning as a depot of the device 100, and the second body 120 as a body downstream in relation thereto.

According to some embodiments, the two bodies 110, 120 can be cylinder-shaped bodies with a cover side and a base side that is opposite thereto in the stacking direction, respectively. A base side 114 of the first body 110 therein can be disposed opposite a cover side 122 of the second body 120. As shown in FIG. 2, the first cavity 150*a* of the first body 110 and the second cavity 150*b* of the first body 110 can border on the base side 114 of the first body 110. The first cavity 160*a* of the second body 120 can border on the cover side 122 of the second body 120. The device 200 therein can be configured such that, during the transition from the first phase to the second phase, the second body 120 twists in relation to the first body 110 around an axis of rotation 250 of the two bodies 110, 120 that extends in the stacking direction. In other words, in response to a rotation of the rotor, the second body 120 it is able to rotate around the axis of rotation 140 and/or the rotary axis of the centrifuge in relation to the first body 110. The axis of rotation 250 of the two bodies 110, 120 can constitute, moreover, a rotary axis of the unit and/or the device 200.

According to some embodiments, a spacing of the two bodies 110, 120 can change during the transition from the first phase into the second phase. For example, the device 200 can have a pressure mechanism 240 that is configured such that, during the transition from the first phase to the second phase, the first body 110 is placed at a distance in relation to the second body 120 by a lift 260 of the unit and/or the device 100 from the second body 120. In particular, during the first phase and during the second phase, the spacing of the two bodies 110, 120 can be minimal, for example, such that the piercer 220 perforates the closing means 210*a*, 210*b* in the respective phase.

As depicted in FIG. 2, according to further embodiments, the second body 120 can be configured such that is has recesses on its cover side 122 thereof in order to receive the first body 114 at least partially.

In other words, embodiments allow for a rotary displacement of a unit and/or a device 200 by means of the pressure mechanism 240. Different liquids (fluids 150*a*, 150*b*) are pre-stored inside the unit and/or device 200. By rotation (around the rotary axis 250 of the device 200), the liquids are routed in sequence one after the other over the piercer 220, and the first body 110 is lowered in relation to the piercer 220. In other words, the spacing between the first body 110 and the second body 120 is reduced. The closing means of the respective cavity and/or membrane of the respective reservoir is perforated therein, and the liquid that is present inside the reservoir is released.

Correspondingly, embodiments allow for combining all the needed processing reagents and auxiliary processing agents into one container unit (for example, in relation to the device 100 or 200) that the user can load onto the rotor of a laboratory centrifuge. Such container units are depicted as devices 100 and 200 in FIGS. 1A, 1B, and FIG. 2. The container unit remains inside the rotor until the very end of the automated process, and it is removed only then. As mentioned above, the container unit includes at least two stacked bodies whose stacking direction has a radial directional component during the centrifuging action. The bodies include one or multiple chambers (or cavities) that can be loaded with auxiliary processing agents and reagents or fluidic inserts. The direction of the chambers and/or the cavities also has a radial directional component during the centrifuging action. The channels and/or cavities can be open, unilaterally or bilaterally closed by a lid. A lid and/or closing means of these cavities therein can be configured such that the lid and/or closing means can be opened automatically in the course of the centrifugation protocol such as, for example, by means of a piercer or by pressure application. Utilizing the centrifugal force, any liquid or solid materials contained in the channels and/or cavities can be transported from a cavity radially located more to the inside to a cavity radially located more to the outside.

According to embodiments, to automate process flows, it is possible to bring different combinations of cavities sequentially in direct or indirect in fluidic contact with each other. The bodies therein can be displaced in relation to each other, for example, by a tangential directional component. According to some embodiments, this way it is possible that, in a first centrifuging step, a material (for example, a liquid) is conveyed from a first source channel (for example, of the first body 110) of a body (for example, body 110) radially located further to the inside (for example, the first cavity 150*a* of the first body 110) to a body and/or a cavity (for example, the first cavity 160*a* of the second body 120) of the body radially located further to the outside. After a relative displacement of the two bodies, in a second centrifugation step, material can be transported from a second source channel of the body located radially further to the inside (for example, the second cavity 150*b* of the first body 110) into the same destination channel located radially further outside (for example, the first cavity 160*a* of the second body 120). In this manner, embodiments thus allow that different materials or auxiliary processing means that are involved in the process sequentially are brought into contact with each other.

The centrifuging protocol is able to cause and/or initiate any displacement of the two bodies in relation to each other directly. Any needed energy in order to effect the displacement of the bodies can be taken from the centrifuging energy, and the time and/or the extent of the displacement can be determined, for example, by a centrifuging frequency that changes over time (and/or an angular velocity of the rotor of the centrifuge that is abe to change over time). The mutual displacement by the bodies in relation to each other can be executed in a linear or in rotary fashion. As described previously, it is possible to use closing means and/or lids or valves for closing off the cavities. The lid and/or the closing means therein can be opened, for example, by a piercer or by pressure such as can be generated, for example, in the centrifuging field by a liquid column that located there above.

Figure 3A:
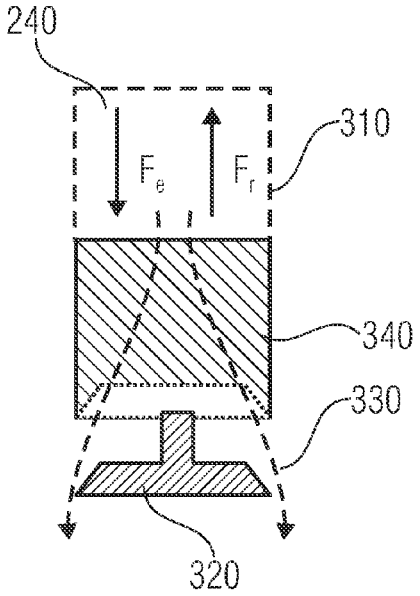
FIGS. 3AA-3BB are schematic representations of different closing means of the kind that can be encountered in devices according to embodiments of the present invention for closing the cavities.
Figure 3A:
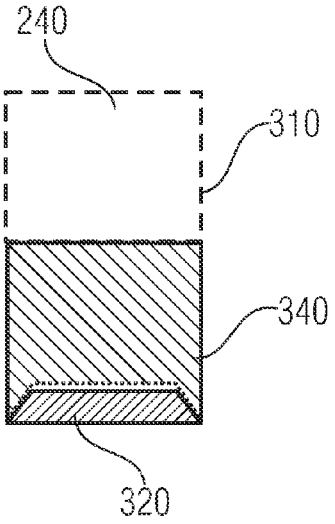

FIGS. 3AA-3BB depict two different possibilities for embodying closing means for the cavities of the bodies of the devices 100 and 200. FIG. 3AA represents a cavity 310 that can be opened and closed with a closing means configured as a valve (320). A pressure mechanism 240, as described previously in FIG. 2, can be used therein to operate the valve 320 and/or to open or close the same in response to a rotation of the rotor or a change of the angular velocity of the rotor. In FIG. 3AA, for example, a force that is generated by the pressure mechanism 240 can be smaller than a centrifugal force that is generated by the centrifugation of the rotor such that valve 320 is opened and that any liquid that is present in the cavity 310 or any liquid that flows through the cavity 310 is able to leave the same via liquid flow 330. The valve 320, as shown in FIG. 3AA, is not disposed in a valve seat 340 inside the cavity. FIG. 3AB depicts the cavity 310 with the valve 320, which has been received by the valve seat 340 of the cavity 310. The valve 320 thus locks the cavity 310, preventing any liquid that is present in the cavity 310 or any liquid that flows into the cavity 310 from exiting the same. A centrifugal force that is generated by the centrifugation of the rotor is thus, for example, smaller than a restoring force that is generated by the pressure mechanism 240. In other words, FIGS. 3AA and 3AB demonstrate the option of using a valve 320 for closing and opening the cavity 310.

According to some embodiments, valve 320 can also be controlled by a centrifugally powered mechanism (for example, pressure mechanism 240) in that a lifting motion is generated; for example, the valve 320 to be locked in place, and a body having the cavity 310 can be moved in relation to the valve 320. Moreover, it is also possible to use perforated plates as a grinding valve (comparable to a spice shaker) that can be operated by a rotary or translational motion, and wherein, according to some embodiments, in this instance as well, it is possible to control the movement by changing the centrifugal frequency (or the angular velocity) of the rotor.

Figure 3B:
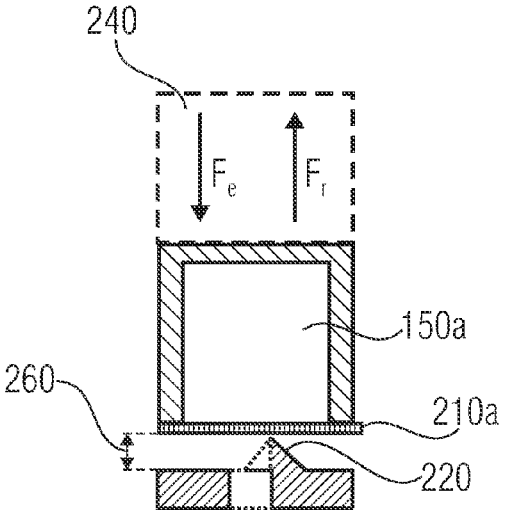
Figure 3B:
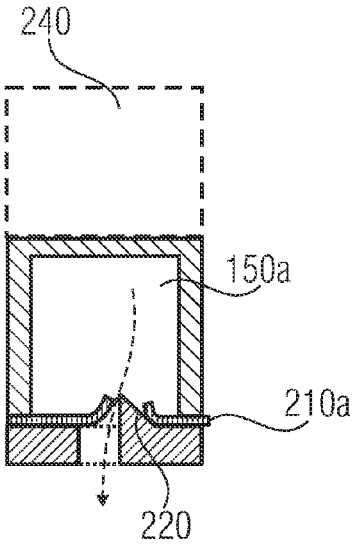

FIGS. 3BA and 3BB depict a further option for a closing means of a cavity. The cavity as shown in FIGS. 3BA and 3BB can be, for example, the first cavity 150*a* of the first body 110 according to FIGS. 1 and 2. The closing means 210*a* of the first cavity 150*a* therein can be configured as a membrane. The cavity 150*a* therein can be, for example, a reservoir or a supply line. In FIG. 3BA a restoring force, which is generated by the pressure mechanism, can be greater than a centrifugal force generated by the centrifugation of the rotor, whereby the closing means 210*a* and/or the membrane is disposed above the piercer 220, for example, with a lift 260. The piercer 220 therein can, for example, be disposed on the first cavity 160*a* of the second body 120. In FIG. 3BB a centrifugal force, which is generated by the centrifugation of the rotor, can be greater than a restoring force that is generated by the pressure mechanism 240. For example, an angular velocity of the rotor in FIG. 3BA can be smaller than an angular velocity of the rotor in FIG. 3BB. The cavity 150*a* with the closing means 210*a* and/or the membrane 210*a* descends therewith onto the piercer 220, or the piercer 220 moves into the closing means 210*a* and/or the membrane 210*a* in order to perforate and/or to open the membrane 210*a*. A liquid that is present inside the cavity 150*a* is thus able to flow out of the cavity 150*a*, for example, into a radially more remote channel opening (for example, into the first cavity 160*a* of the second body 120 according to FIGS. 1 and 2). In other words, FIGS. 3BA and 3BB demonstrate how a pressure mechanism 240 is used in order to perforate a membrane 210*a*, thereby allowing for opening a channel or a reservoir or a cavity 250*a*, and the liquid that is present therein to flow to radially remote channel openings and/or a radially remote cavity.

Different auxiliary process means can be contained in the cavities as shown in FIGS. 1 to 3 (for example, cavities 150*a*, 150*b*, 160*a*). These auxiliary process means can be, on the one hand, pre-stored liquid and solid materials but, on the other hand, also fluidic insertion elements. Auxiliary process means can be, for example: liquid reagents (for example, buffers for DNA extraction), dry reagents (for example, freeze-dried polymerase, antibody coating, microspheres, salts), chromatography columns or membranes, (for example, for DNA extraction or filtration of proteins), micro-fluidic structures such as, for example, siphons, aliquoting structures or mixers, nozzle membranes and/or filter (for example, so call tracked-etch membranes), functional, constructive elements for mixing, separating or defining a fluidic path (as will be described below in FIGS. 4A-4I), valves (as described previously in FIGS. 3AA-3BB), magnetic particles, magnets, chemical substances producing heat, for example, in exothermal reactions of the sample in order to achieve a certain incubation temperature, substances producing gas bubbles in a reaction with the sample while blending the sample with centrifugation or reducing agents and others, or also substances capable of swelling or liquids with solubility for evaporating solutions.

FIGS. 4A-4E demonstrate various insertion elements for the cavities that are possible.

Figure 4A:
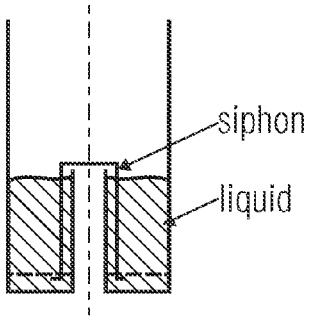
FIGS. 4A-4I are schematic representations of different inserts of the kind that can be encountered in cavities of bodies of devices according to the embodiments of the present invention.

FIG. 4A shows an example for a cavity with siphon. The siphon can controlled either by volume or by capillarity and can be used, correspondingly, for switching liquids as a function of the rotation frequency or as a function of the filling level.

Figure 4B:
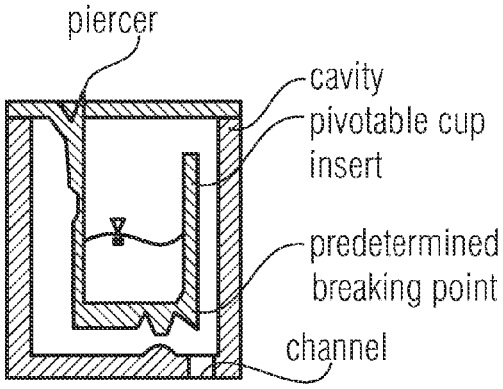

FIG. 4B depicts an example for a cavity with a cup insertion element. The cup and/or pivotable cup insert can be brought to oscillate by varying the centrifugation frequency. This allows for mixing liquids inside the cup. In addition, the cup insertion element includes a piercer on its top side that serves for perforating the reservoir located there-above. The cup insertion element can thus be inserted, for example in the first cavity 160*a* of the second body 120 of the device 200 according to FIG. 2, for example, in order to open the closing means 210*a*, 210*b* of the first body 110 by means of the perforation piercer. In addition, the cup floor contains a predetermined breaking point, whereby, with increased centrifugation frequency, by a bursting of the predetermined breaking point the liquid can be released into the cavity, and it exits the cavity via a discharge channel (or a dripping spout).

Figure 4C:
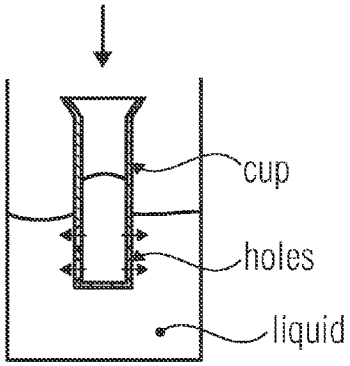

FIG. 4C depicts an example for a cavity with a static mixing element. For example, a liquid in a cup of the static mixing element can flow, due to a centrifugal force, from an opposite cavity into the cup and is blended with a liquid that was pre-stored previously inside the mixing element by means of holes in the cup of the mixing element.

Figure 4D:
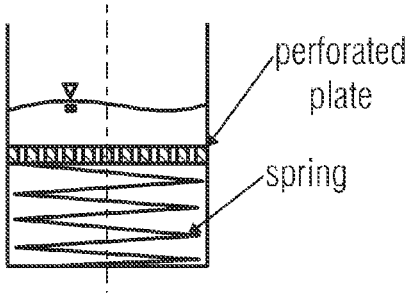

FIG. 4D shows an example of a cavity with a dynamic mixing element. As a function of the speed of a rotor of a centrifuge, a perforated plate moves upwards and downwards to thus blend liquids that are present inside the dynamic mixing element. A spring force of the spring can be adjusted such that a centrifugal force generated by a rotation of the rotor is smaller than the spring force at a first angular velocity of the rotor and greater than the spring force at a second angular velocity of the rotor. The spring therein can, for example, be constituted of an elastomer or an elastic polymer material and can be manufactured, in particular, by injection molding.

Figure 4E:
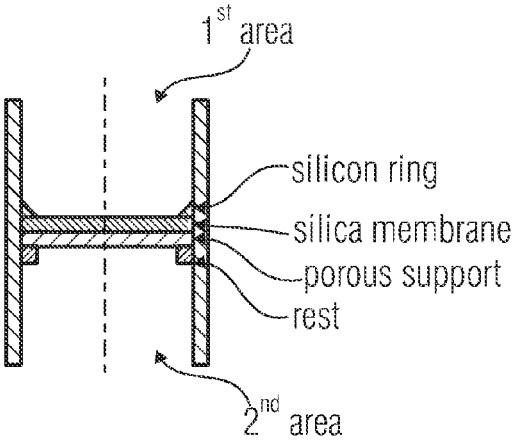

FIG. 4E is a representation of an example for a cavity with inserted silica solid phase for DNA extraction or protein filtration. On the inside, the cavity has a stack made of a silicone ring of a silica membrane and a porous support. This layered stack is fixed in place on a support inside the cavity. A liquid that is present inside the cavity can, for example, as a function of a centrifugation frequency of the rotor, be centrifuged from a first region of the cavity through the silica membrane and the porous support into a second region of the cavity.

Figure 4F:
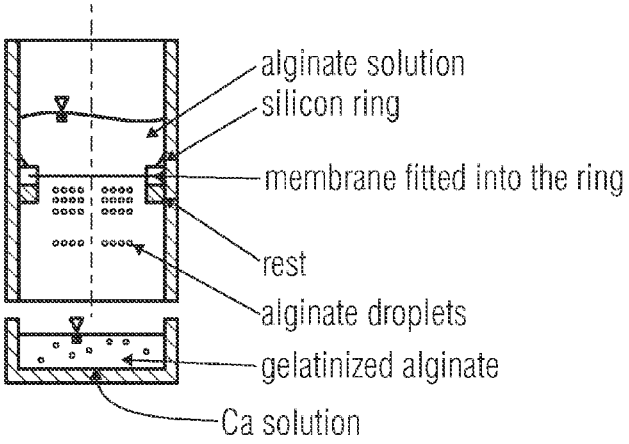

FIG. 4F demonstrates an example of a cavity with a track-etch membrane. It can serve, for example, for a particle or emulsion preparation using a track-etch membrane. An alginate solution is divided into small droplet by the track-etch membrane, which is pressed into a ring, by means of the effect of the centrifugal force. The droplets can be captured in a calcium solution and gelatinize into solid particles. Following a centrifugation process, the cavity thus houses a gelatinized alginate. Moreover, it is also possible for another body having a further cavity to follow the former cavity that contains a calcium solution, whereby the gelatinized alginate accumulates in the further body, for example, such that the further body is removable from the device.

Figure 4G:
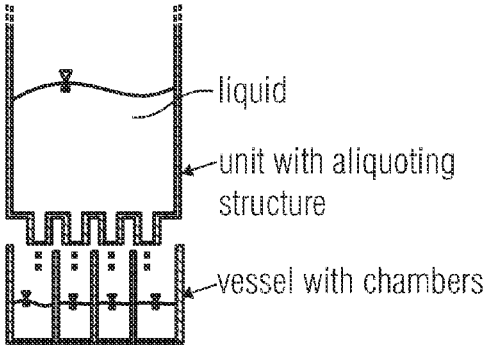

FIG. 4G shows an example for a cavity having a dynamic aliquoting structure. The cavity therein can have an aliquoting structure, and a body of the cavity can be followed by a second body such as, for example, a vessel with chambers that are individually removable from the device. Any liquid that is present inside the cavity with the aliquoting structure distributes itself evenly across the chambers of the vessel with the chambers, for example, responding to a rotation of the rotor.

Figure 4H:
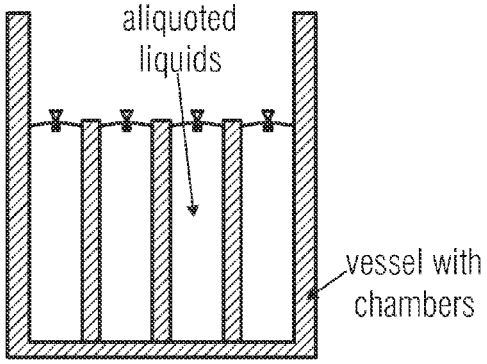

FIG. 4H depicts an example for a cavity with a static aliquoting structure. The cavity with the static aliquoting structure is, therefore, configured as a vessel with chambers, and wherein the aliquoted liquids are present in the individual chambers.

Figure 4I:
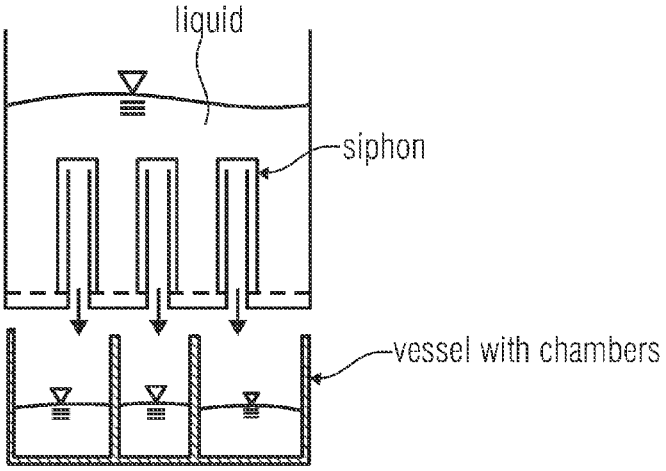

FIG. 4I shows an example for a combination consisting of a siphon and an aliquoting structure, whereby, for example, a siphon can be disposed inside a cavity of a radially inner body and a radially outer body can be configured as a vessel with chambers (multiple cavities). A liquid that is present inside the cavity of the radially inner body is distributed evenly based on a centrifugal force that is generated by the rotation of the rotor among the individual chambers of the radially outer body.

At the beginning of a process, such as, for example, a (bio)chemical process, it can be needed that non-system-specific materials are added to the process. For example, a sample such as blood can be added. The sample can typically be added to one body (one cavity of a body) that is radially located furthest to the inside during the processing. For example, the sample can be added to the first 150*a* and/or the second 150*b* of the first body 110 according to FIGS. 1A, 1B, and 2. The product of the process (for example, DNA extracted from blood), on the other hand, can typically be removed from the body that is radially located furthest to the outside (and/or from a cavity of the body located furthest to the outside). For example, the product of the process can be removed from the first cavity 160*a* of the second body 120 in accordance with FIGS. 1A, 1B, and 2. Therefore, according to one embodiment, the body that contains the product of the process is easily removable from the container unit (and/or the device 100 or 200 according to FIGS. 1A, 1B, and 2) to gain access to the product of the process (that is also referred to as an eluate).

According to some embodiments, it is possible that at least one of the cavities of the device is accessible from outside of the device for the purpose of adding a sample to one of the cavities of the device. Correspondingly, the device can have a lid, for example, that releases, upon a rotation of the device, a cavity that is located radially furthest to the inside, when it is opened.

According to some embodiments, a housing of a device according to the present invention can have at least two housing parts that can be separated from each other, whereby, upon a separation of the at least two housing parts, at least one of the at least two bodies is removable from the device.

Subsequently to be described are such examples that allow, for example, provided a device is configured according to an embodiment of the present invention as a centrifugal tube, for easy product removal. To this end, a device and/or a container unit includes an easily removable collection apparatus that is also suitable, for example, for storing the product and that can be compatible in terms of the format thereof with standard reaction vessels. In relation to the device, a collection vessel therein can be installed in a centralized or decentralized fashion.

FIGS. 5A-5G demonstrate different variants for embodying such collection apparatuses for devices of the embodiments according to the present invention. In other words, FIGS. 5A-5G show examples for advantageous, easy-to-remove collection apparatuses for the product of a process (eluate) and/or effluents (so-called waste). These collecting apparatuses can be disposed therein, for example, in a device according to an embodiment of the present invention as a further body inside the housing 130 of device 100 according to FIGS. 1A, 1B. For example, the collection apparatuses can be disposed such inside the housing 130 or on the housing 130 that, upon a rotation by the rotor, the same are radially disposed, in comparison to the other bodies of the device 100, furthest to the outside.

Figure 5A:
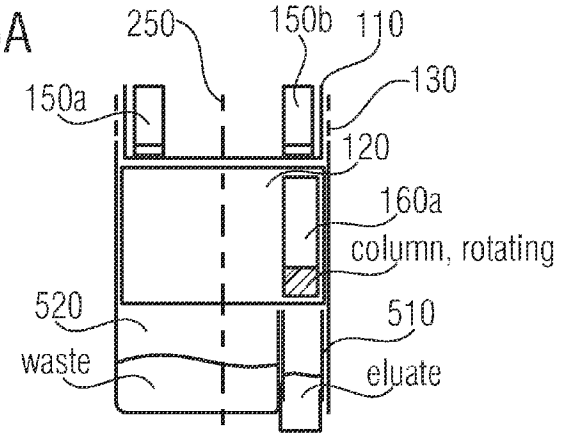
FIGS. 5A-5G are schematic representations of different eluate collecting containers of the kind that can be encountered on devices according to embodiments of the present invention.

FIG. 5A shows a part of a device according to an embodiment of the present invention having a housing 130 and a first body 110 with a first cavity 150*a* and a second cavity 150*b*. Further, the device includes a second body 120 having a first cavity 160*a*. In addition, the device includes a third body 510 in form of a decentral eluate tube 510 that is disposed such in the housing 130 that, when the second cavity 150*b* of the first body 110 is fluidically coupled to the first cavity 160*a* of the second body 120, the eluate tube 510 is also fluidically coupled to the cavity 160*a* of the second body 120. The device is thus configured such that, in the second phase, the first cavity 160*a* of the second body 120 is coupled to the second cavity 150*b* of the first body 110 as well as with the eluate tube 510. In the first phase, when the first cavity 160*a* of the second body 120 is fluidically coupled to the first cavity 150*a* of the first body 110, the first cavity 160*a* of the second body 120 is also fluidically coupled to the waste liquid container 520 of the housing 130. The first cavity 160*a* of the second body 120 has a column by means of which liquids are processed that are present in the first cavity 150*a* and in the second cavity 150*b* of the first body 110. The device is configured such therein that a liquid that is present in the first cavity 150*a* of the first body 110 is processed by means of the column and any waste liquid that results therefrom is collected in the waste container 520 of the housing 130. In the second phase, it is then possible to process a liquid that is present in the second cavity 150*b* of the first body 110 by means of the column, wherein any resulting eluate is collected in the eluate tube 510. The column can thus also be referred to as a rotating column.

Figure 5B:
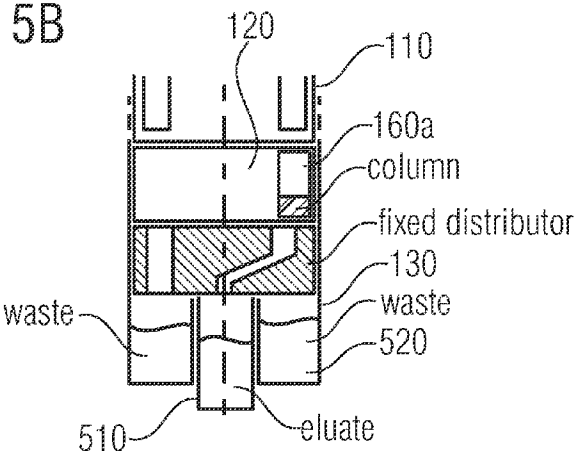

FIG. 5B depicts a further device according to an embodiment of the present invention. The device differs from the device as shown in FIG. 5A in that the eluate tube 510 is disposed centrally inside the housing 130 such that, for example, an axis of rotation 250 of the device also constitutes an axis of rotation of the eluate tube 510. Further, the device includes a stationary spreader between the second body 120 and the eluate tube 510 and the waste liquid container 520 of the housing 130 that is configured such that as to direct liquid that is processed by means of the column in the first phase to the waste liquid container 520 and in the second phase to the eluate tube 510. The stationary spreader therein is disposed inside the housing 130, and the second body 120 is rotably disposed inside housing 130, as described previously in FIG. 5A.

Figure 5C:
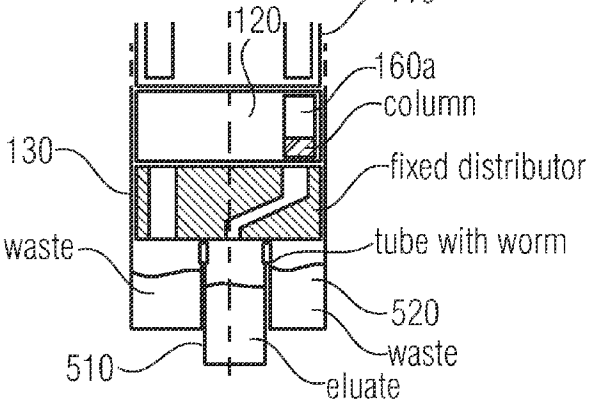

FIG. 5C depicts a further device according to an embodiment of the present invention. The device differs from the device as shown in FIG. 5B in that the eluate tube 510 is threaded such as, for example, having a screw cap (for example, a Saarstedt tube with screw cap, 2 mm).

Figure 5D:
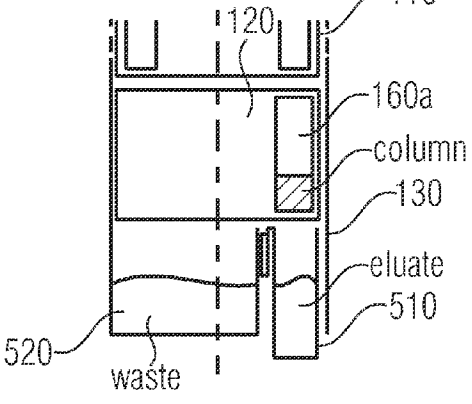

FIG. 5D is a representation of a further device according to an embodiment of the present invention. The device differs from the device in FIG. 5A in that the decentralized eluate tube 510 has an integrated lid. The lid therein can be configured such that it automatically, for example, upon the eluate tube 510 being pulled out of the housing 130.

Figure 5E:
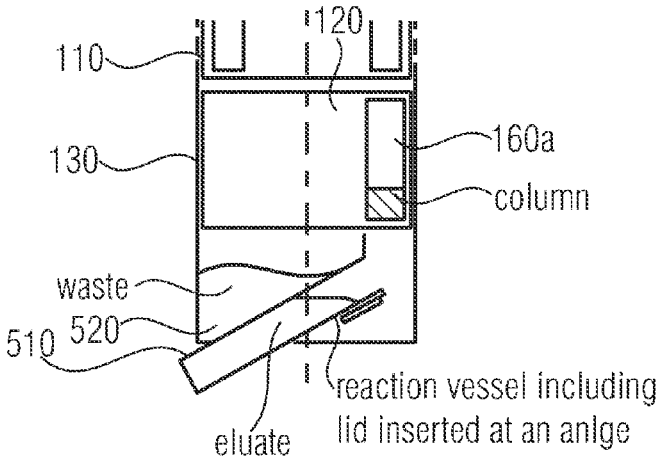

FIG. 5E shows a further device according to an embodiment of the present invention. The device as shown in FIG. 5E differs from the device depicted in FIG. 5D in that the decentral eluate tube 510 with lid is placed and/or inserted into the housing 130 slanting at an angle. According to a further embodiment, an eluate tube eluate tube 510 (also referred to as a reaction vessel) can have a screw cap instead of a lid.

Figure 5F:
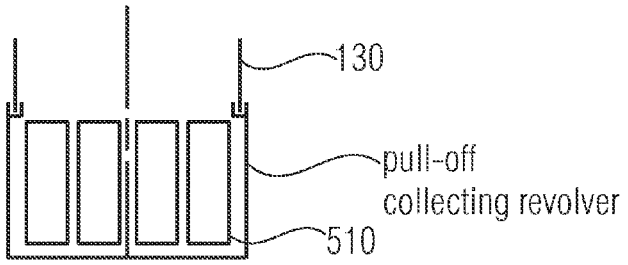

FIG. 5F demonstrates a further device according to an embodiment of the present invention. The device as shown in FIG. 5F differs from the device depicted in FIG. 5A to FIG. 5E in that the eluate is collected inside a further body 510 (for example, in addition to the first body 110 and the second body 120) and in that the further body 510 is disposed on the housing 130 and can be pulled off the same.

The further body 510 can, therefore, also be referred to as a pull-off collecting revolver that is part of the housing 130. The pull-off collecting revolver can be fastened to the housing 130, for example, by means of a screw closure, or it can be clamped to the housing 130.

Figure 5G:
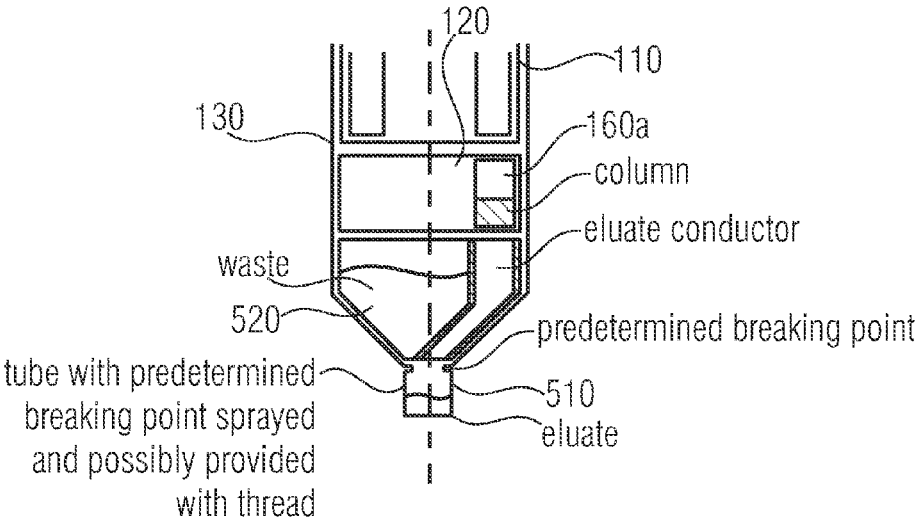

FIG. 5G shows a further device according to an embodiment of the present invention. The device as seen in FIG. 5G differs from the devices as shown in FIG. 5A to FIG. 5F in that the eluate tube 510 is molded to the housing 130 in one piece and in that it can be separated from the housing 130 by means of a predetermined breaking point. Possibly, the eluate tube may be threaded therein. The eluate therein is thus collected in the molded-on eluate tube having a predetermined breaking point.

If waste fluids are to be collected in addition to the sample in the adjacent cavity, which are, for example, still in part wetting any possible capillary reflux can be prevented by inserting a suction sponge into the cavities.

Figure 6:
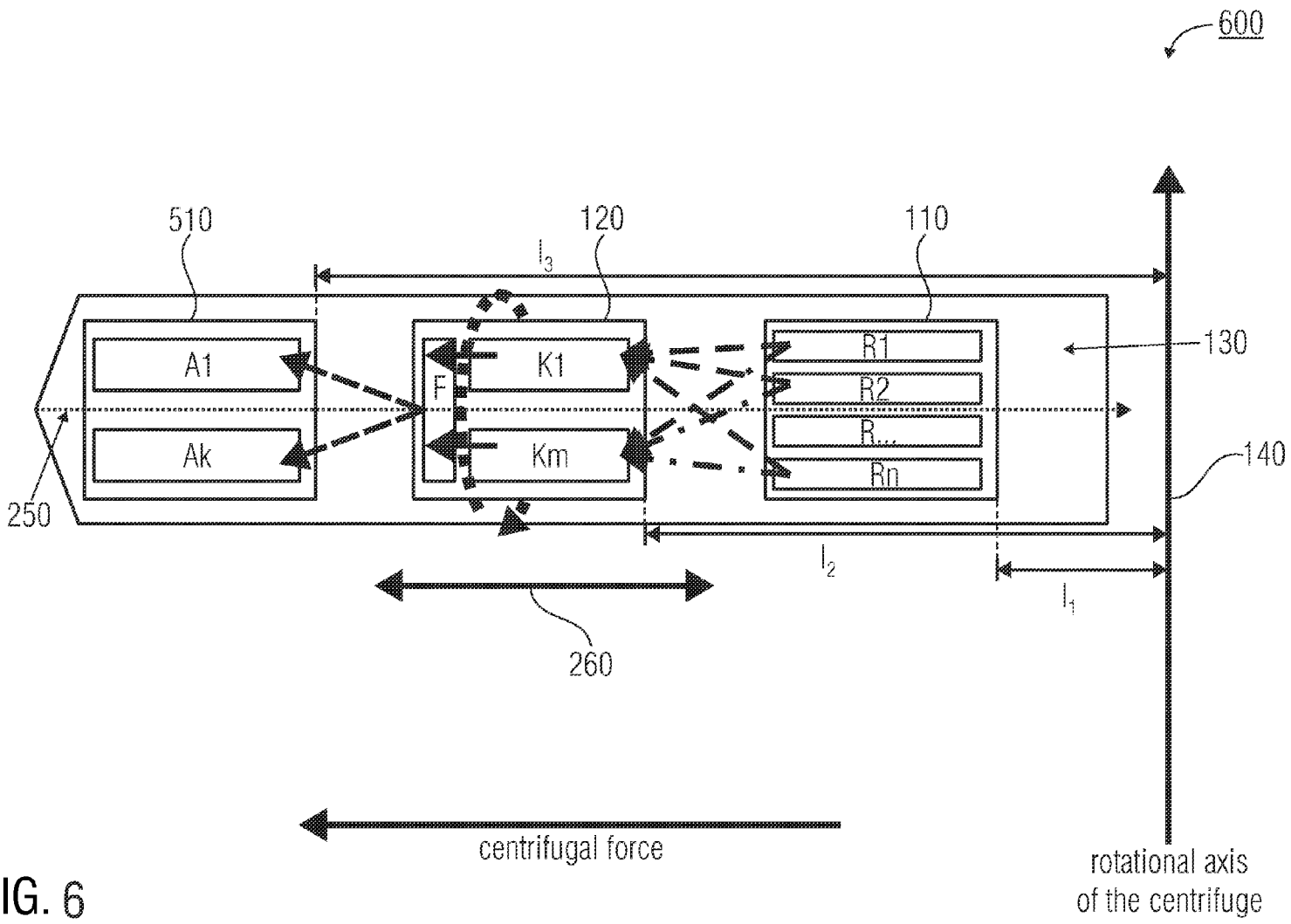
FIG. 6 is a schematic representation of a device according to an embodiment of the present invention.

FIG. 6 depicts a device 600 according to an embodiment of the present invention. The device 600 differs from device 100 as shown in FIGS. 1A and 1B such that it includes a third body 510 within the housing 130. The third body 510 is disposed such in the stacking direction inside the housing 130 that, upon a rotation of the device 600 around the axis of rotation 140 of the centrifuge, a spacing $l_3$ of the third body 510 in relation to the axis of rotation 140 is greater than the spacing $l_2$ of the second body 120 in relation to the axis of rotation 140 of the centrifuge. As previously in device 100, the spacing $l_2$ of the second body 120 in relation to the axis of rotation 140 of the centrifuge is greater than the spacing $l_1$ of the first body 110 of the axis of rotation 140 of the centrifuge. In other words, upon a rotation of the device 600 around the axis of rotation 140 of the centrifuge, the third body is radially disposed furthest to the outside, and the first body 110 is radially disposed furthest to the inside, while the second body 120 is disposed between the first body 110 and the third body 510. Further, the first body 110 includes a plurality of cavities R1 to Rn, wherein n is an index with regard to the number of cavities of the first body 110, with n being any integer. Furthermore, the cavities R1 to Rn can be referred to as reagent pre-storing chambers. The first body 110 can thus be utilized for pre-storing reagents; in addition, a sample (for example, blood) can be added to one of the reagent pre-storing chambers R1 to Rn. For example, all reagents that are needed for implementing a specific (bio)chemical process can be pre-stored in the reagent chambers R1 to Rn. For example, for the purpose of a DNA extraction, it is possible to pre-store reagents such as a lyase, a proteinase as well as any further reagents needed for a DNA extraction.

Furthermore, the second body 120 includes any plurality of cavities K1 to Km, wherein m is an index for a number of cavities of the second body 120, wherein m can take the value of any integer. The cavities K1 to Km can also be referred to as processing cavities K1 to Km. In particular, processing of the reagents R1 to Rn that are pre-stored in the reagent pre-storage chambers can be processed in said processing cavities K1 to Km. In other words, the second body 120 can include processing cavities K1 to Km for processing purposes (such as, for example, mixing, lysis, sedimentation, binding as well as elution).

According to further embodiments, the second body 120 can include separation devices F that are disposed, for example, radially behind the processing cavities K1 to Km in the second body 120.

The third body 510 includes a plurality of cavities A1 to Ak, wherein k is an index for a number of cavities A1 to Ak of the third body 510, wherein k can take the value of any integer. The cavities A1 to Ak can also be referred to a analysis chambers A1 to Ak. The analysis chambers A1 to Ak can serve for catching the liquids that are processed in the second body 120. The liquids that are collected in the analysis chambers A1 to Ak can then be used for an analysis or for further processing. In other words, with its analysis chambers A1 to Ak, the third body 510 can serve for selecting and, if needed, further processing actions. The third body 510 therein can be removable from the housing 130, for example.

According to some embodiments of the present invention, the housing 130, which is configured for insertion into a holder of a rotor of a centrifuge, can be configured as a sleeve having the dimensions of a standard cavity of a laboratory centrifuge.

According to some embodiments, the bodies 110, 120, 510 can be cylindrical bodies with an axis of rotation 250 of the bodies extending in the stacking direction of the bodies.

In the embodiment as shown in FIG. 6, a fluidic coupling of the different cavities of the three bodies 110, 120, 510 can take place by means of twisting of the second body 120 around the axis of rotation 250 of the bodies. Correspondingly, by twisting the second body, any desired fluidic path from the reagent pre-storage chambers R1 to Rn to the analysis chambers A1 to Ak can be embodied via the processing cavities K1 to Km (and via the separation device F, should the second body 120 include any). According to further embodiments, it is also possible for the first body 110 and/or the third body 510 to be twisted and/or to twist around the axis of rotation 250 of the bodies. According to some embodiments, the second body 120 can be configured to perform a translation such as, for example, around a lift 260. The translation of the second body 120 can occur due to the interaction of the centrifugal force generated by the rotation of the rotor around the axis of rotation 140 of the centrifuge with a counter-force such as, for example, a spring force, magnetic force or weight in N. The rotation of the second body 120 around the axis of rotation 250 of the bodies therein can be triggered based on the translation of the second body 120 using a suitable mechanism (such as, for example, the mechanism of a ball point pen, which is explained, for example, in FIGS. 9A and 9B below, or a ratchet mechanism, which is explained in FIGS. 12A-12C below). The translation of the second body 120 such as, for example, along the axis of rotation 250 around a lift 260 can, furthermore, be utilized for opening, for example, closing means of the reagent pre-storage chambers R1 to Rn. The second body 120 therein can have, for example, one or multiple piercers that are able to open closing means of the reagent pre-storage chamber R1 to Rn during a displacement of the second body 120 in the direction of the first body 110, and which closing means can be a membrane, for example.

According to some embodiments, a number of reagent pre-storage chambers R1 to Rn, a number of processing cavities K1 to Kn, a number of the separation device F and a number of the analysis chambers A1 to Ak vary in the context of different devices according to embodiments of the present invention such as, for example, in order to adjust a device to a certain (bio)chemical process. For example, a different number of reagent pre-storage chambers R1 to Rn may be needed for a DNA extraction than for a synthesis of radio-pharmaceuticals.

According to some further embodiments, it is also possible for any number of bodies in different devices according to the embodiments of the present invention to vary such as, for example, adjusted to a certain (bio)chemical process. In particular, using a suitable mechanism, it is possible for bodies located within a housing 130 inside the device to twist in relation to each other based on a rotation of a rotor of a centrifuge.

Figure 7:
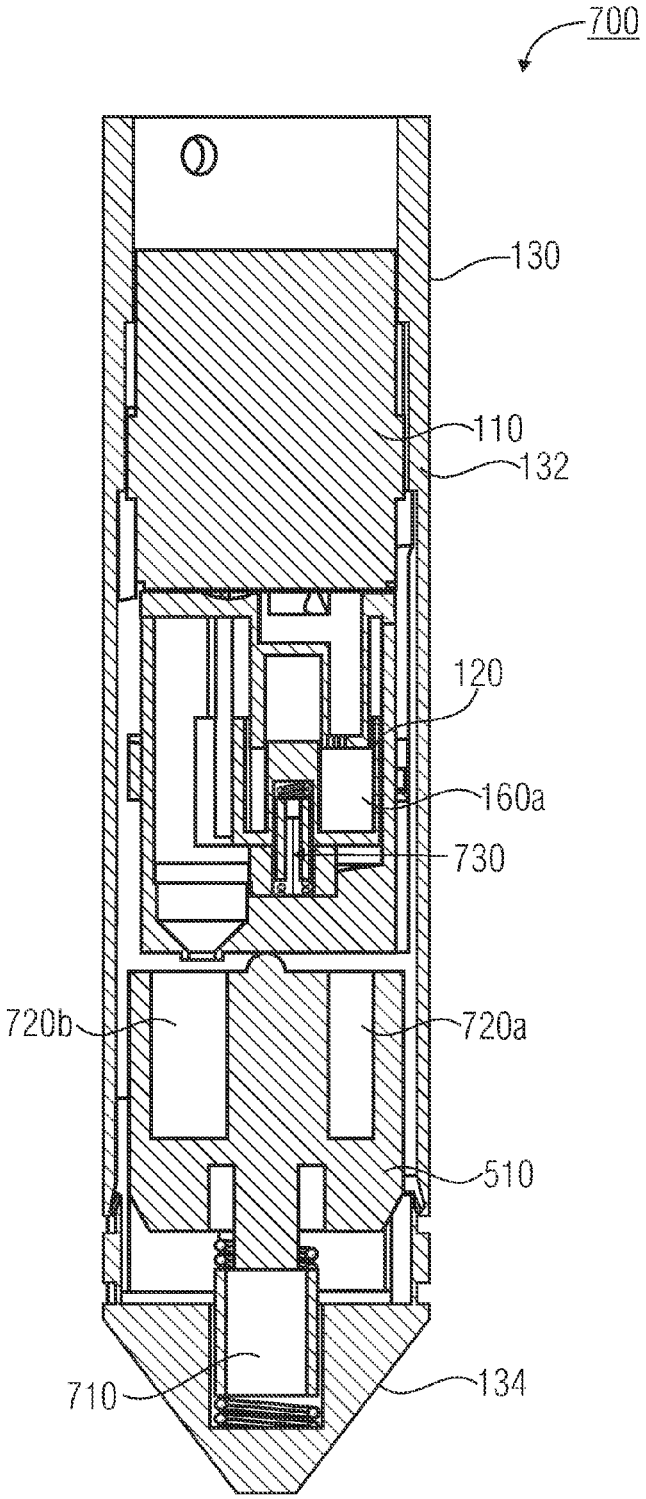
FIG. 7 is a schematic representation of a device according to an embodiment of the present invention.

FIG. 7 shows a sectional view of a device 700 for insertion into a rotor of a centrifuge according to an embodiment of the present invention. The device 700 differs from the device 100 as shown in FIGS. 1A and 1B in that it includes a third body 510 in the stacking direction that is disposed, as in device 600 according to FIG. 6, such that, upon a rotation of the device 700 around an axis of rotation 140 of the centrifuge, it is radially located furthest to the outside in relation to the other two bodies 110, 120 of the device 700. The third body 510 has a first cavity 720*a* and a second cavity 720*b*. The first cavity 720*a* of the third body 510 can be, for example, an eluate-collecting container or an eluate chamber, and the second cavity 720*b* of the third body 510 can be, for example, a so-called waste-collecting (effluents) container or a waste chamber.

Further, the second body 120 has a mixing device 730 disposed in its cavity 160*a* that is configured such that, responding to a rotation of the rotor, it blends at least two fluids that are present inside the cavity 160*a*. The mixing device 730 is described in detail in FIGS. 8CA-8CE below.

Also, the first body 110 includes eight cavities, for example, as reagent pre-storage chambers.

Additionally, the housing 130 includes two housing parts 132, 134 that can be separated from each other such that, when these two housing parts 132, 134 are separated, at least one of the bodies of the device 700 (for example, the third body 510) can be removed from the device 700. According to further embodiments, the housing 130 also include a plurality of housing parts 132, 134. For example, the individual housing parts 132, 134 can be plugged into each other, for example using springs and grooves or by means of screwed connections. A first housing part 132 of the two housing parts 132, 134 of the housing 130 can also be referred to as a first sleeve 132, while a second housing part 134 of the two housing parts of the housing 130 can also be referred to as a second sleeve 134. As shown in FIG. 7, for closing the housing 130, the second sleeve 134 is plugged onto the first sleeve 132.

The three bodies, respectively, can also be referred to as revolvers. Correspondingly, the first body 110 can be referred to as revolver 110, the second body 120 as a second revolver 120 and the third body 510 as a third revolver 510.

The first revolver 110 includes, as described previously, a reagent pre-storage.

The second revolver 120 includes, as described previously, the mixing device 730. The third revolver 510 includes, as described previously, an eluate chamber 720*a* and a waste chamber 720*b*.

In addition, the device 700 includes a spring 710 for the lateral movement of the three revolvers 110, 120, 510. The spring 710 serves to generate a restoring force that acts counter to the centrifugal force generated by the rotation of the rotor in order to allow for a switching process (such as, for example, a twisting of the second revolver 120 in relation to the other two revolvers). The spring 710 can be comparable, for example, to a restoring spring for a ball point pen; and any twisting of the second revolver 120 in relation to the other two revolvers 110 and 510 can be based on ball point pen mechanism, as explained in FIGS. 9A and 9B below.

The device 700 as depicted in FIG. 7 having three revolvers 110, 120, 510 can be used, for example, for the purpose of DNA extraction. As described previously, a ball point pen mechanism is able to translate the centrifugation protocol into any gradual twisting of the second revolvers 120 in relation to the first revolver 110 and in relation to the third revolver 510.

The spring 710 below the third revolver 510 regulates the spacing in relation to the sleeve and/or in relation to the housing 130, which comprises two housing parts 132, 134 (or consists of the same). The interaction of spring 710 with the centrifugal force causes the three revolvers 110, 120, 510 to be moved. This powers the ball point pen mechanism of the device 700, whereby the second revolver 120 is twisted in relation to the other two revolvers 110, 510.

The spring 710 can be configured as a compression spring or a tension spring. In addition, according to further embodiments, the spring 710 can also be configured as another restoring means that generates a restoring force on at least one body of the device 700. In particular, possible for use as restoring means are, for example, elastomers (rubber band), metal springs, thermoplastic materials or thermosetting plastics. Further embodiments envision the restoring means as being manufactured as a component of the a body (for example, as a components of the third body 510). Manufacturing methods of this type are known from the packaging industry and are used, for example, in injection-molding processes for the production of tablet tube lids. This allows for a reduction in the number of parts used in the embodiments according to the present invention as well as a simplification of the assembly.

FIGS. 8AA-8AD show on the left side, in a side view, the first housing part 132 of housing 130 and a sectional view along the sectional axis A-A. Further, FIG. 8AC shows in a side view, the second housing part 134 of housing 130 and FIG. 8AD shows a sectional view along a sectional axis 8AD-8AD. The second housing part 134 constitutes a lower end of the device 700, meaning, upon a rotation of the device 700, the housing part 134 is radially furthest to the outside and, in particular, radially disposed further to the outside than the first housing part 132. The first housing part 132 has a cylindrical shape and a circular cross-section. At a base side 804 of the first housing part 132, the first housing part 132 has two hooks 810 arranged opposite of each other. The two opposite hooks 810 are configured such that they are received by two hook recesses 812 of the second housing 134. The two hooks 810 protrude from the base side 804 of the first housing part 132.

According to further embodiments, the housing part 132 can have an observation window 814 (for example, made of a transparent plastic material) that constitutes, for example, in combination with an indicator on the second body 120, a phase display for indicating given a phase that the device 700 is in at the time when the reading is taken.

According to further embodiments, the first housing part 132 can have a plurality of guide grooves 816 on an inner side that extend at least in a partial area of the inside region of the first housing part 132 in an orthogonal direction in relation to the cover side 802 of the first housing part 132. The guide grooves 816 can have beveled ends on the side, respectively, that is directed toward the base side 804. The interior of the first housing part 132 can be accessible, for example, from the base side 804 of the first housing part 132, for example, in order to push the three revolvers 110, 120, 510 into the first housing part 132. Moreover, the first housing part 132 can be open or closed on its cover side 802 and can have, for example, a lid on the cover side 802.

The second housing part 134 has the same circular cross-section at its cover side 806 as the first housing part 132 on its base side 804. The hook recesses 812 of the first housing part 132 are offset to the rear in relation to the cover side 806 of the second housing part 134. The circular cross-section of the second housing part 134 can be tapered in a region toward a base side 808 of the second housing part 134 in which the hook recesses 812 no longer extend, meaning the housing part 134 can be configured as frustoconical at an end that is opposite of the cover side 806. Within the frustoconical end, the housing part 134 can include a recess 818 for the spring 710. An inside region of the second housing part 134 can be accessible from the cover side 806 of the second housing part 134 such as, for example, in order to receive the third body 510 and/or to remove the same from the housing 130.

A length from the cover side 802 to the base side 804 of the first housing part 132 can be greater than a length from the cover side 806 to the base side 808 of the second housing part 134.

The housing 130, and thereby the two housing parts 132, 134, can correspond in terms of their outer dimensions to a standard laboratory centrifuge such as, for example, having a volume of 500 ml, 250 ml, 50 ml, 18 ml-12 ml, 15 ml, 2 ml, 1.5 ml or 0.5 ml.

Figure 8B:
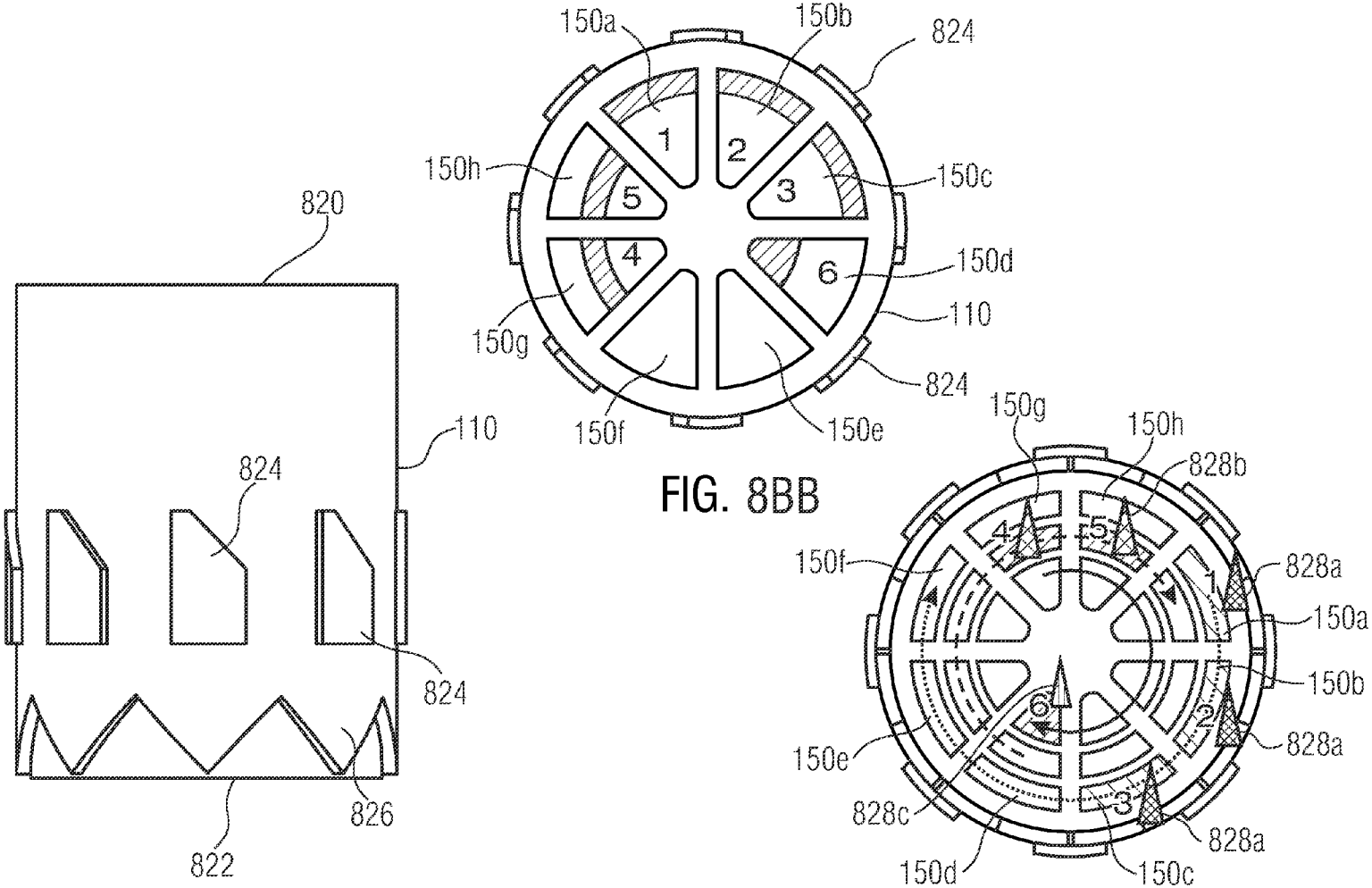
FIGS. 8AA-8DB are schematic representations of individual components of the device from FIG. 7.

FIGS. 8BA-8BC are schematic representations of the first body 110 of the device 700 according to FIG. 7. FIG. 8BA shows the first body 110 and/or the first revolver 110 seen in a side view. As mentioned previously, the first body 110 is a cylindrical body 110 with a cover side 820 and a base side 822 arranged opposite thereto. The first body 110 has at its outer side a plurality of guide springs 824. The number of the guide springs 824 can, for example, be adjusted to the number of guide grooves 816 of the first housing part 132 (meaning of housing 130). The guide springs 824 of the first body 110 are configured such that they engage in the guide grooves 816 of housing part 132. The guide springs 824 can (in connection with the guide grooves 816 of the first housing part 132) be configured such that they prevent the first body 110 from twisting in relation to another body 120, 510 (for example, during a transition from a first phase to a second phase). The guide springs 824 of the first body 110 can be beveled at their ends that are directed toward the cover side 820 to facilitate, for example, the insertion of the first body 110 in the housing 130 (meaning into the second housing part 134). The beveled ends of the guide springs 824 preclude (or at least almost preclude) any locking of the guide springs 824 with the guide grooves 816 of the first housing 132 when the first body 110 is inserted.

According to further embodiments, the first body 110 can have a plurality of profile teeth 826 at its base side 822 that are disposed continuously around the first body 110. A number of the profile teeth 826 can be adjusted, for example, to a number of the process steps that are to be executed in the device. Correspondingly, a number of profile teeth in different devices that are suitable for different (bio)chemical processes can vary. Analogously, the number of guide springs 824 and of guide grooves 816 can vary as well. In the embodiment as shown in FIGS. 8AA-8BC, the first housing part 132 has eight guide grooves 816. Moreover, the first body 110 includes eight guide springs 824 and eight profile teeth 826.

The profile teeth 826 can be configured such, for example, as to facilitate a guiding of the second body 120 and/or the second revolver 120. In other words, FIG. 8BA shows by way of a side view of the first revolver 110 structures for the ball point pen mechanism with grooves between guide springs 824 in relation to the guide in the column (inside the first housing part 132) and recesses (profile teeth 826) for guiding the second revolver 120.

FIG. 8BB depicts a top view of the first revolver 110 with a plurality of cavities for reagent pre-storage. In the concrete embodiment seen here, the first revolver 110 has eight cavities. Inside the eight cavities, it is possible to pre-store, for example, eight different reagents for processing.

FIG. 8BC represents a view from below onto the first revolver 110 with the paths of three piercers that are disposed, for example, on the second revolver 120 for the purpose of opening closing means to the cavities of the first revolver 110. The three piercers perforate, respectively, the chambers (the cavities) with the pre-stored reagents. FIG. 8BC shows the respective paths the individual piercers describe in relation to the first body 110 when the second body 120 is twisted. A path of a first piercer 828*a* is represented by a dotted arrow. A path of a second piercer 828*b* is represented by a perforated arrow, and a path of a third piercer 828*c* is represented by a solid-line arrow. The individual numbers inside the respective cavities indicate, both in FIG. 8BB as well as in FIG. 8BC, in which phase, meaning in which order the piercers perforate the individual cavities and/or their closing means. For example, a first cavity 150*a* of the first body 110 is perforated in the first phase by the first piercer 828*a*. A liquid and/or a process means that is present inside the first cavity 150*a* of the first body 110 is then able to flow into a cavity of the second body 120. In a second phase, in which the second body 120 is twisted in relation to the first body 110 by one step (in relation to the first phase), the first piercer 828*a* perforates a second cavity 150*b* of the first body 110, thus allowing a liquid that is present in the second cavity 150*b* of the first body 110 to flow into a cavity of the second body 120 (for example, the same cavity into which the liquid from the first cavity 150*a* of the first body 110 has already flown previously). In a third phase, the first piercer 828*a* perforates a third cavity 150*c*, thus allowing a liquid that is present in the third cavity 150*c* to flow into a cavity of the second body. The first piercer 828*a* therein can be connected to a cavity of the second body 120, whereby liquid from cavities, which have been perforated by the first piercer 828*a*, flows altogether into one and the same cavity within the second body 120. In a fourth phase, the second piercer 828*b* perforates a seventh cavity 150*g* of the first body 110, whereby liquid that is present inside the seventh cavity flows into a cavity of the second body 120. In a fifth phase, the second piercer 828*b* perforates an eight cavity 150*h* of the first body 110, thus allowing any liquid that is present inside the eighth cavity 828*a* of the first body 110 to flow into a cavity of the second body 120 (for example, the same cavity that received the liquid coming from the seventh cavity 150*g*). The second piercer 828*b* therein can be configured analogously to the first piercer 828*a* such that liquids from cavities, which are perforated by the second piercer 828*b*, flow into a common cavity in the second body 120 or take at least a common fluid path in the second body 120. In a sixth phase, the third piercer 828*c* perforates a fourth cavity 150*d*, whereby any liquid that is present inside the fourth cavity 150*d* flows into a cavity of the second body 120. Further reagents, or no regents, can be pre-stored inside a fifth cavity 150*e* and as sixth cavity 150*f*.

To prevent a piercer from perforating a cavity prematurely before the liquid from the respective cavity is needed, it is possible to dispose the piercers in an offset fashion on the second body 120, and the closing means of the respective cavities, which are marked as cross-hatched in FIGS. 8BB and 8BC, can only be perforated by the piercers at certain locations. Moreover, it is also possible for the individual piercers 828*a*, 828*b*, 828*c* to be extended from the second body 120 in a phase in which they are needed and retracted in another phase into the body 120. This can be initiated, for example, by means of the centrifugation protocol.

Figure 8C:
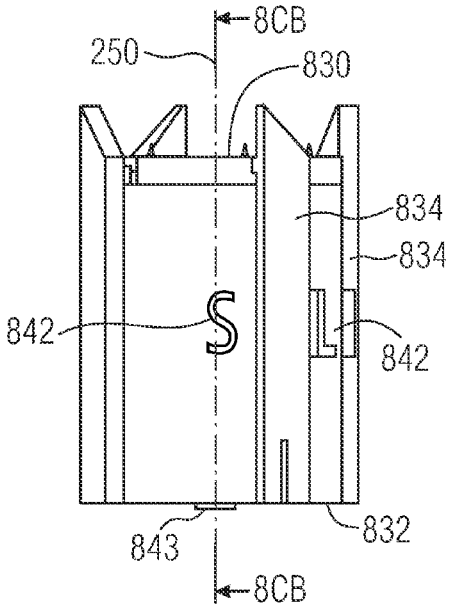
Figure 8C:
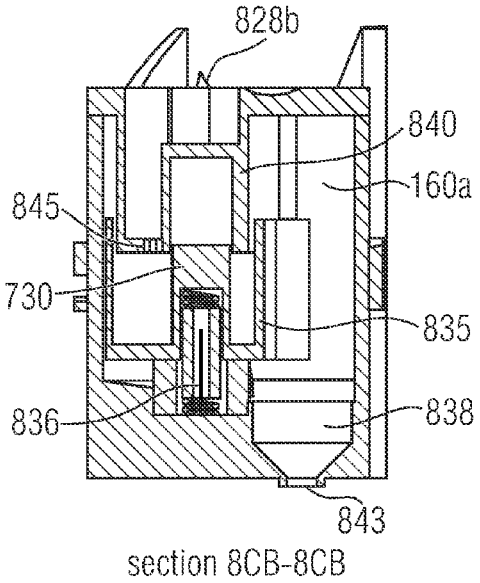
Figure 8C:
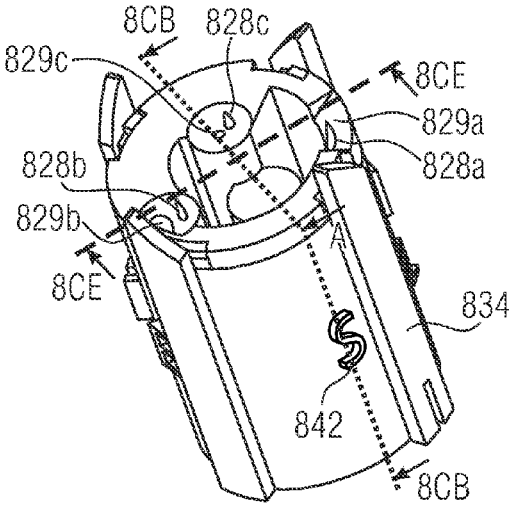
Figure 8C:
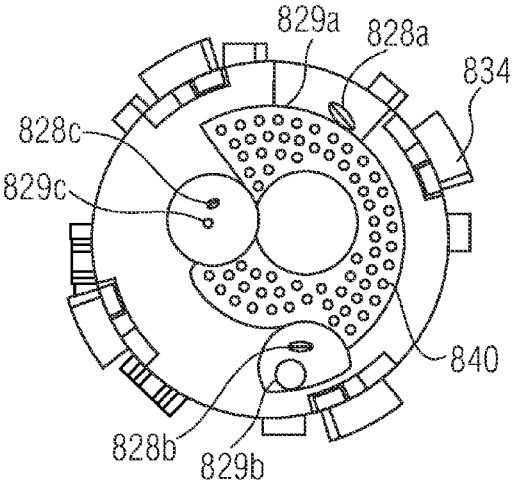
Figure 8C:
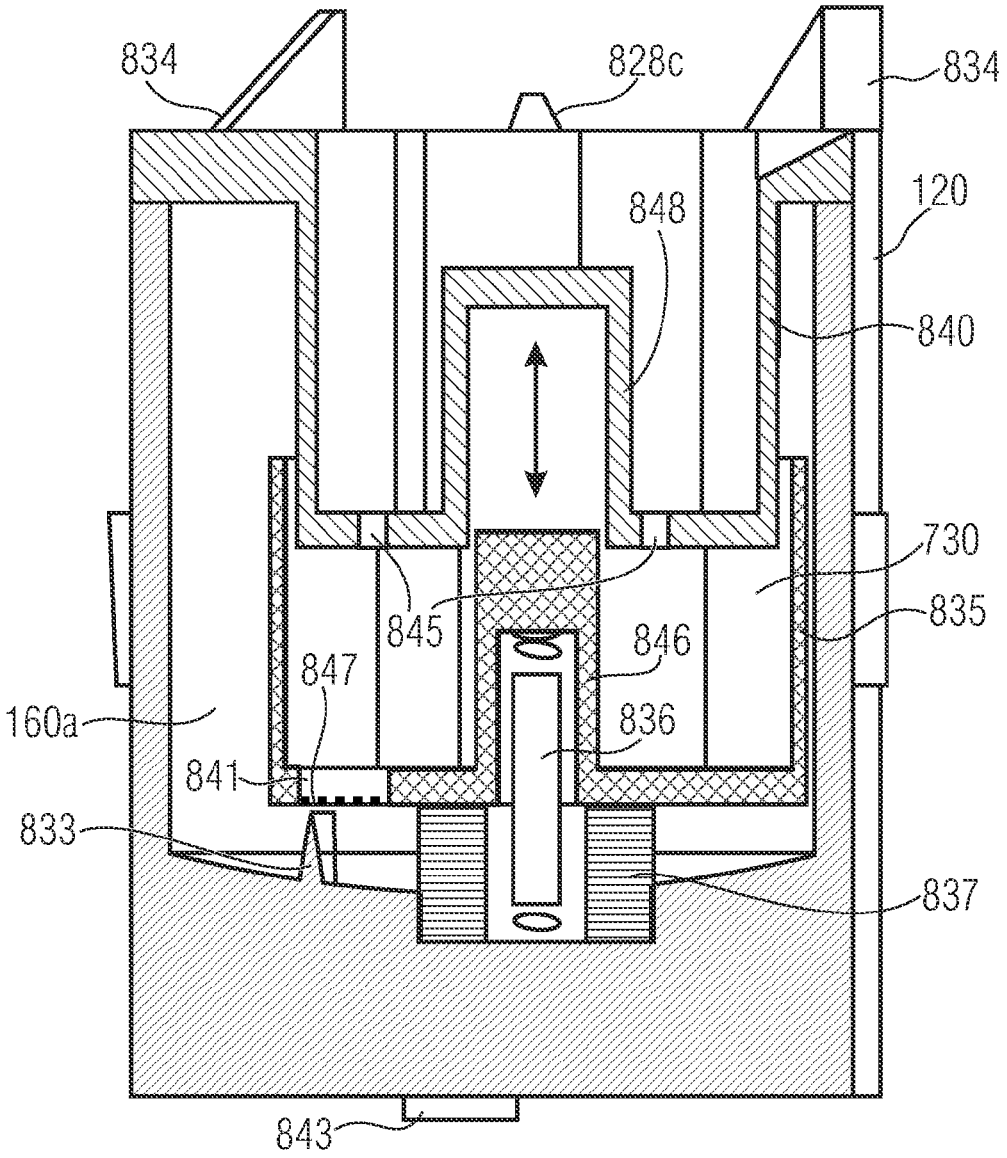

FIGS. 8CA-8CE depict the second body 120 (the second revolver 120) from different perspectives. FIG. 8CA shows the second body 120 in a side view. FIG. 8CB shows the second body in a sectional view along a sectional axis 8CB-8CB. FIG. 8CC shows the second body 120 in an isometric view. FIG. 8CD depicts the second body 120 in a top view. FIG. 8CE shows the second body 120 in another sectional view along a sectional axis 8CE-8CE. The second body 120 is a cylindrical body having a cover side 830 and a base side 832 opposite thereto. The second body 120 includes at its cover side 830, which can also be referred to as a lid, the three piercers 828*a*,828*b*, 828*c*. The three piercers are at different spacings in relation to an axis of rotation 250 of the body 120. The first piercer 828*a* is furthest removed from the axis of rotation 250, and the third piercer 828 is the least remote in relation to the axis of rotation. The second body 120 has, furthermore, a plurality of guide springs 834 that are disposed on the outer side of the second body 120. In the embodiment as shown in FIGS. 8CA-8CE, the second body 120 includes four guide springs 834. The guide springs 834 protrude beyond the cover side 830 of the second body 120 having in their end regions, where they protrude the cover side 830, beveled ends, respectively. The guide springs are configured such that, during a transition from one phase of the device 700 to the next phase (for example, from the first phase to the second phase), they engage interactively with the profile teeth 826 of the first body 110 and the guide grooves 816 of the housing 130. A number of guide springs 834 can be provided depending on the number of envisioned process steps for a process for which the device 700 is intended.

Furthermore, the second body 120 can include a mixing device 730 that is configured such as to blend at least two different fluids or liquids within the first cavity 160*a* of the second body 120. In the following, it is, therefore, possible to refer to the cavity 160*a* of the second body 120 as a mixing chamber 160*a*. The mixing device 730 has a first mixing spring 836 inside the mixing chamber for the mixing action. In addition, the mixing device 730 has a separation device 840 or perforated trough 840 with (passage) openings 834 or holes 845) that is locked in place in the mixing chamber 160*a* on the first body 120. The perforated trough 840 can also be referred to as a perforated plate 840. The openings 845 of the perforated trough 840 are disposed on the perforated trough 840 in such a way that, upon reception of the device 700 inside a rotor of a centrifuge and rotation of the rotor, the openings 845 are radially disposed furthest to the outside with regard to the perforated trough 840. The perforated trough 840 can be open toward the cover side 830 of the second body 120 allowing a liquid to flow from one cavity of the first body 110 into the cavity 160*a* of the second body 120, and thereby into the perforated trough 840. In addition, inside the mixing chamber 160*a*, the mixing device 730 has a mixing trough 835 or a mixing bowl 835. The mixing trough 835 is movably disposed in relation to the perforated trough 840 within the mixing chamber 160*a*. The mixing trough 835 is disposed such that, upon a rotation of the device 700, the mixing trough 835 is disposed radially further to the outside than the perforated trough 840. A liquid that can be present inside the perforated trough 840 can, due to the centrifugal force being generated by the rotation, flow through the openings 845 of the perforated trough 840 in the mixing trough 835. The perforated trough 840 and the mixing trough 835 therein are configured such that, upon a movement of the mixing trough 835, the perforated trough 840 can be retracted into the mixing trough 835. Correspondingly, the mixing trough 835 has a larger cross-section than the perforated trough 840 in order to receive the perforated trough 840 upon occurrence of a movement of the mixing trough 835. The mixing trough 835 has an elevation 846 for receiving the first mixing spring 836. Further, the perforated trough 840 has an elevation 848 that is adjusted to the elevation 846 of the mixing trough 835, thus making it possible for the perforated trough 840 to be received by the mixing trough 835, when the mixing trough 835 moves in relation to the perforated plate 840. The first mixing spring 836 therein is disposed between the mixing trough 835 and the second body 120 in such a way as to exercise a restoring force on the mixing trough 835 counteracting to the centrifugal force.

Furthermore, the mixing trough 835 can have a hole 841 (or multiple holes 841) with a closing means such as, for example, a lid film 847. The hole 841 of the mixing trough 835 therein is disposed on the mixing trough 835 in such a way that, upon a rotation of the rotor, the hole 841 is radially disposed furthest to the outside in relation to the mixing trough 835. A piercer 833 can be disposed on the second body 120. The piercer 833 therein can be disposed such on the second body 120 that, responding to a given angular velocity of the rotor, it perforates the lid film 847 of the hole 841. In connection with the hole 841 and the lid film 847, the piercer 833 thus constitutes a valve of the mixing trough 835 and also of the mixing chamber 160*a* of the second body 120. The mixing device 730 can, furthermore, include a second mixing spring 837 inside the mixing chamber 160*a*. The second mixing spring 837 can be disposed between the mixing trough 835 and the second body 120, which is in the same way as the first mixing spring 836, wherein a spring constant of the second mixing spring 837 can be greater than a spring constant of the first mixing spring 836. This means that a restoring force that is generated by the first mixing spring 836 is less than a restoring force that is generated by the second mixing spring 837.

In addition, the second body 120 can have a dripping spout 843 on its base side 832.

Depending on the rotation frequency or an angular velocity of a rotor of a centrifuge, the first mixing spring 836 moves the mixing trough 835 within the cavity 160*a* (the mixing chamber 160*a*) upward and downward, whereby any liquid that is present inside the mixing chamber 160*a* is blended with another liquid that is present inside the mixing chamber 160*a*. In other words, the mixing trough 835 is moved by the alternating centrifugal force with a change of the angular velocity of the rotor and the restoring force of the first mixing spring 836 counteracting the centrifugal force. The centrifugal force thus moves the mixing trough 835 to a point that is radially further to the outside, and the first mixing spring 836 counteracts this movement. The alternating rotary frequency of the centrifuge causes the mixing trough 835 to move back and forth. Any liquid that is present inside the mixing trough 835 is transported with each movement of the mixing trough 835 through the openings 845 of the perforated trough 840. Provided the perforated trough 840 and the openings 845 have an expedient design, this will result in a blending action. In other words, with changeable spring length, the liquid flows through the openings 845 of the perforated trough 840, thereby resulting in a mixing process. Said mixing action is embodied therein by the interaction of centrifugal force and restoring force (generated by the first mixing spring 836). The change of the rotary frequency of the centrifuge (or in the angular velocity of the rotor of the centrifuge) moves the mixing trough (or mixing bowl) 835 from a location that is radially further to the inside to a location that is radially further to the outside, and vice versa. The liquid that is present inside the mixing bowl 835 is routed therein through the openings 845 of the perforated trough 840, thus resulting in a blending action.

The second mixing spring 837 serves for switching the valve (constituted of the hole 841, the lid film 847 and the piercer 833). As previously mentioned, the second mixing spring 837 has a higher spring constant than the first mixing spring 836, whereby comparatively high rotary frequencies of the centrifuge are needed until the second mixing spring 837 is compressed and the piercer 833 opens the lid film 847 of the hole 841. An angular velocity of the rotor of the centrifuge that is needed for the compression of the second mixing spring 837 therein can be greater, in particular, than an angular velocity of the rotor that is needed compressing the first mixing spring 836. Furthermore, a spring constant of the first mixing spring 836 can be greater than a spring constant of spring 710 that serves for twisting the second body 120 in relation to the other two bodies 110, 510 of the device 700.

After the piercer 833 has opened the lid film 847, the liquid that is present in the mixing trough 835 can exit the second revolver 120 via a column 838 (for example, a silica column 838) inside the mixing chamber 160*a* and through the dripping spout 843 flowing, for example, into the waste collecting container (the waste chamber) 720*b* or the eluate collecting container (the eluate chamber) 720*a* of the third body 510.

On the cover side 830 of the second body 120, the piercers 828*a*, 828*b*, 828*c* can have fluid guides, for example, by means of funnels and subsequent channels or inclines, thus allowing for the possibility of different paths of the fluids to take within the mixing chamber 160*a* whose cavities the piercers perforate.

Correspondingly, for example, it is possible for fluids released by the first piercer 828*a* to be routed directly to the perforated trough 840 by means of a first fluid guide 829*a*, which is constituted as an incline. Fluids that were released by the second piercer 828*b* can be routed, for example, by means of a second fluid guide 829*b*, which is constituted as a funnel with a channel leading past the perforated trough 840 and the mixing trough 835, and to the column 838 or a region of the mixing chamber 160*a* outside of the mixing chamber 835. The region can be, for example, fluidically connected to the column 838, whereby the fluid flows from the region to the column 838. Fluids that are released by the third piercer 828*c* can be routed directly over the column 838, for example, by means of a third fluid guide 829*c*, which is also constituted as a funnel with a channel leading past the perforated trough 840 and the mixing trough 835. The channel of the third fluid guide 829*c* therein can have a smaller cross-section than the channel of the second fluid guide 829*b*, for example, such that a fluid flows more slowly through the third fluid guide 829*c* than through the second fluid guide 829*b*.

Furthermore, the mixing chamber 160 can be tapered frustoconically in an area below the mixing trough 835 (radially further outside than the mixing trough 835), for example, in order to constitute a funnel to the dripping spout 843 for the fluids that are present in the mixing chamber 160*a*.

According to further embodiments, the valve inside the mixing chamber 160*a* can also be constituted as a predetermined breaking point or a siphon such as to blend, for example, multiple liquids and/or reagents from the first body 110 inside the mixing chamber 160*a* and in order to open this valve or predetermined breaking point or siphon in the context of a preset process step in order for the blended reagents to be able to exit the mixing chamber 160*a* (for example, via the dripping spout 843).

As described previously, the mixing chamber 160*a* can have a (chromatographic) column 838 at an exit (on the dripping spout 843) that is directed toward the base side 832 such as is needed, for example, for a DNA extraction for the constitution of reagents. A blended liquid therein can be routed over column 838, as described above, by means of a valve or a predetermined breaking point or a siphon. As described above, the mixing chamber 160*a* can have a film 847 or a membrane 847 that can be perforated by the piercer 833, which is located inside the second body 120, in response to a given angular velocity of the rotor.

According to further embodiments, the mixing trough 835 can be locked in place inside the second body 120 or supported on the second mixing spring 837. The perforated trough 840 therein is able to move upward and downward inside the mixing trough 835, due to the changeable angular velocity of the rotor. The first mixing spring 836 therein can be disposed, for example, between the mixing trough 835 and the perforated trough 840.

According to further embodiments, the second body 120 can include a plurality of cavities, and thereby also a plurality of mixing chambers, for example, with separate mixing devices.

According to further embodiments, the second body 120 can have a scale indicator 842 on its outer side that can, in connection with the observation window 814 of the first housing part 132, constitute, for example, a phase indicator of the device 700. The scale indicator 842 can be easily embodied, for example, using letters and/or numerals that indicate a phase of the device 700.

Figure 8D:
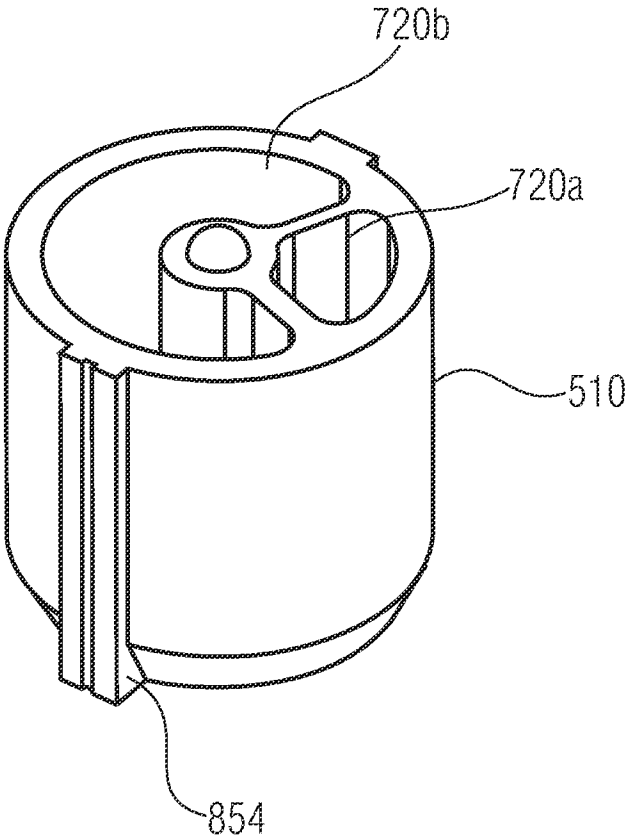
Figure 8D:
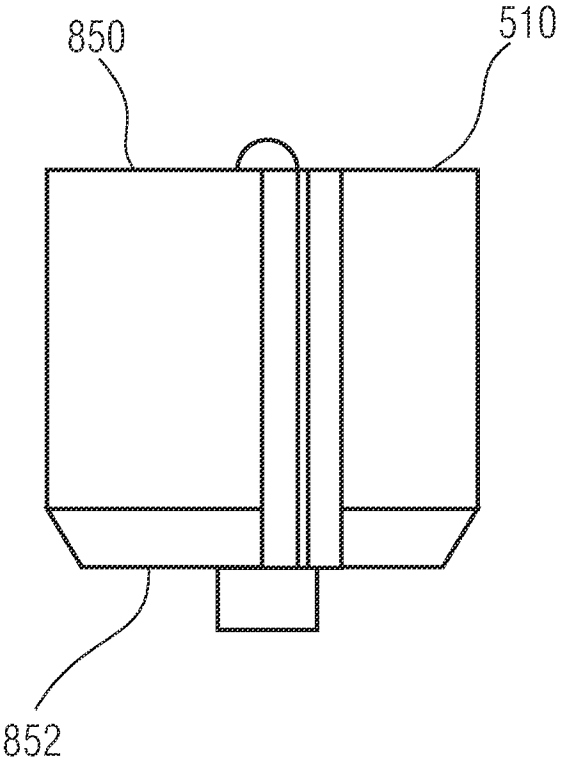

FIGS. 8DA and 8DB show a third body 510 (the third revolver 510), viewed from two different perspectives. FIG. 8DA depicts the third body 510 in a side view, and FIG. 8DB is an isometric representation of the third body 510. The third body 510 is a cylindrical body with a cover side 850 and a base side 852 arranged opposite thereto. The third body 510 has, as described previously in context with FIG. 7, a waste chamber 720*b* as well as an eluate chamber 720*a* for the purpose of collecting the eluate such as, for example, for DNA filtration. Furthermore, the third body 510 includes guide springs 854 at its outer side intended to prevent, for example, any twisting of the third body 510 when the device 700 transitions from one phase to the next phase.

According to further embodiments, the third body 510 can be configured such that it is removable from the housing 130, for example, to subject the liquid that has been collected inside the eluate chamber 720*a* to the implementation of further processing steps.

According to further embodiments, the third body 510 can also have any plurality of cavities.

The third revolver 510 can, moreover, be referred to as the collection revolver for effluent (waste) and eluate.

According to further embodiments, the device 700 can also have any plurality of bodies, wherein each of the bodies can have any plurality of cavities, for example, as a function of the processing for which the device is suited.

Using FIGS. 9A and 9B, the principle of the ball point mechanism as it is utilized by the device according to FIG. 7 shall be explained below. Reference symbols as used in the drawings are only intended to illustrate what parts of the ball point principle correspond to what part of the device 700.

The pressure mechanism that is used in device 700 according to FIG. 7 is based on a principle that finds application in the ball point pen. The pressure mechanism of a ball point pen ensures that the ink insert of the pen is either hidden inside the grip tube or protrudes from the housing, ready to write. The different positions of the insert are embodied by interlocked elements, wherein the elements also twist in relation to each other when the pressure mechanism is operated. This twisting action is also used in ball point pens that are used for advertising purposes to display text that changes with each pressure instance. A pressure mechanism of this kind as found on a ball point pen comprises the following four elements: a stator, which is constituted on the device 700 by the housing 130 and the guide grooves 816; a piston, which is constituted on the device 700 by the first body 110 with the guide springs 824 and profile teeth 826 thereof; a rotor, which is constituted on the device 700 by the second body 120 and the guide springs 834 thereof; and a spring, which is constituted on the device 700 by the spring 710.

Figure 9B:
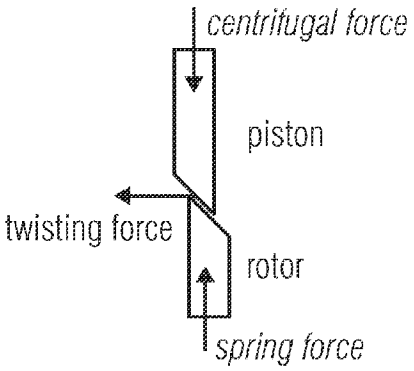
FIGS. 9A and 9B are schematic representations to illustrate the principle of a ball point pen such as can be utilized in a device according to an embodiment of the present invention.
Figure 9A:
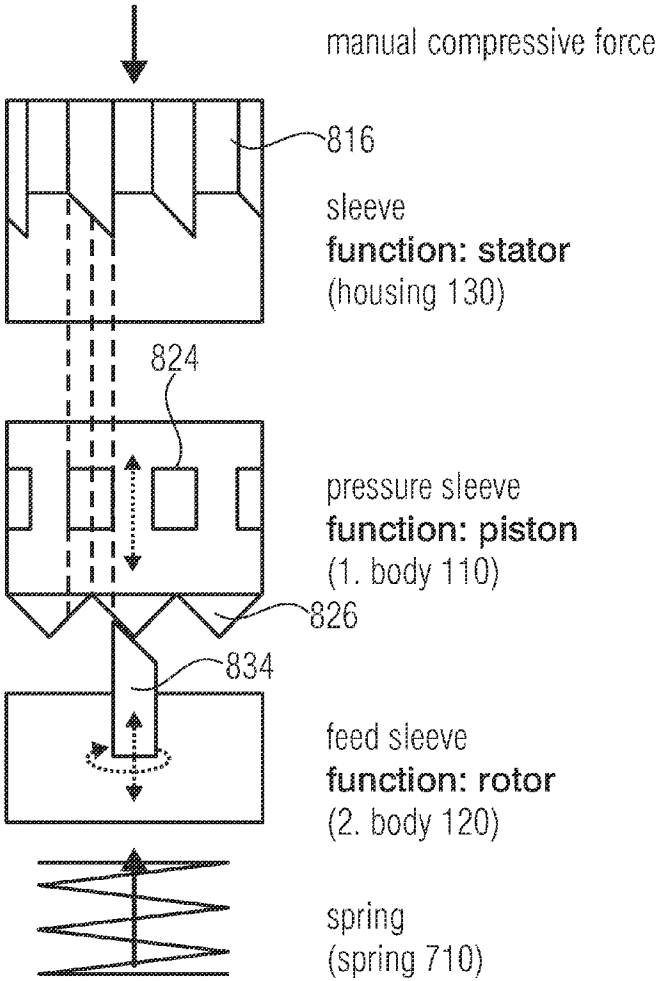

FIG. 9A is a schematic depiction of the interaction of the four elements inside a ball point pen. The stator (sleeve) is depicted in this representation similarly to an explosion drawing above and typically surrounds the piston (pressure sleeve) and the rotor (feed sleeve). The stator with its incorporated profile (guide grooves 816) ensures that the piston (first body 110) can only move upward and/or downward. The rotor (second body 120), on the other hand, is able to move vertically as well as around the axis of rotation (for example, the axis of rotation 250).

The stator (housing 130) and piston (first body 110) together cause the twisting of the rotor (second body 120) upon an easing of the manual pressure force (in the device 700 upon easing of the centrifugal force). First, the needed horizontal force component is generated between piston (first body 110) and rotor (second body 120), shortly thereafter between rotor (second body 120) and stator (housing 130). In ball point pens, via grooves of different lengths in the stator, the rotor is able to snap into place in vertically different positions.

Correspondingly, in ball point pens, it is thus a switching between manual pressure force and a restoring force of a spring that causes the gradual twisting of the rotor.

FIG. 9B is a representation of the profile of the pressure mechanism that is needed for the twisting action. Due to the fact that the spring continuously presses upward, a horizontal force portion occurs at the slanted ends that are attached to the elements. The same is utilized for the twisting action. It is possible to define the states extend-insert and retract-insert by means of the twisting action. In other words, a horizontal force component occurs at the slanted profiles and ensures the twisting action of the rotor.

Such a ball point pen mechanism is also disclosed in specification DE20000422U1.

Figure 10:
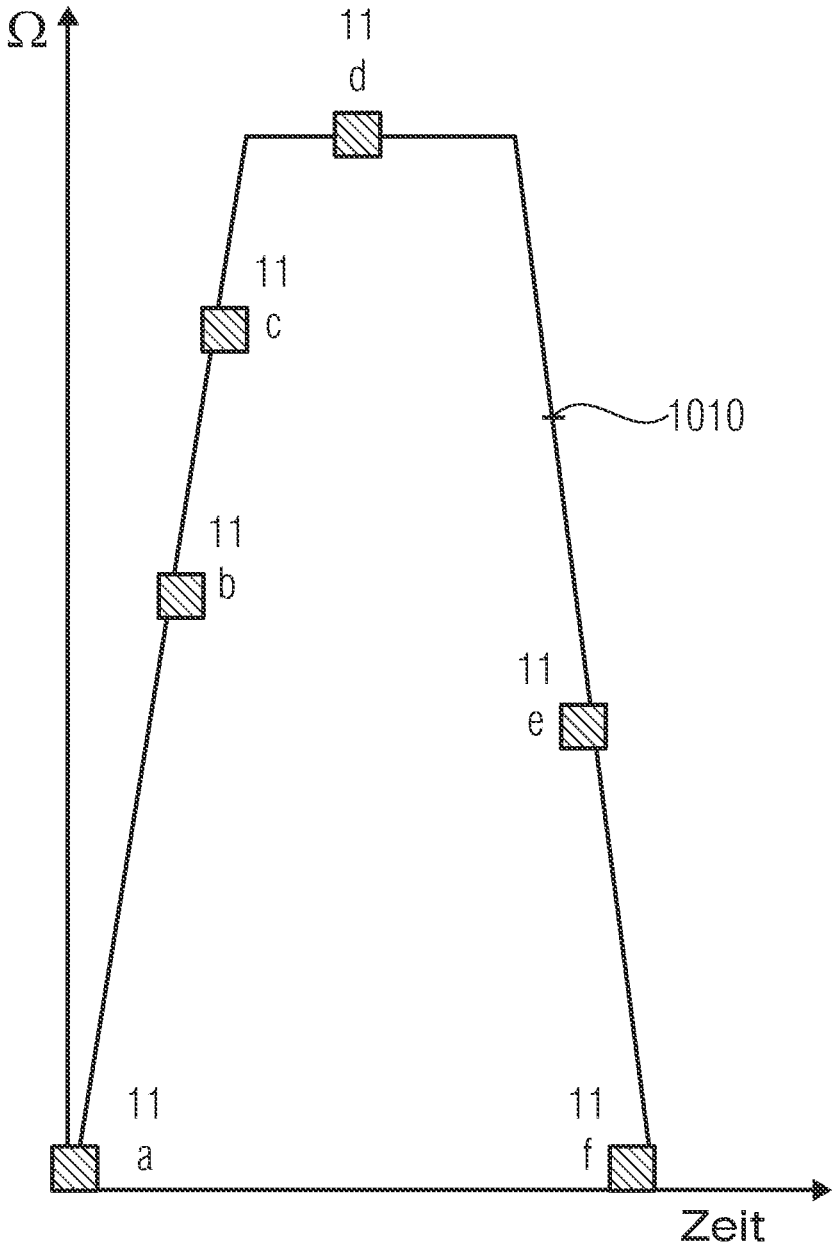
FIG. 10 is a diagram of angular velocity of a rotor of a centrifuge over time.

FIG. 10 demonstrates a diagram of angular velocity over time. Ω therein stands for an angular velocity of a rotor of a centrifuge at which a device according to an embodiment of the present invention (for example, device 700) is inserted. Correspondingly, the rotor of the centrifuge has different angular velocities at different points in time. Different combinations of angular velocity and time are marked on a curve 1010 of the diagram by means of symbols 11*a*-11*f*, meaning a combination of angular velocity over time 11*a* corresponds to FIG. 11A, a combination of angular velocity over time 11*b* corresponds to FIG. 11B, etc. The curve 1010 thus shows in an exemplary fashion a schematic course of the rotary frequency during an operating step of the device 700.

FIGS. 11A-11F depict a partial area of a device according to an embodiment of the present invention (for example, device 700) according to FIG. 7. The partial area shows the interlocking of the first body 110 with the second body 120.

Figure 11A:
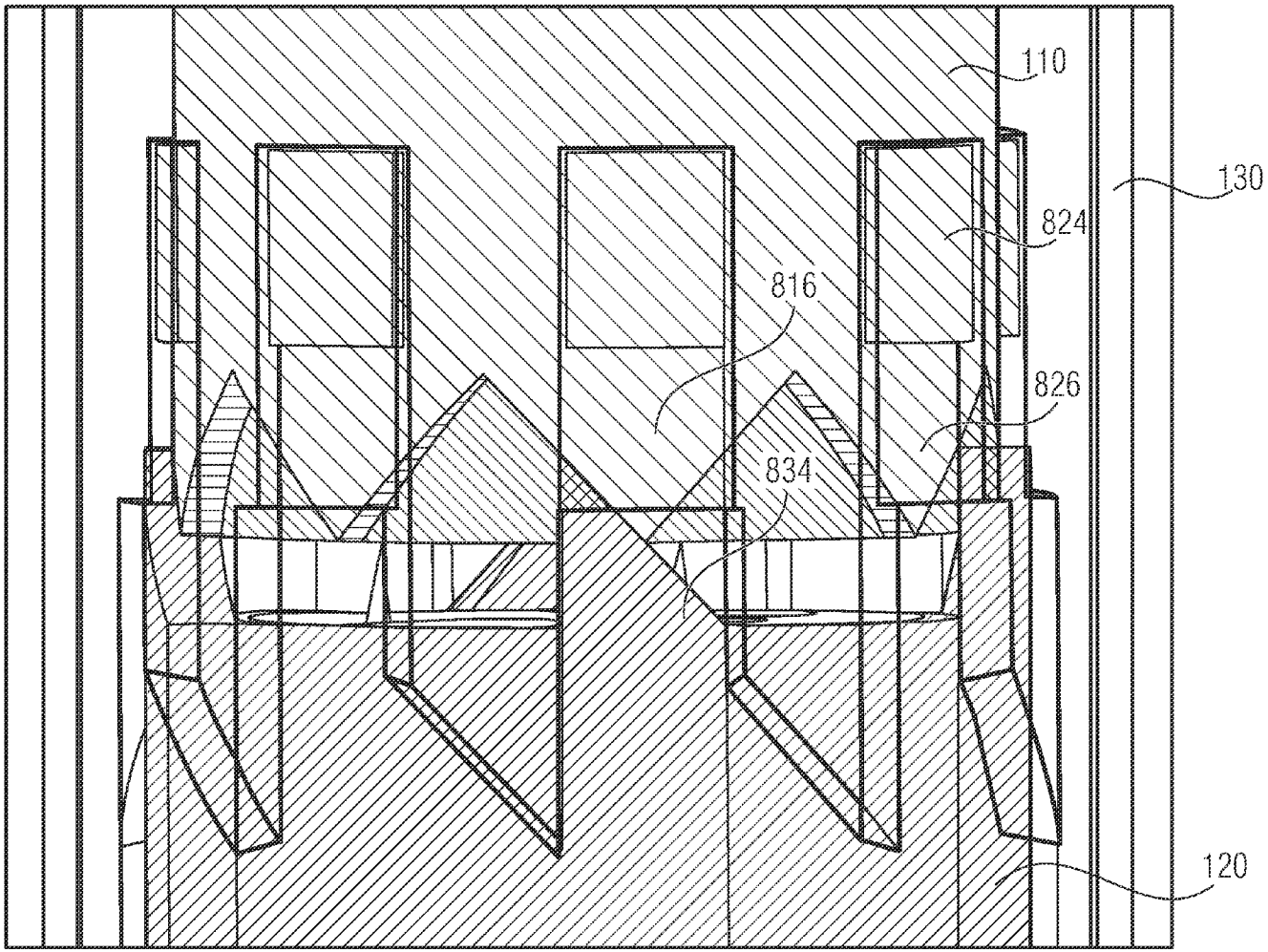
FIGS. 11A-11F are schematic representations of two bodies of a device according to an embodiment of the present invention, as a function of the angular velocity of a rotor over time as shown in FIG. 10.

FIG. 11A shows the device in the starting position; an angular velocity of the rotor is minimal in the starting position with regard to the course of the rotary frequency. By its guide springs 824, the first body 110 (revolver 110) touches the upper stop of the guide, meaning the upper stop of the guide grooves 816 of the housing 130. The second body 120 touches the profile teeth 826 of the first body 110 by its guide springs 834 and is unable to come any closer to the body 110 because the guide grooves 816 of the housing 130 prevent it.

Figure 11B:
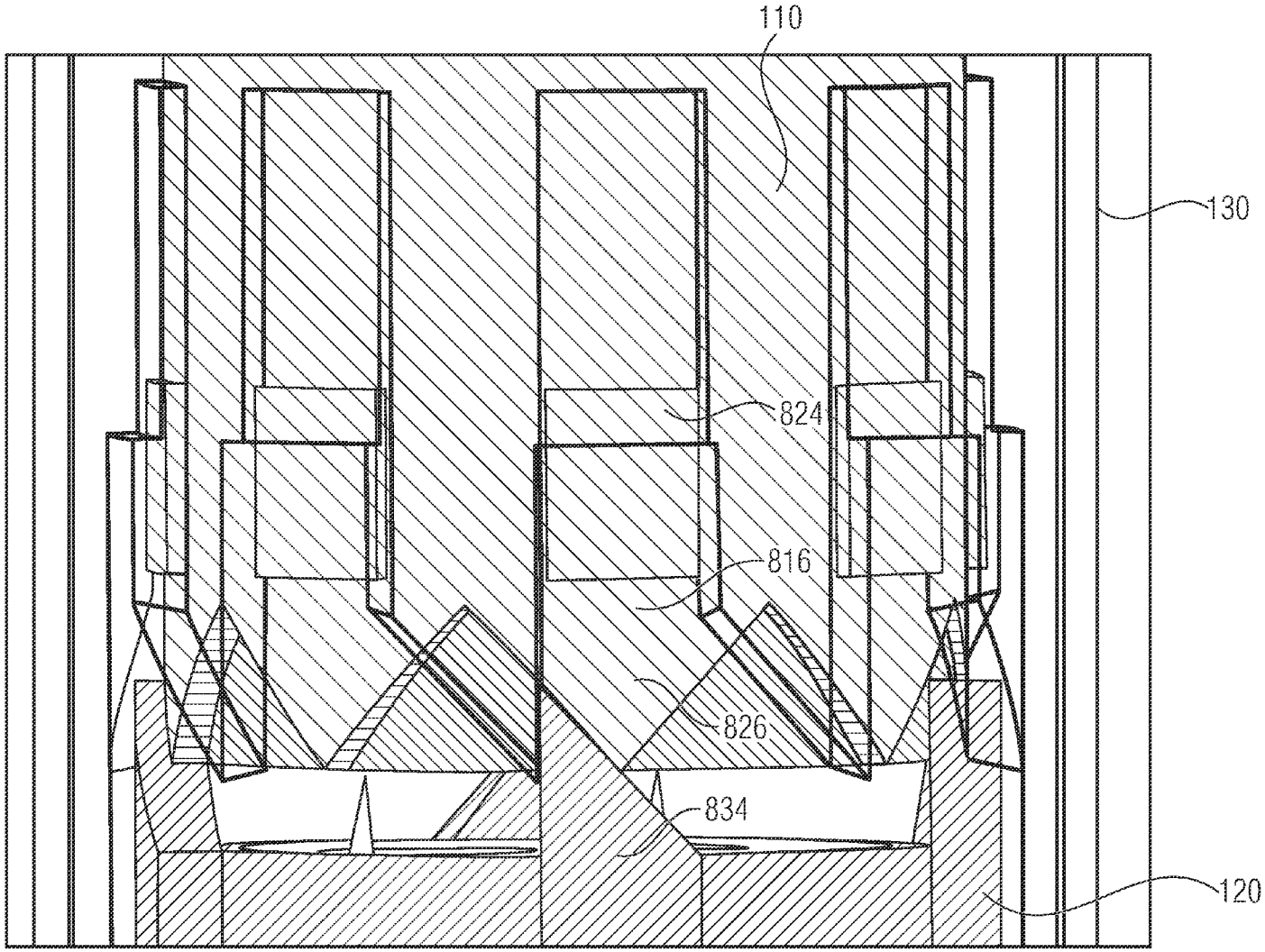

FIG. 11B shows a partial area for a time when the angular velocity is increased in relation to FIG. 11A. Due to the frequency increase, the revolvers (the two bodies 110, 120) migrate downward (toward radially outside). The second revolver 120 is preventing from rotating by the guide of the sleeve, meaning by the guide grooves 816 of the housing 130.

Figure 11C:
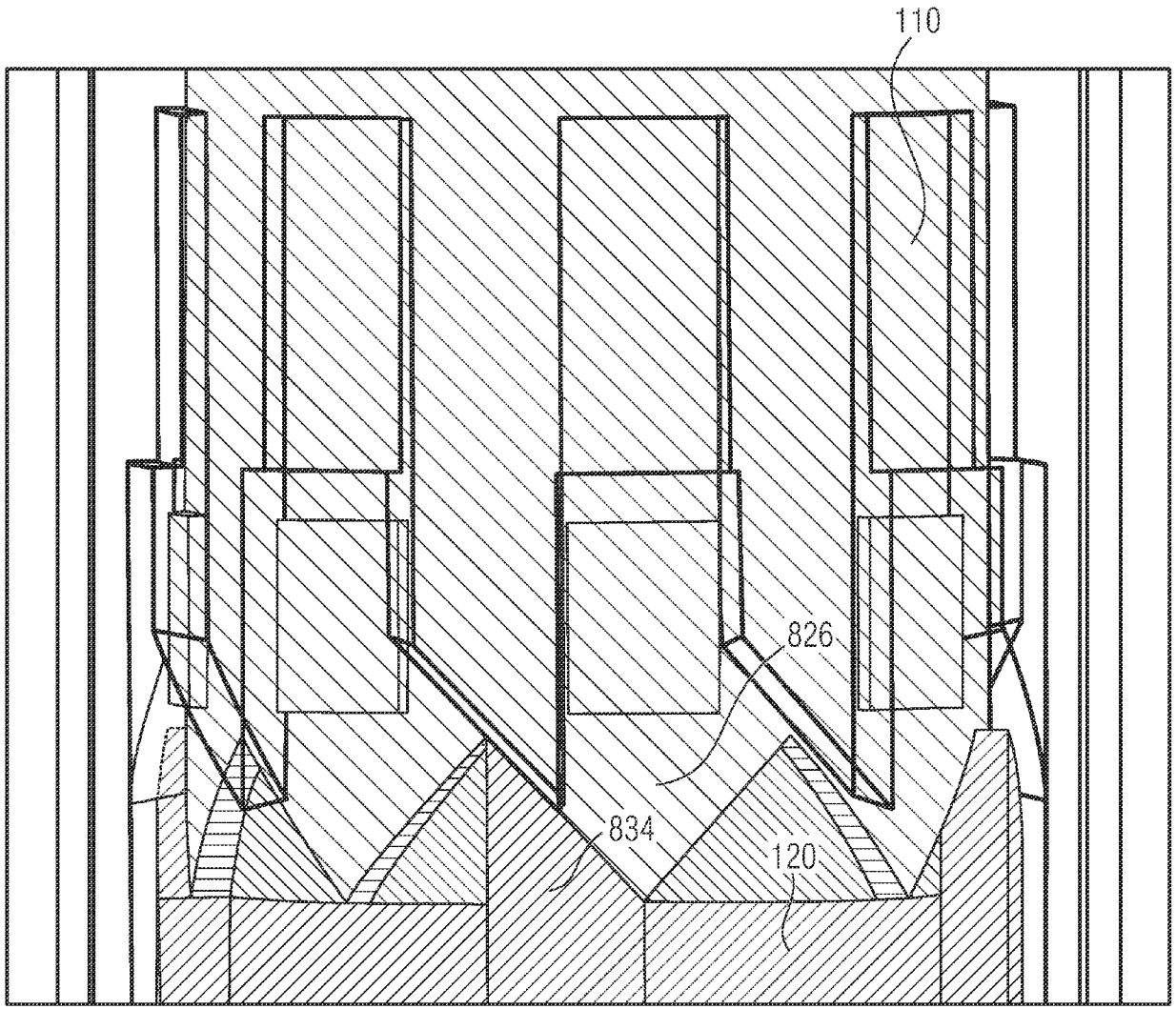

In FIG. 11C, with the rotary frequency further increased, the second revolver 120 migrates beyond the guide of the sleeve (beyond guide grooves 816 of the housing 130) and rotates, due to a horizontal force occurring between the profile teeth 826 of the first body 110 and the guide springs 834 of the second body 120, to the left. The first revolver 110 and the second revolver 120 therein approach each other and a piercer of the lid (cover side 830 of the second revolver 120) perforates the lid film (a closing means of a cavity) of the first revolver 110. The guide springs 834 of the second body 120 are engaged in the profile teeth 826 of the first body 110. Any liquid that is present in a cavity, which was perorated by a piercer of the second body 120, can now flow from said cavity into a cavity in the second body 120.

Figure 11D:
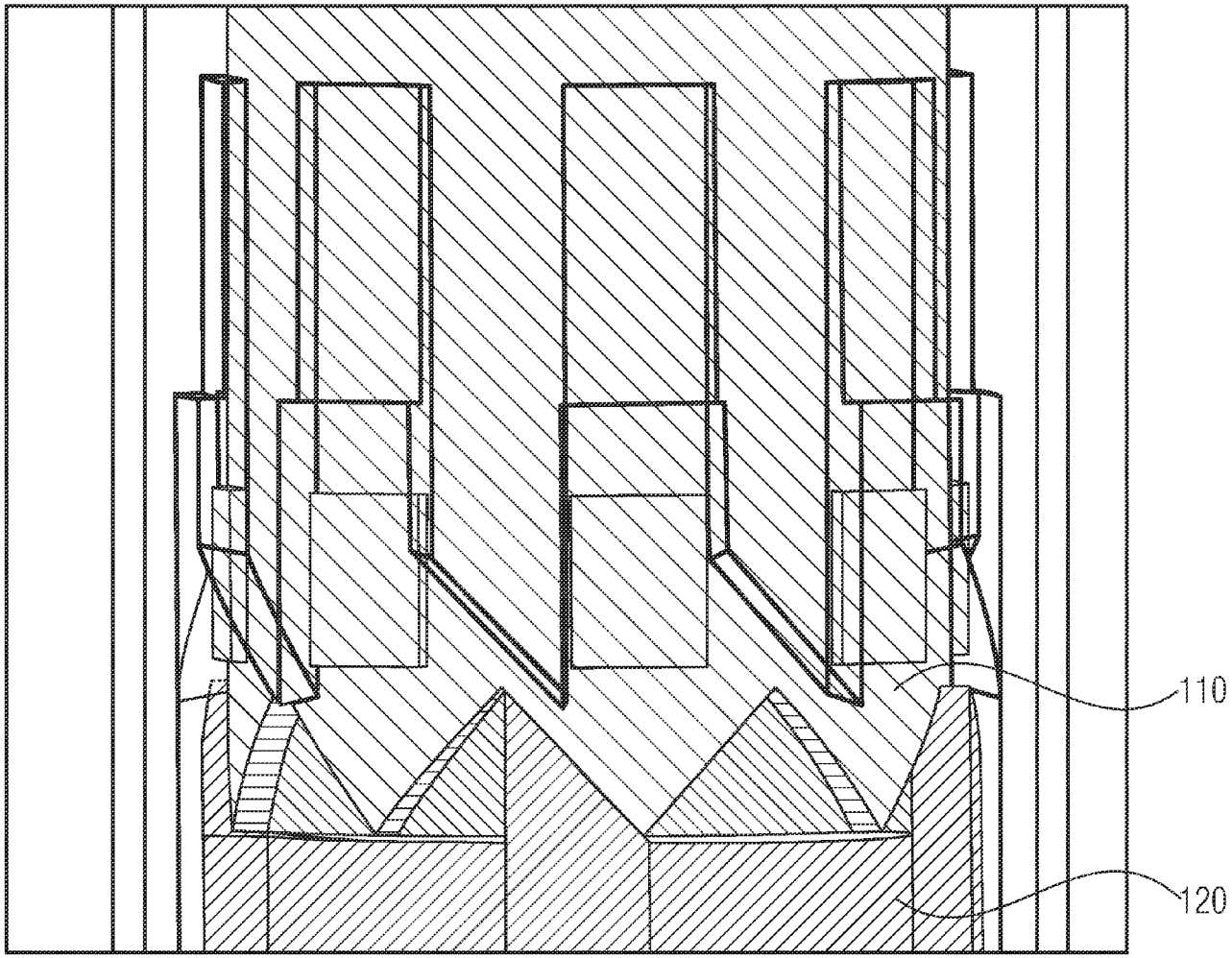

FIG. 11D depicts the partial area after a further increase of the rotary frequency; here, the two revolvers 110, 120 are completely extended. The spring 710 that generates a restoring force counteracting the centrifugal force is maximally compressed, when the revolvers 110, 120 are maximally extended, because the centrifugal force that is generated by the rotation of the rotor is greater than the restoring force that is generated by the spring 710.

Figure 11E:
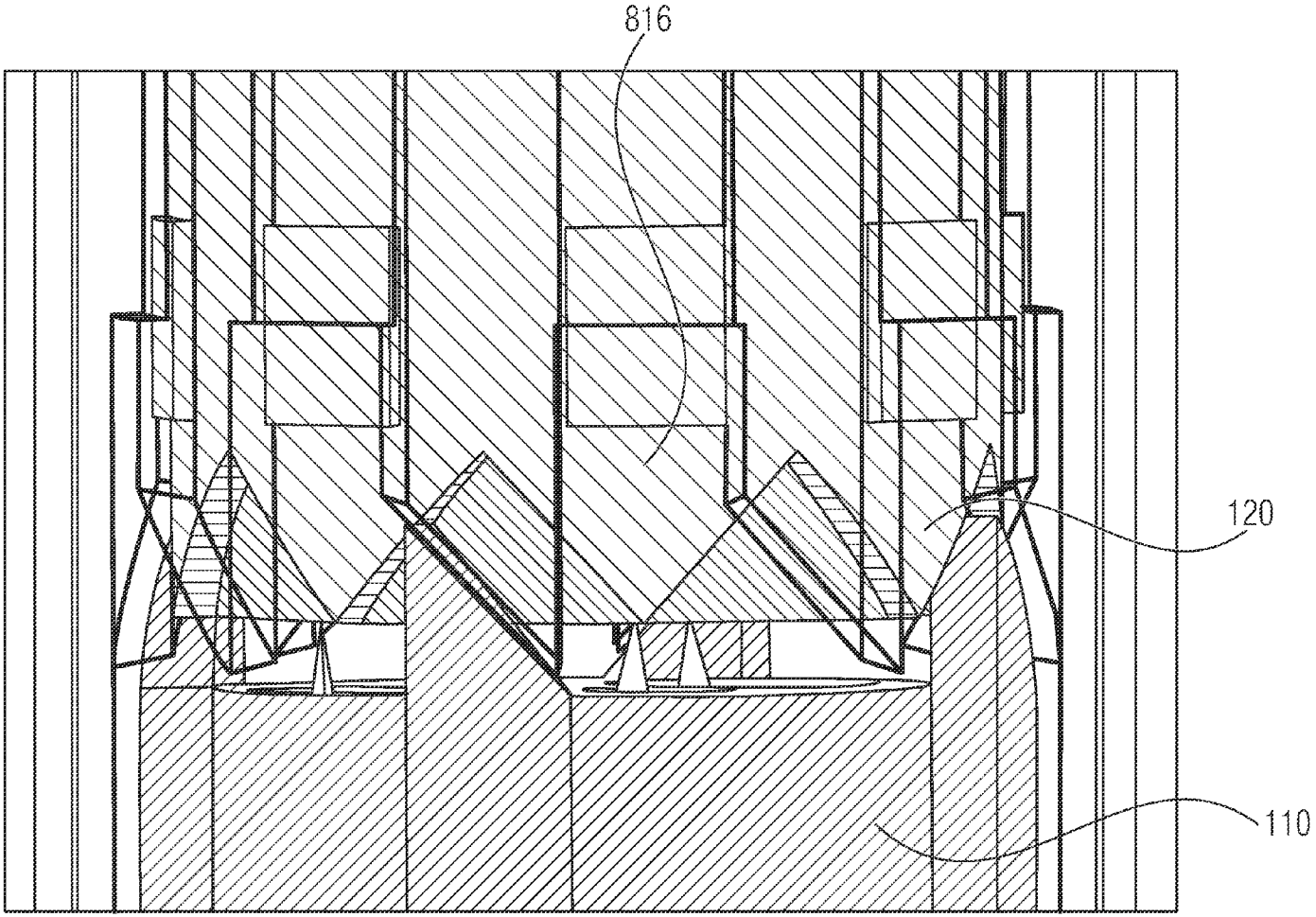

FIG. 11E shows the partial area at a throttled rotary frequency in contrast to FIG. 11C. The spring force (restoring force) of the spring 710 presses the two revolvers 110, 120 upward again. The second revolver 120 moves along the slanted guide of sleeve 1 (or along rims of guide grooves 816 of the first housing part 132 of the housing 130) further to the left. The first revolver 110 and the second revolver 120 move away from each other, and the piercer of the second revolver 120 is released.

Figure 11F:
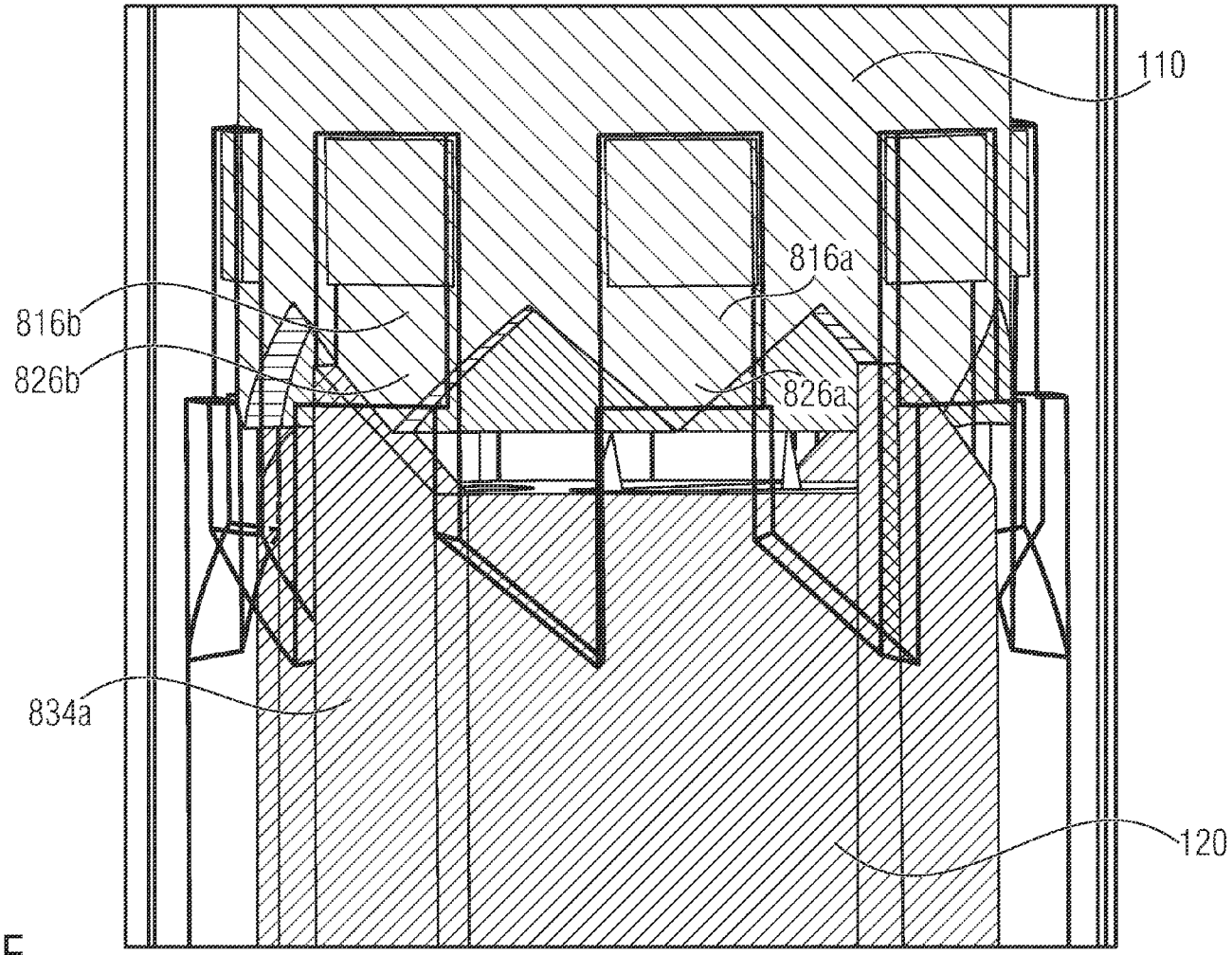

FIG. 11F shows the partial area after the rotary frequency has been throttled further. The system is located in the starting position and rotated by an eighth of a rotation to the left in comparison to the position in FIG. 11A. A guide spring 834*a* that was engaged in FIG. 11A with a guide groove 816*a* of the housing 130 and a first profile tooth 826*a* of the first body is now, in FIG. 11F, engaged in a second guide groove 816*b* of housing 130, which is adjacent to the first guide groove 816*a*, and a second profile tooth 826*b* of the first body 110, which is adjacent to the first profile tooth 826*a*.

Figure 12A:
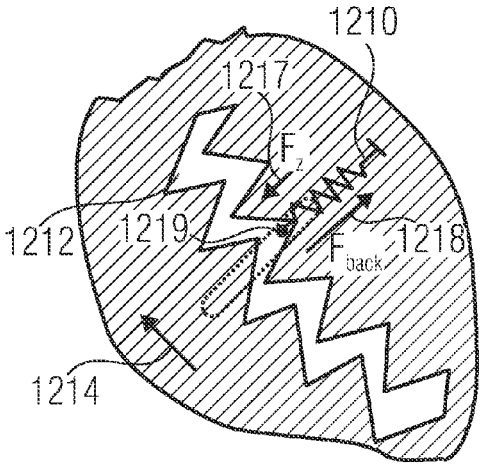
FIGS. 12A-12C are schematic representations to illustrate a ratchet principle and a schematic depiction of a device according to an embodiment of the present invention utilizing the ratchet principle.
Figure 12B:
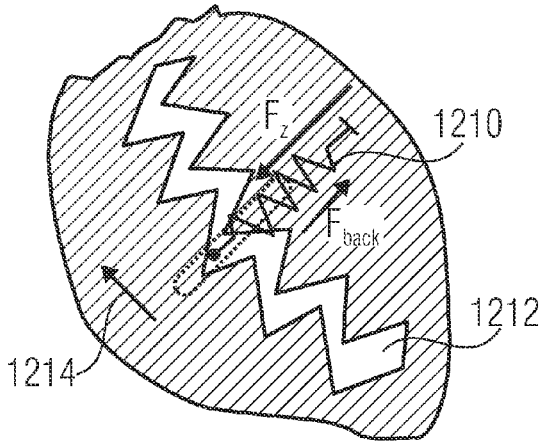
Figure 12C:
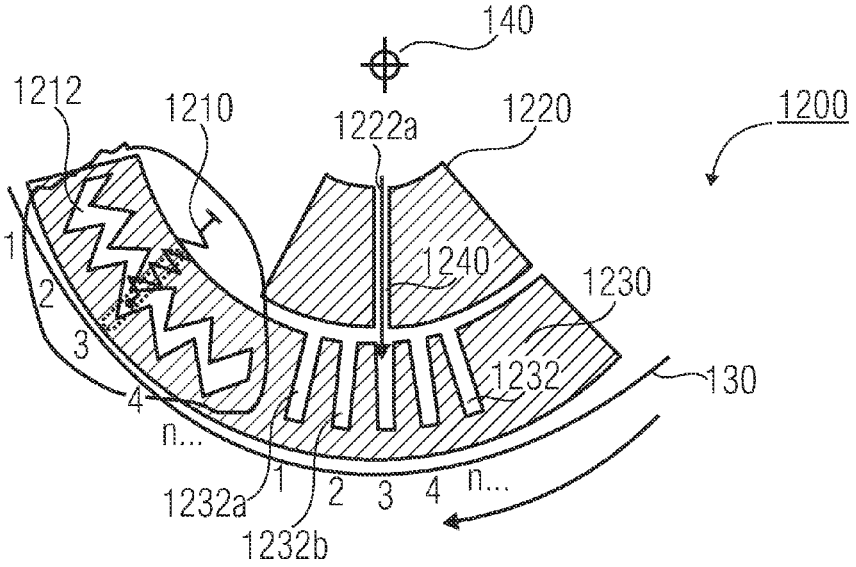

FIGS. 12A-12C are exemplary representations of how a ratchet mechanism can be used as a pressure mechanism for the device according to an embodiment of the present invention in order to automatically, meaning depending on a centrifugation protocol, couple different cavities of bodies disposed in a radial direction to each other.

FIG. 12A depicts a restoring element 1210 that runs inside a conveying rail 1212. The restoring element 1210 can be configured, for example, as a spring having at one end a pin 1219 with a mass. The restoring element therein is configured such that it generates a restoring force counteracting the centrifugal force. A direction of the arrow 1218 therein indicates the direction in which the restoring force acts, while the length of the arrow indicates the amount of the restoring force that is generated by the restoring element 1210. A direction of the arrow 1217 therein indicates a direction of the centrifugal force that is generated by the rotation of the rotor. A length of the arrow 1217 therein indicates an order of magnitude of the centrifugal force that is generated by the rotation of the rotor. It is clearly discernable in FIG. 12A that the centrifugal force is smaller than the restoring force. A rotary direction of the rotor of the centrifuge is indicated by an arrow 1214. FIG. 12A therein demonstrates a state with small angular velocity, the elastic restoring element 1210 is contracted and pulls the pin located at the end toward the center by the mass (toward the axis of rotation 140 of the rotor). A body of a device according to the embodiment of the present invention such as, for example, the first body 110 of the device 100, which is connected to the restoring element 1210, can thus be rotated further by a semi-step.

FIG. 12B shows a state at increased angular velocity; by increasing the angular velocity, the mass directs the pin 1219, which runs in the radial guide rail 1212, toward the outside. The body that is connected to the restoring element 1210 (such as, for example, the first body 110) is thereby rotated by a further semi-step. In FIG. 12B, the centrifugal force that is generated by the rotation of the rotor is greater than the restoring force generated by the restoring element 1210.

FIG. 12C depicts a part of a device 1200 for insertion into a rotor of a centrifuge according to an embodiment of the present invention. The device 1200 includes two bodies 1220, 1230 that are stacked one above the other and that can be separated from each other. Furthermore, the device 1200 has a housing 130 that is configured such as to be inserted into a holder of the rotor of the centrifuge.

The two bodies 1220, 1230 are disposed such inside the housing 130 in a stacking direction that, upon a correct reception of the device 1200 in the rotor of the centrifuge and upon a rotation of the rotor, a spacing of one of the two bodies 1220, 1230 in relation to an axis of rotation 140 of the rotor is smaller than a spacing of one of the other two bodies 1220, 1230 in relation to the axis of rotation of the rotor 140. In the concrete embodiment as shown in FIGS. 12A-12C, a spacing of a first body 1220 in relation to the axis of rotation 140 is smaller than a spacing of a second body 1230 in relation to the axis of rotation 140 of the rotor. In other words, the second body 1230 is disposed radially further to the outside in the housing 130 than the first body 1220. The first body 1220 has a cavity 1222*a*. The second body 1230 has a plurality of cavities 1232. The two bodies 1220, 1230 are movably disposed in relation to each other in the housing 130 in order to couple, responding to a rotation of the rotor, in a first phase, the cavity 1222*a* of the first body 1220 to a first cavity 1232*a* of the cavities 1232 of the second body 1230 fluidically and to couple, in a second phase, the cavity 1222*a* of the first body 1220 to a second cavity 1232*b* of the second body 1230 fluidically. The radial guide rail 1212 therein can be configured such that it is adjusted to the number of cavities 1232 of the second body 1230. In addition, the radial guide rail 1212 can be configured such that, at a high angular velocity of the rotor such as, for example, when the centrifugal force is greater than the restoring force, the cavity 1222*a* of the first body 1220 is coupled, respectively, to a cavity of the cavities 1232 of the second body 1230. FIG. 12C thus demonstrates how a ratchet mechanism can be used to sequentially interconnect a channel output or a cavity 1222*a* of a first body 1220 with different channel inputs or cavities 1232 of a second body 1230. A liquid flow 1240 therein can be routed such as, for example, in phases of high angular velocity of the rotor (meaning correspondingly in phases of high centrifugal force) from the cavity 1222*a* to one of the cavities 1232*a*-1232*n*, respectively, of the second body 1230. A conveying means, meaning a rotary direction of the rotor of the centrifuge can be opposite the rotary direction of the first body 1220 therein in relation to the second body 1230.

Although in the embodiment in FIGS. 12A-12C the first body 1220 twists in relation to the second body 1230, in further embodiments, it is also possible for the second body 1230 to twist in relation to the first body 1220.

As described based of FIGS. 11A-11F and 12A-12C, in order to achieve a displacement of the bodies in relation to each other in embodiments according to the present invention, it is possible to employ an actuation mechanism that can be characterized in that the variable centrifugal force interacts with a restoring force that is independent of the centrifugation (for example, a spring force, magnetic force, gravity, etc.), whereby a change of the centrifugation frequency causes the movement of an actor. Depending on the configuration of the mechanism, this can be a linear, a rotary or a motion that is guided along certain paths. Different mechanisms have been demonstrated (ball point pen mechanism, ratchet mechanism) that exercise such a function. Increasing the centrifugation frequency can cause the movement of the actor to go into one direction, while lowering the centrifugation frequency can cause the movement of the actor to go into the other direction. According to an embodiment, the movement of the actor can power a ratchet mechanism, as shown in FIGS. 12A-12C, thus also allowing for an advancement only in one direction. The advancement therein can be linear or rotary. According to further embodiments, the advancing motion can also be coupled to a lifting motion with an additional directional component. Said lifting motion can be executed, for example, bistably. In combination, these components can constitute a pressure mechanism such as can be found on a ball point pen. However, contrary to the ball point pen, the pressure mechanism is powered by the changing centrifugal force. With each centrifugation step, the mechanism can be gradually advanced, whereby a stepwise mutual displacement of the bodies occurs. This way, it is possible to bring different channel outputs sequentially in contact with different channel inputs (for example, different cavities). Employing a pressure mechanism, as according to the ball point pen principle that is demonstrated in FIGS. 11A-11F, can imply a lifting movement that can be utilized for modifying the spacing of the bodies in relation to each other or to further components. If needed, the lifting movement can be bistable and/or provided with a special course by the use of a curved path. According to some embodiments (as shown in FIGS. 11A-11F), the lifting motion can be used for perforating the lid (or the closing means) of a cavity in a defined process step using a piercer. Thus, it is possible to embody a valve that can be used to control the process.

As described previously, an actuating mechanism is based, on the one hand, on the centrifugal force that is generated by a rotation of the rotor and, on the other hand, on a restoring force. The restoring force therein can, as mentioned previously, be caused by a spring, a magnetic field or a gravitational field. In embodiments, a restoring means for generating the restoring force can be configured as a spring.

The actuating mechanism that is described in FIGS. 11A-11F and 12A-12C serving for the twisting action and/or generation of the lift can be an integral components of the devices according to the embodiments of the present invention. However, the actuating mechanism can also be an external reusable mechanism that is brought into contact with the device before use.

If the mechanism is an integral component of the device, it can be installed on each individual unit that is to twist or, alternatively, only on a single unit. In the last instance, the motion can be translated to other units by means of a shaft.

In an embodiment as external reusable mechanism, it is possible to attach the mechanism externally such as, for example, by placing it on top of the centrifuge tube. The rotary and/or lifting motions generated in the mechanism can be transmitted by a shaft or pestles onto the devices that are to be moved.

Devices according to embodiments according to the present invention can be configured, in particular, as disposable items such as, for example, with pre-stored reagents that are disposed of after having been used for a process for which they are suitable and the eluate has been removed.

Figure 13:
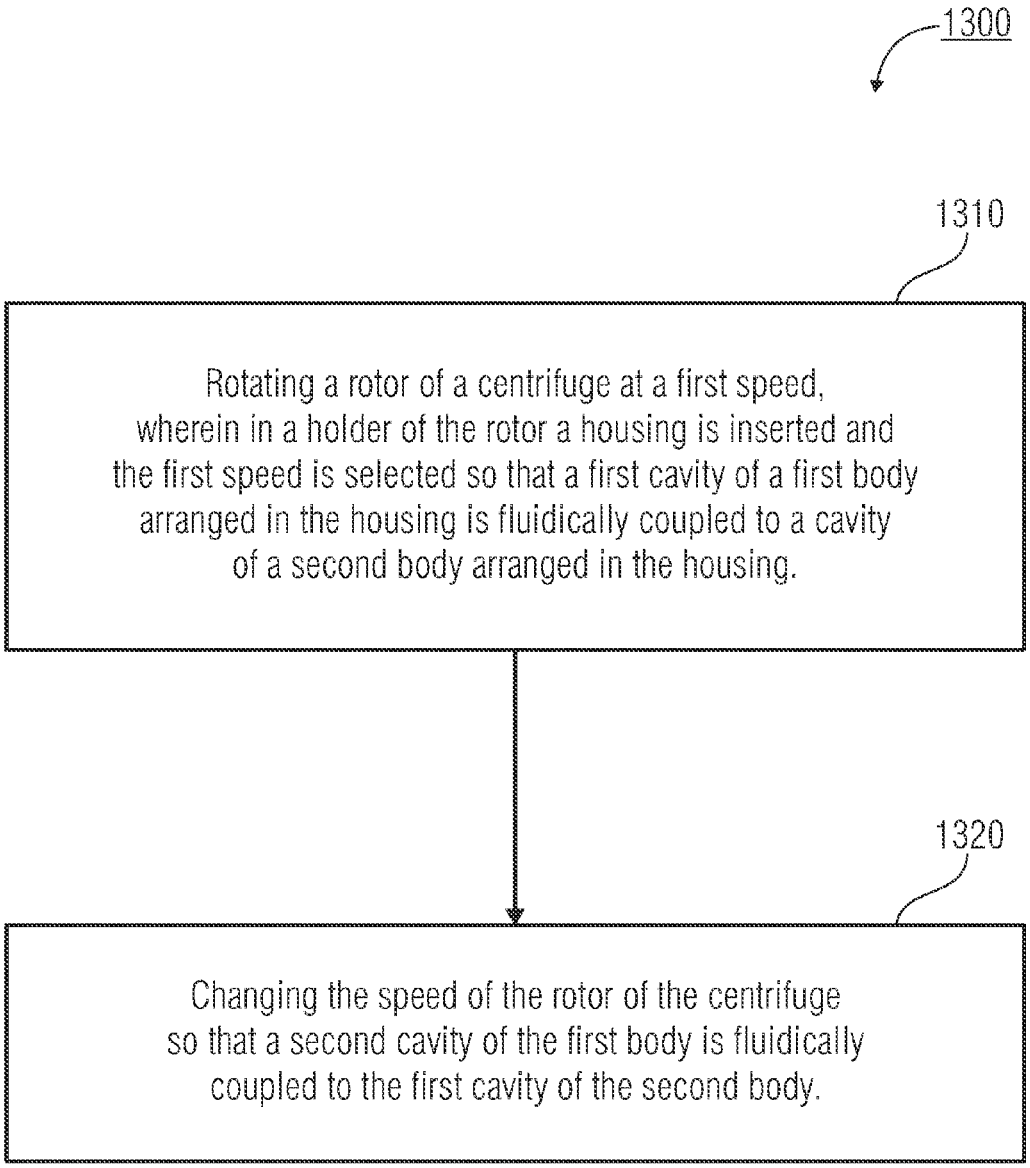
FIG. 13 is a flow diagram of a method according to an embodiment of the present invention.

FIG. 13 shows a flow diagram of a method 1300 for fluidically coupling cavities according to an embodiment of the present invention. The method 1300 comprises a first step 1310 of rotating a rotor of a centrifuge having a first speed. A housing is inserted into a holder of the rotor and in which there are disposed at least two stacked bodies in a stocking direction. The at least two bodies that are stacked one above the other are disposed in the stacking direction such that, upon a rotation of the rotor, a spacing of one of the at least two bodies is smaller in relation to the axis of rotation of the rotor than a spacing of another of the at least two bodies in relation to the axis of rotation of the rotor. A first of the at least two bodies includes at least a first and a second cavity, and a second of the at least two bodies includes at least one first cavity. The at least two bodies are movably disposed in relation to each other in the housing in order to, in response to a rotation of the rotor in a first phase, fluidically couple the first cavity of the first body to the first cavity of the second cavity, and in order to fluidically couple in a second phase the second cavity of the first body to the first cavity of the second body. The first velocity is chosen such that the first cavity of the first body is fluidically coupled to the first cavity of the second body. This way, in the first phase, a liquid or fluid that is present in the first cavity can flow into the first cavity of the second body if the first body is radially disposed further to the inside than the second body, or, if the first body is radially disposed further to the outside than the second body, a liquid or fluid that is present in the first cavity of the second body can flow into the first cavity of the first body.

Furthermore, the method 1300 comprises a step 1310 of changing the velocity of the rotor of the centrifuge such that the second cavity of the first body is fluidically coupled to the first cavity of the second body. If the first body is radially disposed further to the inside than the second body, a liquid that is present in the second cavity of the first body can flow into to the first cavity of the second body and be blended, for example, with a liquid that is present therein. If the first body is disposed radially further to the outside than the second body, a liquid that is present in the first cavity of the second can flow into the second cavity of the first body and be blended therein, for example, with a previously pre-stored liquid.

The method 1300 can be utilized, for example, for blending different liquids and/or reagents that are pre-stored according to an embodiment of the present invention in the device in order to implement, for example, a (bio)chemical process such as, for example, a DNA extraction.

According to further embodiments, to blend several liquids and/or to fluidically couple different cavities to each other, it is possible to implement step 1320 of changing the velocity of the rotor as many times as desired, for example, depending on the needed process steps.

Below, using FIGS. 14 and 15AA-15BC, there follows a description of an exemplary application of the device 700 according to FIG. 7 for a DNA extraction based on the method 1300 according to FIG. 13. The device 700 and further devices according to embodiments according to the present invention are also suitable for automating other (bio)chemical processes.

Figure 14:
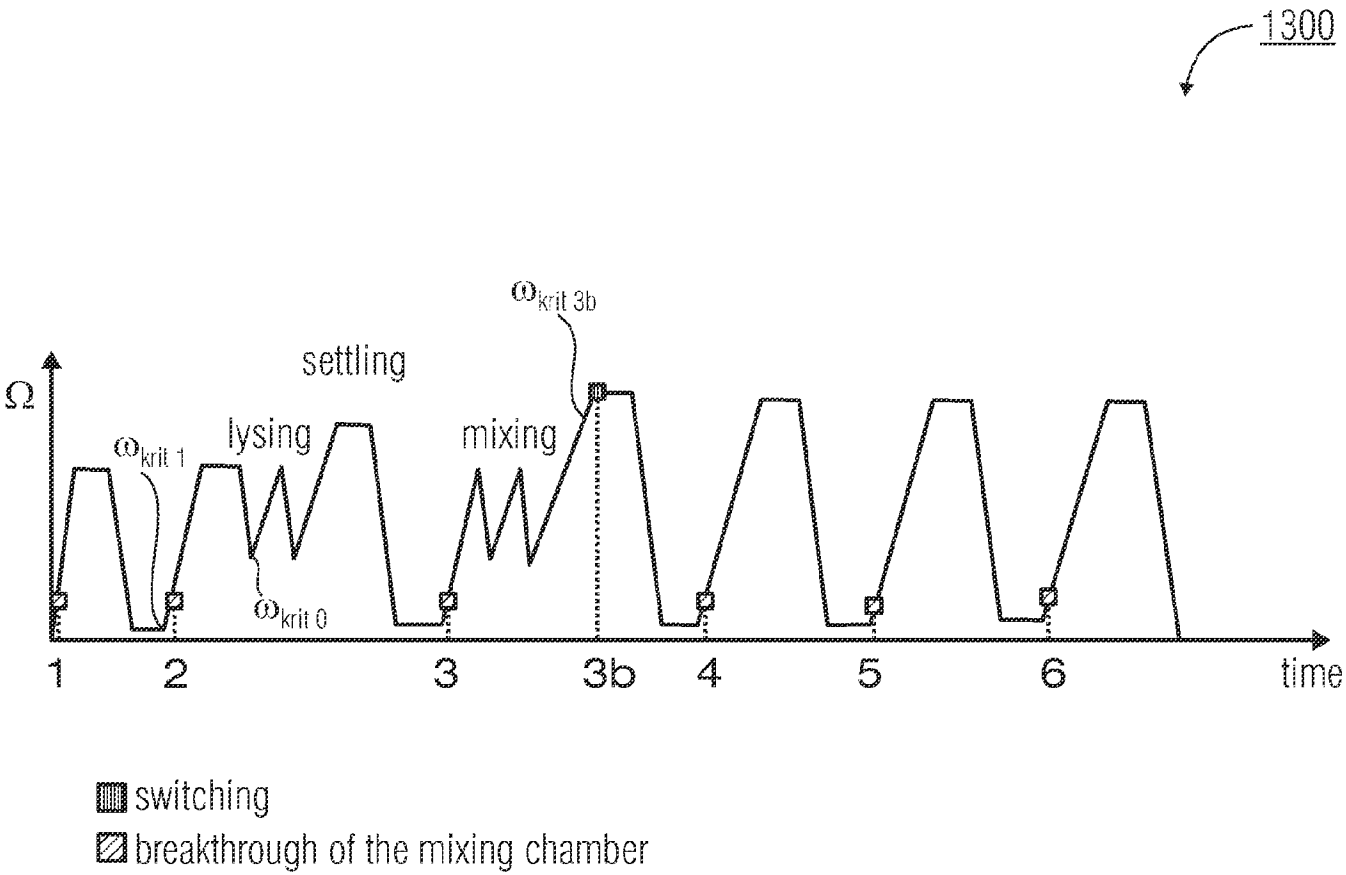
FIG. 14 is a diagram between time and angular velocity of a rotor of a centrifuge in an method for the fluidic coupling of multiple cavities according to an embodiment of the present invention.

FIG. 14 depicts a diagram of angular velocity over time of a rotor of a centrifuge for a method of fluidically coupling multiple cavities according to an embodiment of the present invention. Ω therein stands for the angular velocity of the rotor of the centrifuge. The time points associated with the numbering 1 to 6, which are marked by black points, indicate time points when the device 700 transitions from one phase to the next phase. A cross-hatched box indicates when a break-through of the mixing chamber 160*a* of the second revolver 120 occurs.

Figure 15A:
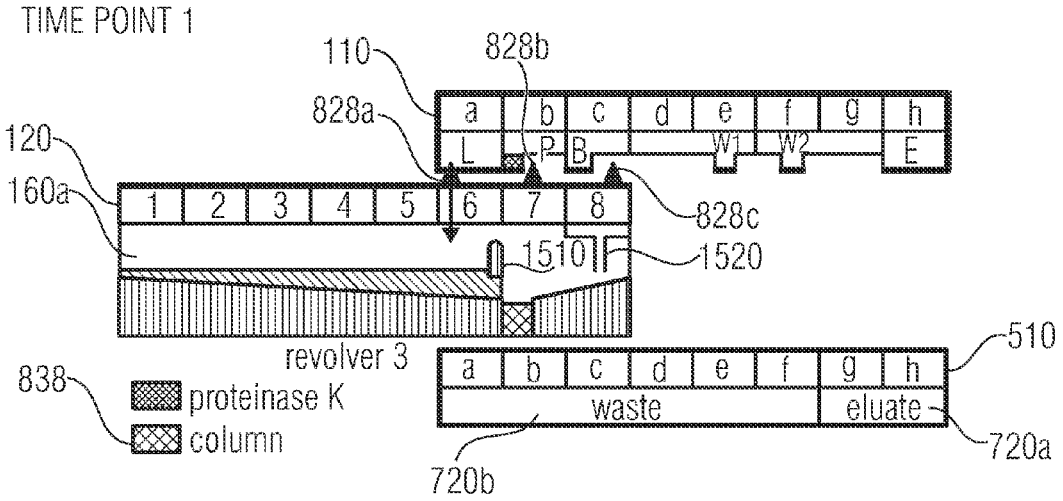
FIGS. 15AA-15BC are schematic representations of bodies of a device according to an embodiment of the present invention such as can be encountered in connection with the implementation of the method from FIG. 14.
Figure 15A:
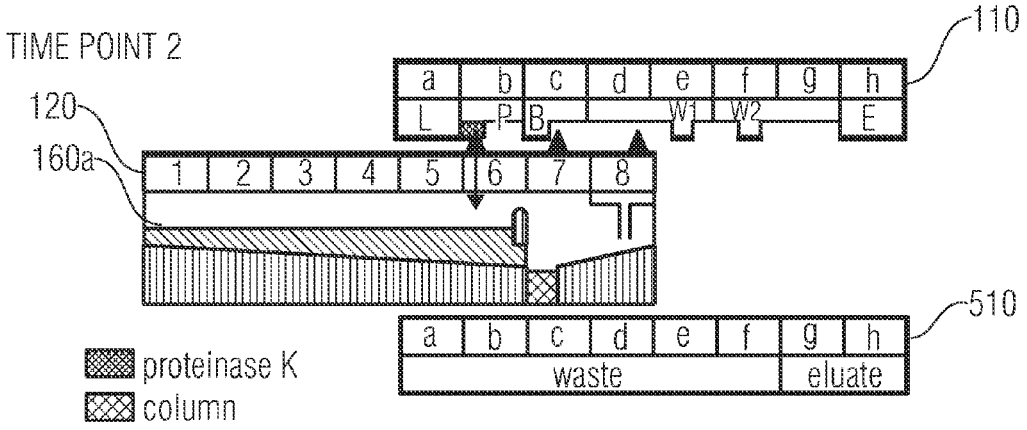
Figure 15A:
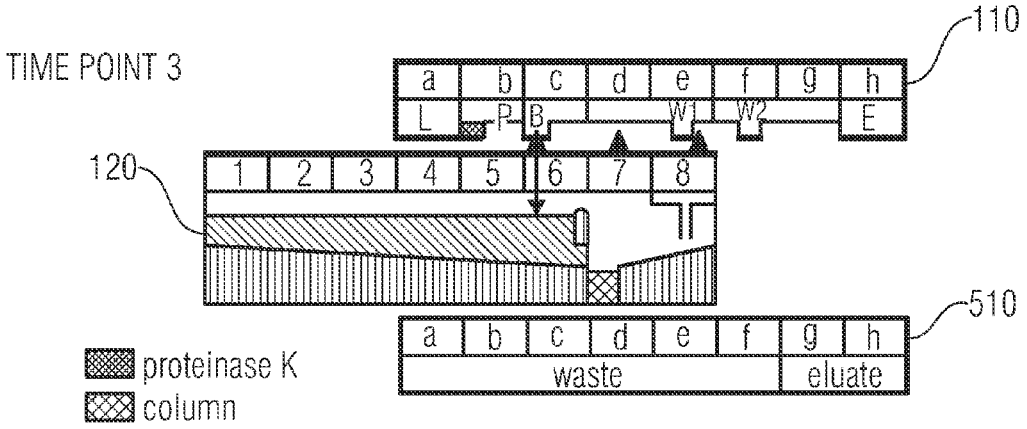

FIGS. 15AA-15BC indicate states of the individual revolvers 110, 120, 510 in relation to each other as they occur with the implementation of the method 1300 utilizing the angular velocity over time diagram according to FIG. 14. FIGS. 15AA-15BC thus demonstrate a process graphic of a process flow in the device 700 using an exemplary DNA extraction. The current liquid flow is characterized by an arrow, respectively. The revolvers are represented as rolled down. Inside the cavities of the first revolver 110, there are located all the reagent that are to be pre-stored. The second revolver 120 accommodates the mixing chamber 160*a* and a predetermined breaking point 1510 such as has been described, for example, in FIG. 4B. The third revolver 510 is a collecting revolver for the effluent (waste) into the waste collecting container (in the waste chamber) 720*b* and the eluate in the eluate collecting container (in the eluate chamber) 720*a*.

In the container unit (of device 700) as shown in FIGS. 15AA-15AC, the binding buffer (B), the lysis buffer (L), the two wash buffers (W1, W2) and the elution buffer (E) are pre-stored in the first revolver 110. A chromatographic column 838 and a mixing device 730 (not shown in FIGS. 15AA-15AC) are integrated in the second revolver 120.

Before being able to start the DNA extraction, the following manual steps are needed. A sample is pipetted into a chamber (cavity (P)) of the first revolver 110, for which purpose the lid if the same is perforated. The sample rehydrates the lyophilisated pre-stored proteinase therein. Subsequently, the centrifuge tube (the device 700) is transferred to the centrifuge, the lid of the centrifuge is closed and a stored or manually entered program with frequency profiles is started.

The following steps are automatically implemented by the centrifuge without any need for user involvement.

In a first step of the method (for example, step 1310 of method 1300), the centrifuge accelerates the rotor to a preset angular velocity $\omega_{max}$. The integrated spring 710 of revolvers 110, 120, 510 is compressed, and the revolvers 110, 120, 510 move radially to the outside. After a further angular velocity $\omega_{krit2}$ is reached, the second revolver 120 leaves the guide of the sleeve 130 (the guide grooves 816 of the housing 830) and is able to twist along its axis of rotation 250. This occurs due to the guide structure in the first revolver 110 (due to the profile teeth 826 of the first revolver 110), and the spacing between the first revolver 110 and the second revolver 120 is reduced whereby one of the piercers (in the concrete embodiment the first piercer 828*a*) perforates an upper cavity (L) of the first revolver 110 that contains the lysis buffer. The lysis buffer flows into the second revolver 120. After a preset amount of time, the rotor in the centrifuge is decelerated. The spring 710 presses the revolvers 110, 120, 510 radially to the inside as soon as the velocity falls below an angular velocity $\omega_{kritO}$. A force component is occurs on the slanted profiles that are fastened to the second revolver 120 and the sleeve 130 (meaning at the guide grooves 834 of the second revolver 120 and the delimitations of the guide grooves 816 of the housing 130) that further twists the second revolver 120 in relation to the remaining components. A twisting action of the first body 110 is prevented due to the engagement of the guide springs 824 of the first body 110 with the guide grooves 816 of the housing 130. Any twisting of the third body 510 is prohibited by the outer bars 854 of the third body 510. In other words, in the first step, a lower lid and/or a lower closing means of a cavity (L) is perforated by the first revolver 110, and the lysis buffer is centrifuged into the mixing chamber 160*a* of the second revolver 120.

In a further step (FIG. 15AB), such as, for example, step 1320 of method 1300, the cavity of the sample is perforated by the first piercer 828*a*, the sample also reaches the mixing chamber 160*a* of the second revolvers 120. Lysis buffer and sample collect inside the mixing chamber 160*a*, which can also have installed therein sedimentation cavities. By changing the angular velocity of the centrifuge, the mixing process inside the second revolver (in mixing chamber 160*a*) is triggered. Sample and lysis are blended inside cavity 160*a* (and/or the mixing chamber 160*a*) in the second revolver 120. Bacteria and other solid materials of higher density than the liquid mixture can be removed by sedimentation. In other words, the sample is centrifuged into the mixing chamber 160*a* and mixed, and therein cells are lysated and insoluble cell components subsequently precipitated, if needed.

In a further step (FIG. 15AC), after a certain mixing period, a cavity (B) of the binding buffer is perforated by the second piercer 828*b* and reaches the mixing chamber 160*a*. The mixing action is repeated.

In a further step (FIG. 15BA), a valve is switched in the mixing chamber 160*a*. The mixture is conveyed by centrifugal force over the column 838 into the waste chamber (the waste collecting container) 720*b* of the third revolver 510. By way of an example, four different possibilities for valve switching will be specified below. A first possibility is capillary filling of a siphon when the rotary frequency of the centrifuge falls below a critical value $\omega_{krit3a}$. A second possibility is an overflow siphon that is switched by a further perforation step in which an additional binding buffer is introduced into the system. A third possibility is that a further piercer, such as, for example, in the second revolver 120, perforates a target location inside the mixing chamber 160*a*. A fourth possibility, as shown in FIGS. 15AA-15BC, provides that a predetermined breaking point 1510 is switched upon acceleration above a critical rotary frequency $\omega_{krit3b}$. The result is the same with all four possible options; the DNA therein binds to the chromatographic column 838, whereby the DNA from the sample binds to the chromatographic column 838 and is thus present bonded to the chromatographic column 838. In other words, in the concrete embodiment as shown in FIGS. 15AA-15BC, the centrifugation frequency is increased. The mixture of sample, lysis buffer and binding buffer is guided over the DNA-binding (chromatographic) column 838. The passing liquid is collected in the waste chamber 720*b* of the third revolver 510.

Figure 15B:
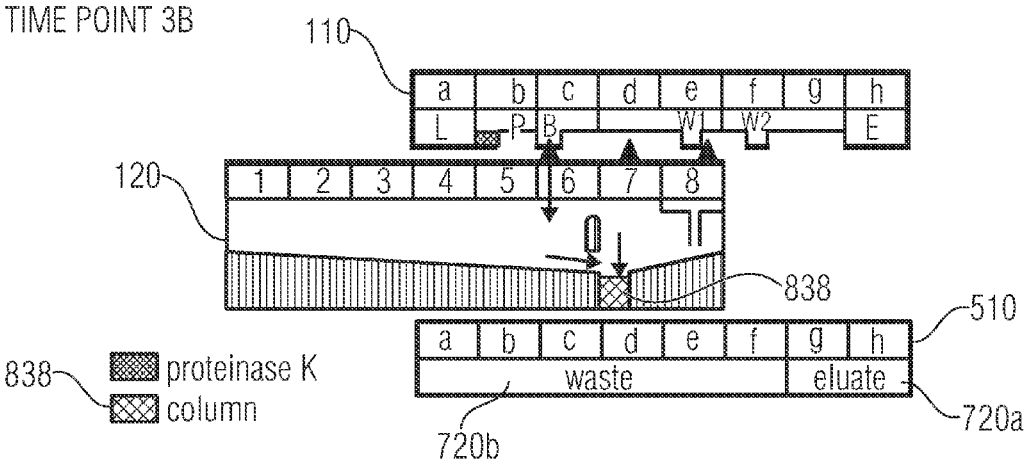
Figure 15B:
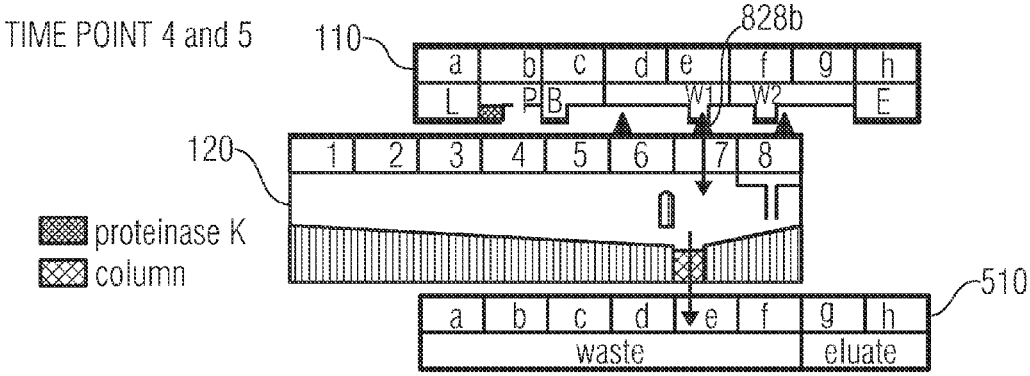
Figure 15B:
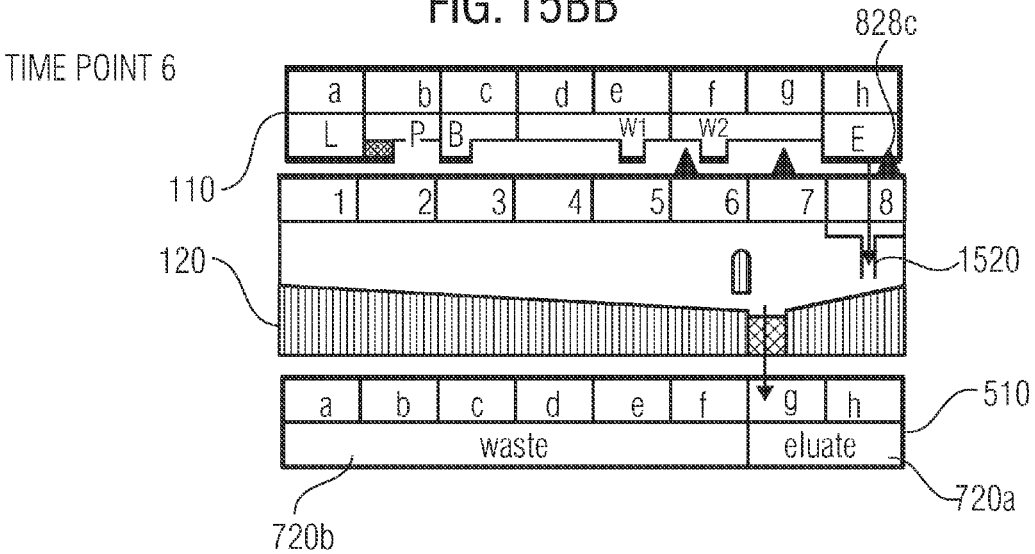

The cavities (W1, W2) with a wash buffer inside are perforated in a fourth and fifth steps (FIG. 15BB). The wash buffers are introduced into the waste chamber 720*b* of the third revolver 510 via column 838. The second revolver 120 (mixing chamber 160*a* of the second revolver 120) is washed. Depending on the quality of the washing, of the starting substances, only the DNA of the sample in the second revolver 120 is left bonded to the column 838. The cavities (W1, W2) of the wash buffer herein are perforated by the second piercer 828*b* of the second revolver 120, as shown in the concrete embodiment. In other words, the two wash buffers are successively routed over the column 838. The wash buffers are collected in the waste chamber (in the effluent collecting container) of the third revolver 510.

The elution buffer (E) is centrifuged over the column 838 in the final centrifuging step (FIG. 15BC). Column 838 of the second revolver 120 is located therein above the eluate chamber 720*a* of the third revolver 510. The elution buffer (E) dissolves the bonded DNA, and the eluate is collected in a cavity (in the eluate chamber 720*a*) in the third revolver 510. In the concrete embodiment shown here, a cavity (E) of the elution buffer is perforated via the third piercer 828*c*. According to some embodiments, the elution buffer can be routed via a special fluid guide 1520 (for example, the third fluid guide 829*c* according to FIGS. 8CA-8CE) within the mixing chamber 160*a* of the second body 120. Said fluid guide 1520 can serve, for example, to influence a flow velocity of the elution buffer.

The reconcentrated DNA in the elution buffer is now located inside the eluate chamber 720*a*. All further substances are located inside the waste chamber 720*b*. The rotor of the centrifuge now comes to a halt and the started program is complete.

The centrifuge tube (device 700) can now be removed from the rotor of the centrifuge, and the reconcentrated DNA can be removed from the centrifuge tube (of the device 700), for example, by removal of the third revolver 510 and made available for further processing.

According to further embodiments, the revolvers 110, 120, 510, as shown in FIGS. 15AA-15BC, can also be microtiter plates 110, 120, 510 having cavities that can be displaced in relation to each other in a translational fashion.

The method shown herein in connection with the device 700 offers, particularly in comparison with manual methods, the advantage that the individual steps for blending the sample with the different reagents do not have to be implemented manually; instead, they are implemented in an automated fashion inside the centrifuge and as a function of the centrifugation protocol. In a manual process, the centrifuge would have to be stopped after each of the individually outlined steps in order to add to the sample, by pipetting, the reagents needed for a given step such as, for example, binding buffer, wash buffer or eluate. The presently outlined method realizes tremendous time and cost advantages, in particular, for the processing of large volumes. Moreover, a standard centrifuge can be used to implement the outlined method (for example, a swing-out or fixed-angle centrifuge) that is available as part of the instrumentation in any standard laboratory. Special instruments as envisioned by standard technology are not needed for the method according to the presently outlined devices.

According to some embodiments, a device according to an embodiment of the present invention can also be configured in a microtiter plate format, such as, for example, for handling immunoassays. Conducting immunoassays on stacked bodies or microtiter plates can be done, for example, in that the stacked bodies shift in relation to each other, utilizing the ball point pen mechanism, in two directions inside the laboratory centrifuge, whereby one channel output is able to address several channel inputs.

For example, a protocol for an immunoassay (sandwich immunoassay) can be implemented in a device according to a present embodiment. The immunoassay protocol therein can comprise the steps that follow. In a first step, the sample is applied to a microtiter plate. Subsequently, it is possible to carry out three to five wash steps, thereafter adding a second antibody (detection antibody). After three to five further wash steps, a substrate can be added. In the last step, it is possible to implement a detection (for example, using a technique that is known to the person skilled in the art, such as chemiluminescence, fluorescence, dying reaction, GMR, gold particles, etc.), for example, in an external reader instrument for microtiter plates.

Figure 16:
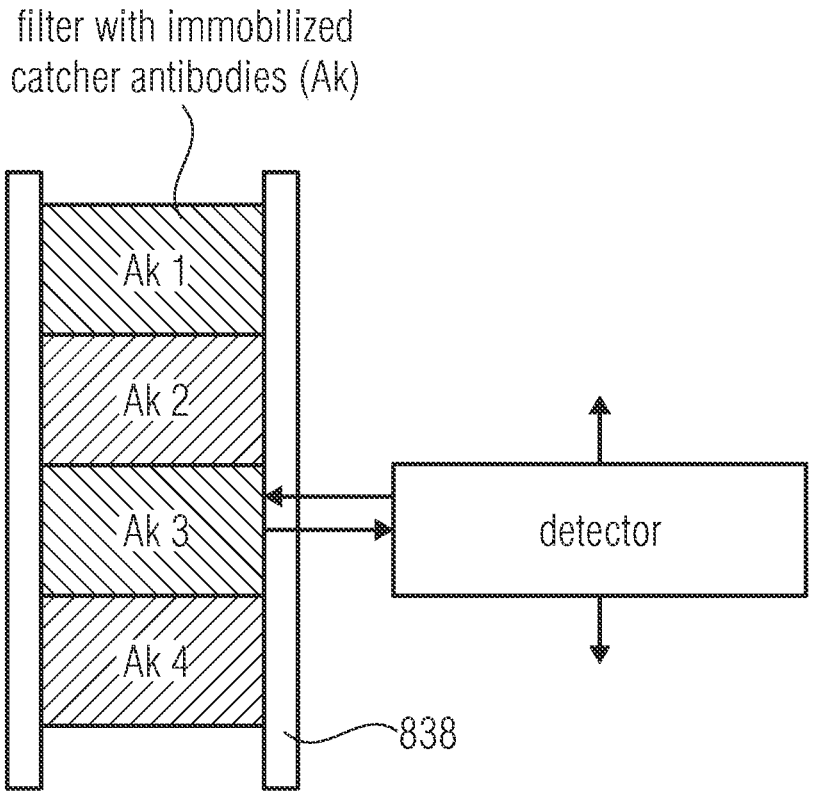
FIG. 16 is a schematic representation of a possible embodiment of a column that can be configured inside a cavity of a body of the device according to an embodiment of the present invention.

To detect different parameters simultaneously, it is possible to configure column 838 as shown in FIG. 16. FIG. 16, therefore, shows a column 838 for detecting different parameters simultaneously. Various catcher antibodies (Ak1 to Ak4) are vertically immobilized in substrates in column 838. It is thus possible to test a sample for several antigens at the same time (with the aid of the detector).

Further, a device according to an embodiment of the present invention can be used in the synthesis of radioactive compounds. In (K. Hamacher, H. H. Coenen, G. Stocklin; "Efficient Stereospecific Synthesis of No-Carrier-Added 2-[18F]-Fluoro-2-Deoxy-D-Glucose Using Aminopolyether Supported Nucleophilic Substitution," *Journal of Nuclear Medicine*; February 1986) provides and example for a synthesis of this kind. Any production of radioisotopes outside of the device can be achieved with the aid of a positron emitter by shooting at a so-called target as a gas or liquid inside a cyclotron. The steps that are to be implemented inside the device (in part also a solid-phase reactions) can be the following as in indicated below.

A first step could be a phase transfer for transferring the radioisotopes (for example, 18F) from the target liquid (for example, H218O) into an organic solvent. Subsequently, the isotope-labeling of the starting material can occur. Then follows the removal of the protective groups of the labeled starting material and finally a cleaning step.

Embodiments according to the present invention thus relate to devices and methods for the automated handling of liquids using a standard laboratory centrifuge. Processes that can be automated include chemical or (bio)chemical preparative or he analytical processes.

Embodiments according to the present invention rely on the ideal of automating individual process steps for simplified handling of process liquids, as well as the development of cost-effective and very compact systems in connection with the development of lab-on-a-chip systems.

Embodiments according to the present invention can be used for processing different volumes of liquids, as needed.

The lab-on-a-chip systems as described by standard technology often suffer from the disadvantage that automated processes can only comprise a few steps in the context of these systems, and with the sensitivity of these processes being limited. Lab-on-a-chip systems consisting of a solid material carrier as well as a standard laboratory device such as, for example, a laboratory centrifuge, used for actuating the solid material carrier, have not been known to date. Standard laboratory instruments (laboratory centrifuges) are part of the basic equipment encountered in almost any laboratory. If it were possible to process such a lab-on-a-chip cartridge using such a standard laboratory instrument, the user would not have to acquire any special equipment to automate processes involving the cartridge. Any barrier to a market launch of such a cartridge would, therefore, be lowered in comparison to the application of common lab-on-a-chip systems or pipetting robots. Embodiments according to the present invention solve this specified problem in that by using a standard laboratory centrifuge it is possible to automate the processing of liquids.

The actuation principle of centrifuging as specified in the embodiments is applied as an essential process component in many (bio)chemical processes (synthesis, analysis and filtration) anyway. The centrifugal force therein is utilized for conveying liquids from a process step that is radially further inside to a process step that is radially further outside or for materials separation based on differences in material densities. Embodiments according to the present invention, therefore, do not need any (or only insignificantly increased) complexity with regard to the implementation of (bio) chemical processes.

Embodiments are significantly less expensive and provide greatly simplified handling, in particular, in contrast to especially developed centrifuge systems, for example, as described in specifications U.S. Pat. No. 5,045,047 and U.S. Pat. No. 5,087,369. None of the named specifications describes simply an insert that is integrated in a standard centrifuge for a fully automated implementation of a desired process, such as, for example, DNA extraction.

According to some embodiments, an actuation mechanism is used to achieve a displacement of the bodies that is characterized in that the variable centrifugal force interacts with a restoring force that is independent of the centrifugation (for example, a spring force, magnetic force, gravitational force), whereby a change of the centrifugation frequency causes a motion of an actor. Depending on the configuration of the mechanism, the motion can be linear, rotary or guided along certain paths. Different mechanisms have been named herein (ratchet and ball point pen mechanisms) that perform such a function. Upon increasing the centrifugation frequency, it is possible for the motion of the actor to act in one direction, while a lowering of the frequency will cause the motion of the actor to act in the other direction. According to some embodiments, the motion of the actor is able to power the ratchet mechanism, which causes an advancement only in one direction. The advancement therein, however, can also be linked to a lifting motion with an additional directional component. Said lifting motion can be executed, as shown in the context with the ball point pen mechanism, in a bistable fashion.

According to some embodiments, the configuration of the bodies can depend in part on the selected configuration of the container unit (of the device). In case of a rotary design of the device, it is possible to insert bodies in the centrifuge tube (in the device) that are configured as cylindrical revolvers. A revolver therein can include a basic body, an axis of rotation and concentrically disposed channels (cavities). The channels can be unilateral or bilaterally provided with a valve or a lid (or a closing means), thereby constituting a cavity.

In case of a translational design of the devices of the present invention, it is possible for bodies to be configured as microtiter plates, meaning plates having a field of row-type channels, wherein the same can be closed, as in the rotary configuration, by means of valves or lids in order to constitute cavities. As described above, in all embodiment variants, the cavities can be loaded with process means, or they can contain micro-fluidically functional inserts or structures (as shown in FIGS. 4A-4I).

According to some embodiments of the present invention, it is possible to use, on the one hand, the centrifugal force and, on the other hand, the restoring force are used to power the actuation mechanism. The restoring force can, as mentioned above, be caused by a spring, a magnetic field or a gravitational field. Especially easy in terms of achieving an embodiment is a solution with a spring such as, for example, as component of a body, which can be easily manufactured by an injection molding process.

According to further embodiments, a process control can be needed in the context of quality management. Said process control can be implemented, for example, using a mechanical counter or other count-keeping systems by way of a phase indicator that is integrated or coupled to the device, as envisioned by some of the embodiment according to the invention. Using any such counter, it is possible to check if the needed number of twists of the stacked unit, which is needed for a successful processing, has occurred. A simple counter can be realized by applying labels and a scale on components of the device that move in relation to each other. In the alternative, instead of numbers, it is possible to use lettering that characterizes a given current process step. In FIGS. 8CA and 8CC, this can be seen by the lettering 842 as shown on the outer side of the second body 120.

The person skilled in the art is familiar with possible manufacturing processes for devices according to embodiments of the present invention. For mass production of the device, the advantageous manufacturing type can be an injection molding process; for prototyping (prototype design), lathing, milling and stereolithography can be advantageous.

According to some embodiments of the present invention, a device can be constituted partially or entirely of a plastic material. In particular, it is possible to manufacture embodiments of the present invention as disposable items.

The cavities of the units (bodies) of the devices can be, such as, for example, for pre-storing liquids, be closed with a lid (closing means). Various methods are available for this aspect as well. Correspondingly, a closing means can be, for example, a glued or a self-adhesive connection by means of a self-adhesive film attached via solvent bonding or thermal bonding. Advantageous is the use of capping films having good barrier properties that can be easily opened by a piercer and that include, for example, a plastic-coated aluminum film.

An advantage of embodiments according to the present invention is, correspondingly, the aspect of automating (bio)chemical processes in a laboratory centrifuge, which is part of the basic equipment in most laboratories worldwide. No additional, expensive laboratory instruments are needed or an automation of processes by means of the device according to the invention. This facilitates any market launch and penetration of embodiments according to the present invention.

A further essential advantage of embodiments according to the present invention is their variability in terms of applications. Thus, it is possible to automate (bio)chemical processes of the most varied kind. Moreover, any contamination risk during the process is considerably lowered, because this is a closed system.

A further advantage is the fact that no professionally trained personnel is needed for the implementation of the process.

In addition, the production costs for embodiments according to the present invention are not considerably higher (or only insignificantly higher) than for disposable items that can be needed for the manual or automated processing of (bio) chemical processes. This is accompanied by the advantage that the automation of laboratory processes by means of embodiments of the present invention is superior to manual process handling even for small sample volumes; moreover, the expenditure for large sample volumes is also not higher than for an automated solution that is based, for example, on pipetting robots or special centrifuges.

A multitude of laboratory protocols that are known to the person skilled in the art can be implemented by embodiments of the present invention. For example, possible implementations are: DNA extraction, immunoassay, nucleic acid analytics (possibly with recombinase polymerase amplification (RPA)), protein filtration, HPLC/purification, laboratory protocols, foodstuffs monitoring, or even the synthesis of radioactive compounds (radiopharmaceuticals) for nuclear medical applications.

By way of a summary, some of the properties of some embodiments according to the present invention shall be captioned in the following.

According to some embodiments, the action of sequentially bringing the cavities of the bodies of the device into fluidic contact can be achieved specifically in such a way that the bodies are displaced in a tangential direction in relation to each other without any need for removing the device from the centrifuge to this end. In a first centrifugation step therein, a material can be conveyed from a first source channel that is located radially further to the inside into a target channel of a second body that is located radially further to the outside. After a relative displacement of the two bodies, in a second centrifugation step, it is possible to convey a material from a second source channel of the first body that is located radially further inside to the same target channel that is located radially further outside. This way, by executing further centrifugation steps, it is possible to embody a flow of process steps in the course of which different auxiliary process materials that are involved in the process can be sequentially brought into contact with each other.

According to embodiments of the present invention, it is possible for the mutual displacement of the bodies to be initiated by the centrifugation protocol, while the energy that is needed for the displacement is obtained from the centrifugation energy. A point in time and/or extent of the displacement can be determined by a, in terms of time, changing centrifugation frequency. The mutual displacement of the bodies can be executed in a linear or rotary fashion; moreover, said mutual displacement of the bodies can be triggered, in particular, by an actuation mechanism that causes, based on the interaction of the variable centrifugal force with a restoring force that is independent of the centrifugation (for example, a spring force, magnetic force, gravitational force), a positional change of the two bodies in relation to each other. A change of the centrifugation frequency therein can cause movement of an actor, and wherein the movement can be linear, rotary or extending along a preset path, depending on the configuration of the mechanism. Upon increasing the centrifugation frequency, the actor can, for example, move in one direction; upon the centrifugation frequency being lowered, the actor can move in the other direction. The actuation mechanism therein can be utilized, for example, in order to power a ratchet mechanism that facilitates an advancing motion of the actor only in one direction, wherein said direction of advancement can also be linear, rotary or along a certain path.

According to some embodiments, the advancing motion of the actor can also be coupled to an additional movement in another direction, such as, for example, a lifting motion. Said lifting motion can be executed, in particular, in a bistable fashion, whereby a movement is achieved that finds its application in the pressure mechanism of a ball point pen. Said pressure mechanism can be powered in this way by a changeable centrifugal force, whereby with each step the mechanism can be advanced by one step, thus resulting in a gradual mutual displacement of adjacent bodies. This way, it is possible to bring different channel outputs sequentially into contact with different channel inputs (and/or different cavities). Simultaneously, some embodiments provide that the use of the pressure mechanism will allow for executing a bistable lifting motion, if needed, that results in a change of the spacing of the bodies in relation to each other. In particular, the change of the spacing can be used to cause the perforating action of the lid (the closing means) of a cavity, at a defined point in time and/or process step, by means of a piercer. This way, it is possible to embody a valve that can be used as a control means for the process that is to be automated.

According to some embodiments, as described previously, it is possible for the cavities of the individual bodies to have lids that can be opened automatically while the centrifugation protocol runs. The lids can be opened by means of a piercer or, for example, by centrifugal pressure. The liquid or solid materials that are contained inside the cavities can then be transported, using centrifugal force, from a cavity located radially further inside to a cavity located radially further outside.

According to some embodiments, the bodies that are stacked one above the other can be separated from each other.

According to further embodiments, the restoring means is configured such that a first amount of a force, which is based on a centrifugal force and acts in the opposite direction of the restoring force, is greater at a first angular velocity in the first phase than an amount of the restoring force; and configured such that a second amount of the force, acting in the opposite direction of the restoring force, is smaller at a second angular velocity during a transition from the first to the second phase than the amount of the restoring force. The force that is based on the centrifugal force can be generated by a redirection of the centrifugal force such as, for example, with the aid of a mechanical, hydraulic, pneumatic or similar means and can act in a different direction that the centrifugal force.

According to further embodiments, the restoring means can be configured such that a first amount of a component of the centrifugal force acting in the opposite direction to the restoring force is greater at a first angular velocity in the first phase than an amount of the restoring force, whereby a second amount of the component of the centrifugal force acting in the direction opposite to the direction of the restoring force is smaller at a second angular velocity during a transition from the first to the second phase than the amount of the restoring force such that, during the transition from the first phase to the second phase, at least one of the at least two bodies moves within the housing.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for insertion into a rotor of a centrifuge comprising:

at least two bodies stacked one above the other; and a housing that is configured in order to be inserted into a holder of the rotor of the centrifuge;

wherein the at least two bodies in the housing are disposed in a stacking direction in such a way that, upon a correct reception of the device in the rotor of the centrifuge and rotation of the rotor, a spacing of one body of the at least two bodies in relation to an axis of rotation of the rotor is smaller than a spacing of another body of the at least two bodies in relation to the axis of rotation of the rotor;

wherein a first body of the at least two bodies comprises at least one first cavity and a second cavity;

wherein a second body of the at least two bodies comprises at least one first cavity;

wherein the at least two bodies are movably disposed in relation to each other inside the housing in order to fluidically couple in a first phase, responding to a rotation of the rotor, the first cavity of the first body to the first cavity of the second body and in order to fluidically couple, in a second phase, the second cavity of the first body to the first cavity of the second body;

a restorer;

wherein the restorer exercises a restoring force on at least one of the at least two bodies in order to hold, depending on the angular velocity of the rotor, the at least two bodies in a given position in relation to the housing; and wherein the restorer is configured such that a first amount of a force that is based on a centrifugal force acting in a direction opposite to the restoring force is greater at a first angular velocity in the first phase than an amount of the restoring force, and such that a second amount of the force acting in the direction opposite the restoring force is smaller at a second angular velocity during a transition from the first phase to the second phase than the amount of the restoring force such that during the transition from the first phase to the second phase at least one of the at least two bodies moves inside the housing.

2. The device according to claim 1, which is further configured such that, during the transition from the first phase to the second phase, a position of the at least two bodies changes in relation to the one another such that a position of the first body in relation to the second body is different in the first phase from a position of the first body in relation to the second body in the second phase, wherein the device is, furthermore, configured such that the transition from the first phase to the second phase occurs in response to a change of an angular velocity of the rotor in relation to the angular velocity of the rotor in the first phase.

3. The device according to claim 1, which is further configured such that the transition from the first phase to the second phase occurs without a change in the direction of rotation of the rotor of the centrifuge.

4. The device according to claim 1, which is further configured such that an amount of a first angular velocity of the rotor in the first phase and an amount of a second angular velocity of the rotor in the second phase are higher than an amount of a third angular velocity during the transition from the first phase to the second phase.

5. The device according to claim 1, wherein at least one of the cavities of the first body comprises a closer on a side that is directed to the first cavity of the second body, wherein the device is configured such that the closer is opened in the corresponding one of the first phase or the second phase in which the cavity of the first body, which comprises the closer, is fluidically coupled to the first cavity of the second body.

6. The device according to claim 5, wherein the closer is a membrane and wherein the second body comprises at least one piercer on the side that is directed toward the first body that is configured such as to perforate the membrane.

7. The device according to claim 5, wherein the closer is a pressure-sensitive membrane, wherein the pressure-sensitive membrane is configured such that, responding to a pressure of a reagent, which is present in the cavity, that is generated by increasing the angular velocity of the rotor of the centrifuge, the closer bursts open.

8. The device according to claim 1, wherein the at least two bodies are configured as microtiter plates, wherein the device is, furthermore, configured such that, during the transition from the first phase to the second phase, the at least two bodies are displaced in relation to each other.

9. The device according to claim 1, wherein at least two bodies are cylinder-shaped bodies comprising a cover side, respectively, and a base side that is located opposite thereto in the stacking direction;

wherein a base side of the first body is disposed opposite a cover side of the second body;

wherein the first cavity of the first body and the second cavity of the first body border on the base side of the first body;

wherein the first cavity of the second body borders on the cover side of the second body; and wherein the device is, furthermore, configured such that, during the transition from the first phase to the second phase, the second body twists in relation to the first body around an axis of rotation of the at least two bodies extending in the stacking direction.

10. The device according to claim 9, wherein the housing comprises, on an inner side, a plurality of guide grooves that extend in an axial direction along the axis of rotation of the bodies at least in the region of the housing, and wherein the first body comprises, on an outer side, a plurality of guide springs that are configured such that they engage with the plurality of guide grooves of the housing in order to prevent, during the transition from the first phase to the second phase, a twisting action of the first body around the axis of rotation of the bodies.

11. The device according to claim 10 on which, furthermore, the first body comprises a plurality of profile teeth at its base side, which are disposed continuously around the first body, and on which, furthermore, the second body comprises a plurality of guide springs on an outer side;

wherein the plurality of the guide springs of the second body protrude from the cover side of the second body comprising beveled ends, respectively, in an end region where they protrude the cover side;

wherein the plurality of the guide springs of the second body is configured such that they engage, during the transition from the first phase to the second phase, alternately with the plurality of the profile teeth of the first body and the plurality of guide grooves of the housing;

wherein a first guide spring from the plurality of the guide springs of the second body engages in the first phase with a first profile tooth from the plurality of profile teeth of the first body;

wherein the first guide spring of the plurality of guide springs of the second body engages in the second phase with a second profile tooth that is adjacent to the first profile tooth from the plurality of profile teeth of the first body.

12. The device according to claim 1 comprising, furthermore, a ratchet mechanism that is configured such as to change, responding to a rotation of the rotor of the centrifuge, a position of the first body in relation to the second body.

13. The device according to claim 1, wherein the restorer comprises a spring made of a plastic material.

14. The device according to claim 1, wherein a spacing of the at least two bodies in relation to each other is greater during the transition from a first phase to a second phase than a spacing of the at least two bodies in relation to each other in the first phase and in the second phase.

15. The device according to claim 1, wherein the same comprises, furthermore, a third body that is disposed in the stacking direction comprising a first cavity and a second cavity, wherein the device is configured such as to fluidically couple in one phase the first cavity of the third body to the first cavity of the second body and as to fluidically couple in a further phase the second cavity of the third body to the first cavity of the second body.

16. The device according to claim 1, wherein the first body comprises, furthermore, a third cavity, wherein the device is, furthermore, configured such as to, responding to a rotation of the rotor, fluidically couple in a third phase the third cavity of the first body to the first cavity of the second body.

17. The device according to claim 1, wherein the second body comprises a mixing device inside its first cavity;

wherein the mixing device comprises a mixing trough and a separation device comprising at least one passage opening;

wherein, responding to a rotation of the rotor, a distance between at least one wall section of the mixing trough and the separation device is variable such that a liquid that is present inside the mixing trough is pressed through the at least one passage opening of the separation device.

18. The device according to claim 1, wherein the housing comprises at least two housing parts that can be separated from each other such that, in the event of a separation of the at least two housing parts, at least one of the at least two bodies can be removed from the device.

19. The device according to claim 1, wherein the same comprises, furthermore, a phase indicator readable from the outside of the device, wherein the phase indicator is configured such as to indicate the phase that the device is in at the point in time when the reading is taken.

20. The device according to claim 1, wherein at least one of the cavities of the device is accessible from outside of the device.

21. The device according to claim 1, wherein the device comprises plastic material.

22. A centrifuge comprising:

a rotor; and a device for insertion into the rotor of the centrifuge, the device comprising:

at least two bodies stacked one above the other; and a housing that is configured in order to be inserted into a holder of the rotor of the centrifuge;

wherein the at least two bodies in the housing are disposed in a stacking direction in such a way that, upon a correct reception of the device in the rotor of the centrifuge and rotation of the rotor, a spacing of one body of the at least two bodies in relation to an axis of rotation of the rotor is smaller than a spacing of another body of the at least two bodies in relation to the axis of rotation of the rotor;

wherein a first body of the at least two bodies comprises at least one first cavity and a second cavity;

wherein a second body of the at least two bodies comprises at least one first cavity;

wherein the at least two bodies are movably disposed in relation to each other inside the housing in order to fluidically couple in a first phase, responding to a rotation of the rotor, the first cavity of the first body to the first cavity of the second body and in order to fluidically couple, in a second phase, the second cavity of the first body to the first cavity of the second body;

a restorer;

wherein the restorer exercises a restoring force on at least one of the at least two bodies in order to hold, depending on the angular velocity of the restoring force of the rotor, the at least two bodies in a given position in relation to the housing; and wherein the restorer is configured such that a first amount of a force that is based on a centrifugal force acting in a direction opposite to the restoring force is greater at a first angular velocity in the first phase than an amount of the restoring force, and such that a second amount of the force acting in the direction opposite the restoring force is smaller at a second angular velocity during a transition from the first phase to the second phase than the amount of the restoring force such that during the transition from the first phase to the second phase at least one of the at least two bodies moves inside the housing.

23. A method for fluidically coupling cavities using the device according to claim 1, the method comprising:

rotating the rotor of the centrifuge at the first velocity;

wherein the first velocity is selected such that the first cavity of the first body is fluidically coupled to the first cavity of the second body; and changing the velocity of the rotor of the centrifuge such that the second cavity of the first body is fluidically coupled to the first cavity of the second body.

24. A method for producing a labeled starting material wherein the device according to claim 1 is used to fluidically couple cavities, the method comprising:

rotating the rotor of the centrifuge at the first velocity;

wherein the first velocity is selected such that the first cavity of the first body is fluidically coupled to the first cavity of the second body; and changing the velocity of the rotor of the centrifuge such that the second cavity of the first body is fluidically coupled to the first cavity of the second body.

* * * * *